United States Patent [19]

Shiba et al.

[11] Patent Number: 4,880,726

[45] Date of Patent: Nov. 14, 1989

[54] METHOD OF FORMING A COLOR IMAGE

[75] Inventors: Keisuke Shiba; Seiji Ichijima; Kei Sakanoue; Seiichi Taguchi, all of Kanagawa, Japan

[73] Assignee: Fuji Photo Film Co., Ltd., Kanagawa, Japan

[21] Appl. No.: 270,712

[22] Filed: Nov. 14, 1988

[30] Foreign Application Priority Data

Nov. 12, 1987 [JP] Japan ..... 62-285998
May 11, 1988 [JP] Japan ..... 63-112608

[51] Int. Cl.[4] ..... G03C 7/16; G03C 7/30; G03C 7/32

[52] U.S. Cl. ..... 430/376; 430/357; 430/372; 430/383; 430/551

[58] Field of Search ..... 430/372, 376, 383, 357, 430/551; 350/132

[56] References Cited

U.S. PATENT DOCUMENTS 4,247,177 1/1981 Marks et al. ..... 350/132
4,291,109 9/1981 Whitmore ..... 430/367
4,729,944 3/1988 Mihayashi et al. ..... 430/367

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A method of forming a color image wherein a color print original is printed on a printing color photographic material and the thus printed material is then subjected to color development to give a color print, which is characterized in that a band stop filter having a half width of the spectral transmittance curve of said filter in a wavelength range outside the region of the maximum spectral sensitivity wavelength ($\lambda max$)$\pm$20 nm of at least one light-sensitive layer of the printing color photographic material is provided between the light source to be used in said printing step and the light-sensitive layer of said printing color photographic material, and in that a compound of a general formula (I):

$$(C_p).X \qquad (I)$$

wherein $C_p$ represents a coupler residue capable of coupling with the oxidation product of a color developing agent to form a substantially colorless compound or a coupler residue which is coupled during a color development step to form a compound capable of being dissolved or diffused out of the layer of the photographic material; and X represents a group which is in the coupling position of the coupler and which may react with the oxidation product of a developing agent or which may react therewith to be released from the coupler, is incorporated into the light-sensitive layer of the said printing color photographic material or a taking color photographic material from which the said color print original is obtained, or into the interlayer existing between the light-sensitive layers of the said material.

By the present method, excellent color prints can be obtained in short printing times, having reduced interlayer color mixing. pr

19 Claims, 5 Drawing Sheets

METHOD OF FORMING A COLOR IMAGE

FIELD OF THE INVENTION

The present invention relates to a method for forming a color image, and particularly to a method in which a color light-sensitive material is imagewise exposed with light transmitted through a band stop filter.

BACKGROUND OF THE INVENTION

Color photographs from silver halide color photographic materials are increasingly much in demand, and photographed films are forwarded to a process shop at any time and anywhere to rapidly and inexpensively obtain color photographs. There are particular requirements for stabilization of the final quality of color prints, reduction of the defective fraction in formation of color prints and improvement of the image quality, especially the color reproducibility, of color images formed.

Recently, the progress of the techniques of silver halide emulsions and coloring agents used in color photographic materials, as well as those for processing of color photographic materials for color development, is remarkable. However, the technique is suitably printing a printing color photographic material through a print original formed from a taking color photographic material, i.e., the technique of exposing the blue-sensitive layer, the green-sensitive layer or the red-sensitive layer of a printing color photographic material independently and well-balanced for the blue light component, the green light component or the red light component in accordance with a print original remains an important factor for improving the finished image quality.

A method of using a color filter in a printer has been proposed, for example, in U.S. Pat. No. 2,997,389 (French Pat. No. 1,248,376 and JP-A-51-113627—the term "JP-A" as used herein means an "unexamined published Japanese patent application"), so as to stabilize the finished quality of a color photographic image formed. Further, a method of using an optical filter has been proposed in JP-A-53-64037, so as to improve the spectrally sensitivity of the printer sensor for detecting the color tone of a print original as well as to improve the color separation of the light components of blue, green and light for exposure so that the printing color photographic material conforms to the print original. In addition, a method of providing a dye-containing filter layer has been proposed in British Pat. No. 1,015,683, French Pat. No. 1,248,376, JP-B-51-1419 (the term "JP-B" as used herein means an "examined Japanese patent publication") and JP-A-60-45237; and a method of using a substractive color filter together with a filter for removing the intersecting wavelength portions in the spectral sensitivity curves of a copying photographic paper in enlargement printing or copy printing of photographic images by a subtractive process has been proposed in U.S. Pat. No. 4,050,807.

However, there are various problems of interlayer color mixing in the respective light-sensitive materials of a taking color photographic material to be used forming a print original, the spectral transmittance characteristics of the color image formed on the material, the spectral sensitivity distribution of a printing color photographic material and the spectral absorption characteristic of the color image formed on the material, as well as the formation of stains and the side-coloration by residual dyes in the step of color development and the interlayer color mixing during the step of color development. The color separation filters mentioned above cannot satisfactorily be utilized n practice since the practical effects of such filters have not been fully investigated. Since the spectral transmittance characteristics of such filters are not pertinent, the printing time would be prolonged so that the adjustment of the respective exposure components for obtaining color balance would often be rather difficult.

U.S. Pat. No. 4,050,807 and JP-A-53-64037 are silent on the constitutional element for preferred filters.

A means of improving the color reproducibility by incorporating a photographic dye into a color photographic material so as to correct the spectral sensitivity distribution of the material has been described, for example, in JP-B-51-1419. In addition, a means of fixing such a photographic dye in a particular layer in the photographic material is described in U.S. Pat. Nos. 3,247,127, 2,390,707, 2,255,077, 2,493,747, 2,843,486, 4,420,555, 2,548,564, 2,484,430, 3,148,061 and 3,756,814. However, when this technique is applied to a taking color photographic material, the resulting spectral absorption width is broad and the sensitivity of any light-sensitive layer of the color photographic materials lowered. When applied to a printing photographic material, this would often cause side-coloration or residual dyes.

On the other hand, as a color-mixing preventing agent, the compounds represented by formula (I) shown below are used in the photographic material as is disclosed in JP-A-61-20037.

SUMMARY OF THE INVENTION

A first object of the present invention is to provide a method of printing a printing color photographic material through a print original without prolonging the printing time, to obtain a color print which is excellent in finished quality, especially color reproducibility.

A second object of the present invention is to overcome the interlayer color mixing which would occur in the step of color development of a taking color photographic material or a printing color photographic material and to improve the color image-forming material to be used in the printing color photographic material, and as a result, to improve the image quality of the color print formed.

Other object of the present invention will be apparent to one skilled in the art from the description of the specification below.

It has not been found that these and other objects of the present invention may be achieved by a method of forming a color image wherein a color original is printed on a printing color photographic material and the thus printed material is then subjected to color development to give a color print, which is characterized in that a band stop filter having a half width of the spectral transmittance curve of the filter in a wavelength range outside the region of the maximum spectral sensitivity wavelength ($\lambda max$)$\pm$20 nm of at least one light-sensitive layer of the printing color photographic material is provided between the light source to be used in the printing step and the light-sensitive layer of the printing color photographic material, and in that a compound represented by forming (I):

$$(Cp\rightarrow X \qquad (I)$$

wherein Cp represents a coupler residue capable of coupling with the oxidation product of a color developing agent to form a substantially colorless compound or a coupler of being removed from said layer during said developing step; X represents a group in the coupling position to said coupler capable of reacting with the oxidation product of a color developing agent, or capable of reacting with the oxidation product of a color developing agent to be released from the coupler.

DETAILED DESCRIPTION OF THE INVENTION

Figure 1:
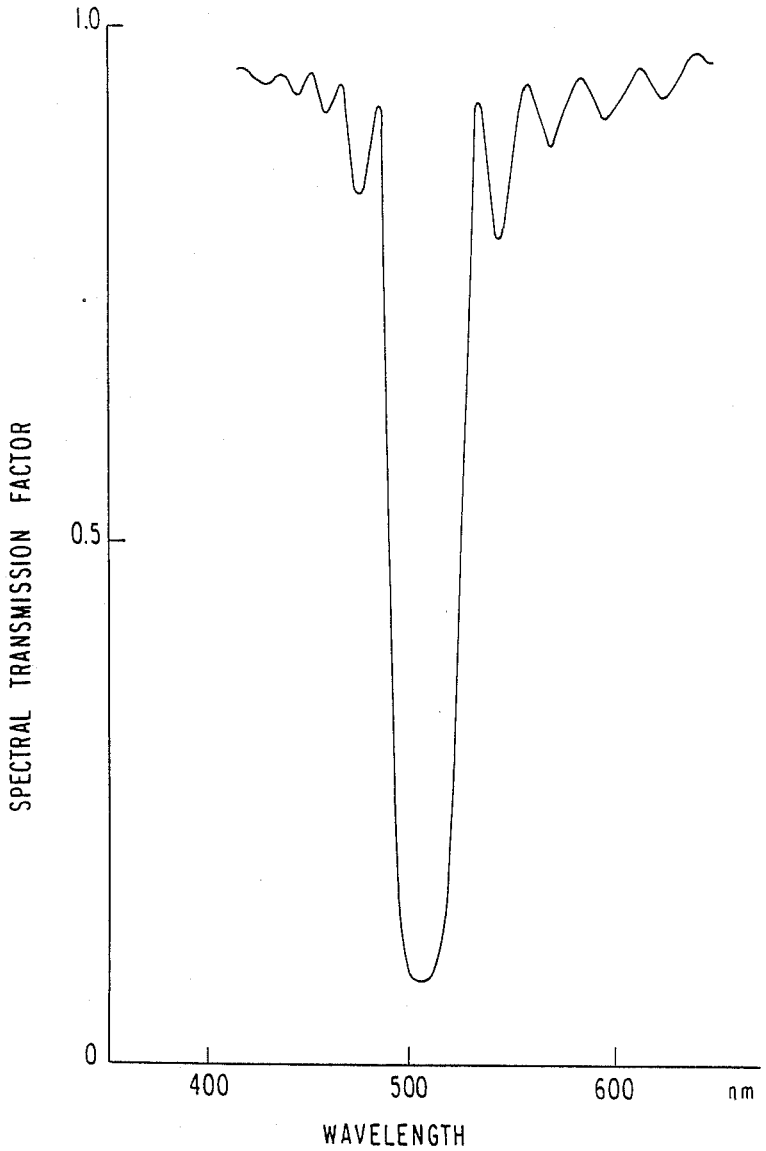
FIG. 1 to FIG. 3 each shows a spectral transmittance curve of each of the filter samples 1 to 3.

The present invention is now descried in greater detail.

According to one preferred embodiment of the present invention, the band stop filter is a filter formed by plural layers each containing a silicon oxide-containing layer and an aluminum oxide-containing layer on a substrate.

According to another preferred embodiment of the present invention, a compound of the following general formula (I) is incorporated into a light-sensitive layer of the taking color photographic material or printing color photographic material or into on interlayer existing between the light-sensitive layers of the said material.

$$(Cp\rightarrow X \qquad (I)$$

in which Cp represents a coupler residue capable of coupling with the oxidation product of a color developing agent to form a substantially color less compound (including the case of forming a color less compound by reaction with a developer component) or a coupler capable of coupling during a color development step to form a compound capable of being dissolved or diffused out of the layer of the photographic material; and X represents a group in the coupling position of the coupler that is capable of reacting with the oxidation product of the color developing agent or capable of reacting with the oxidation product to be released from the coupler.

The present invention uses of a band stop filter having a half width ($W_{\frac{1}{2}}$) of the spectral transmittance curve of the filter in a wavelength range outside the region of the maximum spectral sensitivity wavelength ($\lambda^{max}$)±20 nm preferably, ($\lambda^{max}$)±30 nm, of the light-sensitive layers of the printing color photographic material used in the printing step. The band stop filter for use in the present invention has a half width $W_{\frac{1}{2}}$ of preferably from 5 to 60 nm, more preferably from 10 to 40 nm. In the spectral transmittance curve is too broad, the printing photographic material would have substantially low sensitivity and a longer printing time would be required, and as a result, the color reproducibility-improving effect would be reduced. In the band stop filter for use in the present invention, the ratio of the $\frac{1}{4}$ width ($W_{\frac{1}{4}}$) of the spectral transmittance curve to the $\frac{3}{4}$ value width ($W_{\frac{3}{4}}$) thereof ($W_{\frac{1}{4}}/W_{\frac{3}{4}}$) is preferably 0.35 or more, more preferably from 0.5 to 1.0, although depending upon the half width ($W_{\frac{1}{2}}$) and the position of λmax. In this connection, band stop filters having a ratio of 0.5 or more not been substantially practically used in this technical field.

"Maximum spectral sensitivity wavelength" means a wavelength providing the maximum spectral sensitivity in a visible region (e.g., 400 to 700 nm) of each photosensitive layer. The maximum spectral sensitivity wavelgnth is obtained by using a equienergy spectrograph and a sensitometry.

In accordance with one preferred embodiment of the present invention, the band stop filter of the invention is preferably provided between the light source of the printer and the fixed position of the printing color photographic material, more preferably between the light source and the print original together with a infrared ray absorption filter, a color correcting filter or a natural density filter. A suitable method of incorporating the filters into the printer, for example, is described in Japanese Patent Application No. 62-146544 may be referred to.

The band stop filter for use in the present invention is filter which has plural thin layer films of dielectrics with different refractive indices on a substrate and which reflects light within a particular wavelength range but transmits light within other wavelength range.

The material which may be used for the substrate includes, in general, glass, silicon, sapphire, rock crystal and surface-treated plastic films or plates. The dielectrics which may be used in the present invention are described in *Handbook of Thin Films* (edited by the Japan Society for the Promotion of Science, Thin film 131st Committee and published by Ohm Co., Japan, in 1983), page 817, 2-2 Sec., especially page 820, Table 2-6. Specifically, inorganic compounds such as silicon dioxide, silicon oxide, aluminum oxide, tin oxide, zirconium oxide, titanium dioxide, zinc sulfide, silicon compounds, germanium compounds or tellurium compounds or metals such as silver, aluminum, neodymium, titanium or thallium may be used optionally together with other organic dielectrics, for example, those described in ibid., page 523, 1-2 Sec., especially polymer dielectrics such as polystyrene, polypropylene, polyimide, FEP Teflon or poly-γ-benzyl glutamate, if necessary. The dielectrics may easily be selected for use in the present invention.

In preparation of the filter for use in the present invention, thin layers of at least two or more dielectrics with different refractive indices may be provided repeatedly on a substrate to form plural layers (preferably from 5 to 50 layers, or if desired, more than 50 layers) thereon. For planning the filter, for example, the descriptions in the aforesaid *Handbook of Thin Layers*, pages 823, 4th Sec. as well as in S. Fujiwara, *Optical Thin Layers* (published by Kyoritsu Publishing Co., Japan, 1986), 2nd Ed., 6th Chap. may be referred to. The multilayered film may be formed by a sputtering method, CVD method or coating method but it is preferably formed by a vacuum evaporation plating method. Plural different filters may be combined by adhesion to obtain in the band stop filter for use in the present invention.

More precisely, the band stop filter for use in the present invention may be a commercially available Band Stop Filter BSF (trade name by Kohshin Optical Industries Co., Japan) where the absorption zone width is made narrow.

The minimum transmittance of the band stop filter which is preferably be used in the present invention is preferably 30% or less, more preferably 20% or less, especially preferably 10% or less.

The band stop filter for use in the present invention is an interference filter, for example, as described in *Handbook of Color Science* (edited by the Japan Color Society and published by Tokyo University Publishing, 1985, 5th Dg.), 21th Chap. However, the band stop filters of the invention which have such a sharp and low minimum transmittance have not really been obtained up to the present.

The wavelength range for $W_{\frac{1}{2}}$ of the spectral transmittance curve of the band stop filter to be used in the present invention is preferably within the range of from 480 nm and/or from 570 to 630 nm, and it is preferred that the filter is used together with an ultraviolet absorption filter having an absorption in a wavelength range shorter than 420 nm or an infrared absorption filter having an absorption in a wavelength range longer than 750 nm.

Further, the filter which may preferably be used in the present invention is a band stop filter having plural layers each containing a silicon oxide-containing layer and an aluminum oxide-containing layer on a substrate.

Specifically the band stop filter which is preferably used in the present invention is a solid filter containing plural silicon oxide-containing layers and aluminum oxide-containing layers on a transparent substrate.

The filter containing plural silicon oxide-containing layers and aluminum oxide-containing layers is described in detail hereunder.

As the substrate, materials which are resistant to heat treatment of, for example, hot coating, such as quartz, glass, ceramics and plastics may be used, and quartz, glass and the like silicon oxide-containing plates are preferred. The thickness of the substrate plate is preferably from 0.2 mm to 2 mm. The silicon oxide layer or the aluminum oxide layer has a film thickness of from 300 Å to 5000 Å, and the silicon oxide layer and the aluminum oxide layer are provided alternately on the substrate.

By varying the optical thickness (refractive index and thickness) of the silicon oxide layer and that of the aluminum oxide layer in formation of multilayer constitution band stop filters having desired optical absorption characteristics in the visible range in the present invention may be obtained. Using the band stop filter with the intended characteristics, color prints which are excellent in light-fastness, heat-resistance and scratch-resistance and which have a stable finished quality can be obtained in accordance with the present invention.

The number of the layers provided on the substrate in the band stop filter for use in the present invention is preferably 7 or more, preferably from 21 to 101, especially preferably 47 or more. The maximum absorbability of the band stop filter may be elevated with increase of the number of the layers, especially of 21 layers or more, whereby sharp spectral absorption characteristics may be attained in a determined wavelength range. Further, the variation of the spectral absorption characteristics because of the deflection of the incident angle from the vertical direction of the band stop filter may be reduced.

The filter of the present invention which contains plural silicon oxide layers and aluminum oxide layers has a protective layer which is preferably thicker than the other layers, as an outermost layer. The protective layer is thicker than the other layers, and preferably the silicon oxide or the aluminum oxide, especially preferably the silicon oxide, is provided in a thickness of from 500 Å to 1 μm or so. The thickness of the protective layer is thicker than the other layers whereby the scratch-resistance of the filter may be improved. Accordingly, the band stop filter for use in the present invention is also chemically protected and is excellent in storability.

The filter containing plural silicon oxide layers and aluminum oxide layers, which is preferably used in accordance with the present invention, is a band stop filter having 7 or more layers provided on a substrate and having a protective layer, which is thicker than the other layers, provided on the plural layers. More preferably, the band stop filter for use in the present invention has from 20 to 101 layers provided on a substrate.

The band stop filter having plural silicon oxide layers and aluminum oxide layers, which is used in the present invention, may be prepared by alternately forming silicon oxide layers and aluminum oxide layers on a substrate by evaporation plating. For evaporation plating of the layers, conventional PVD methods such s vacuum evaporation plating method or ion plating method as well as CVD methods such as plasma evaporation plating may be employed. The vacuum may be from $10^{-11}$ to $10^{-4}$ Torr, especially from $10^{-6}$ to $10^{-4}$ Torr, of an inert gas such as nitrogen, argon or helium gas. Oxygen gas may be incorporated into the inert gas, if desired.

The layer constitution, the layer thickness and the layer constituting substances of the band stop filter of the present invention may be measured by electromicroscopic observation "ESCA" of the section of the filter.

The method of forming color images by the use a silver halide color photographic material includes an imagewise exposure step, which includes taking of an object and copying or printing from a color original, and a color developing step following the exposure step. For imagewise exposure, three methods (a whole surface simultaneous exposure process, a slit exposure process, and a synchromous slit exposure process) are generally employed, and in addition to them, an additive exposure system and a substractive exposure system may also be employed. The band stop filter of the present invention may be applied to all of the said exposure systems, and in particular, it is effectively used in a substractive exposure system.

On a printing step of the present invention, a light source, a filter, an optical system, etc. which are commonly used in printing are used. Generally, light amount and light quality are controlled with a color separation filter, color correction filter, etc. In many cases, color printing original is set so as to receive a light of uniform light amount. Color printing photographic material is imagewise exposed through a lens by a light passing through the color printing original. Thus, color printing original obtained from color printing light-sensitive material or color printing light-sensitive material is imagewise exposed at the printing step.

The band stop filter used in the present invention is set forth between a light source and an optical system, in an optical system or between an optical system and color printing light-sensitive material, preferably between a light source and an optical system or in an optical system.

The color printing light-sensitive material thus imagewise exposed produces images by a color developing processing.

Any exposure processes such as a whole-surface simultaneous exposure process, an optical slit exposure process, a synchromous slit exposure process may be used.

In the first process, the entire surface of a color light-sensitive material is imagewise exposed at the same time. This process requires lens and a shutter. An exposing machine to be used in this process may have a simple construction. In this process, the exposure can be effected only once or several times, (sequential exposure process). This process can provide an excellent picture quality. Ordinary cameras and autoprinters employ this process. The second process is a slit exposure process. In this exposure process, a slit moves across the light axis between the object to be copied or color original and the color light-sensitive material to effect image exposure. The third process is a synchronous slit exposure process. In this exposure process, the object to be copied or color original and the color light-sensitive material are synchronously moved during image exposure. The exposing machines according to these processes are relatively small but are susceptible to uneven scanning or image distortion due to unevenness in the speed of sunchronous movement or insufficient accuracy of suynchronous movement. In the above described simultaneous exposure process, a wide radiation anble is obtained. Howver, the filter used in this process is include4d in an interference filter of the kind which varies in spectral absorption characteristics depending on the angle of incidence of the light, causing unevenness in the finish quality of color prints. Therefore, it has been desired to develop a band stop filter which is particularly improved so as to provide a less radiation angle dependency of spectral absorption.

By the use of the band stop filter in accordance with the present invention, the color mixing between the respective components for yellow, magenta and cyan color images may be prevented. For example, when the band stop filter is applied to a Macbeth Color Chart (described in Japanese Patent Application No. 62-150320), the average color-mixing degree may be lowered to 0.10 or less; and when this is applied to a conventional color negative-color paper system, the degree may be lowered to 0.07 or less. In short, color mixing due to the spectral sensitivity of a printing photographic material as noise may be reduced by the band stop filter, to cut the undesirable absorption of the color image constituting a print original. In addition, color mixing of color image components, lowering of saturation of color images as well as variation of the finished quality the color print obtained, which result from poor compatibility between the spectral absorption characteristics of the yellow, magenta and cyan color image constituting a print original and the spectral sensitivity characteristics of the blue-sensitive layer, green-sensitive layer and red-sensitive layer of a printing color photographic material, as described in, for example EP 277589A, may be overcome by the use of the band stop filter in accordance with the present invention.

The present invention surprisingly overcomes interlayer color mixing which would occur during color development of a taking color photographic material and a printing color photographic material.

Hydroquinone derivatives, aminophenol derivatives, amines, gallic acid derivatives, catechol derivatives, ascorbinc acid derivatives and sulfonamidophenol derivatives have been known as conventional color mixing preventing agents. However, since compounds which are generally known as conventional color mixing preventing agents. However, since compounds which are generally known to be useful as a color mixing preventing agent have a strong reducing activity, these often have disadvantageous and harmful side-effects, e.,g. they fog light-sensitive silver halide and inhibit the color reaction in a color development step.

In accordance with the present invention, it has been found that compounds represented by formula (I) scarcely have such harmful side-effects and noticeable augment of the effect of the band stop filter used in the present invention.

The compounds of the formula (I) are described in greater detail below.

The compounds formed immediately after the coupling reaction of the coupler of formula (I) with the oxidation product of a developing agent include two types: colored compounds and substantially colorless compounds. In the former case, the dye formed is not utilized in formation of color images in the method of the present invention. That is, in a preferred embodiment of the present invention, the dye formed in development is alkali-soluble and is diffused out of the photographic layer, or is dissolved out with a developer, or is reacted with components in a developer, such as a sulfite ion or hydroxyl ion, to become substantially color less. These reactions may occur simultaneously. The residual amount of the colored compound formed by coupling of the coupler of the formula (I) and the oxidation product of a developing agent in development is preferably 10% or less, more preferably 5% or less, in the photographic layer after development.

When the dye formed is alkalisoluble, the dye formed has a hydrophilic group, preferably a dissociatable group. The degree of a the alkali-solubility of the dye noticeably varies in accordance with the environmental conditions in a development, for example, the pH value of the processing solution used, the processing time and the structure of the developing agent used. However, the degree may easily be adjusted to a desired value by proper selection of the substituents in the group Cp in the formula (I).

When the dye formed reacts with the components contained in a developer to become substantially colorless, for examples, the reactions described in *Journal of the Japan Photographic Society,* Vol. 27, page 172 (1964), and *Journal of the Americal Chemical Society,* Vol. 84, page 2050 (1962) may occur. The reaction rate to form a color-less product depends upon the kind of the components contained in the developer as well as the amount thereof, but this may properly be adjusted to a desired degree by appropriate selection of the group Cp and the substituents in this group.

Conventional coupler residues may be used as the group Cp, including yellow coupler residues (e.g., open-chain ketomethylene type coupler residues), magenta coupler residues (e.g., 5-pyrazolone type or pyrazolotriazole type coupler residues), cyan coupler residues (e.g., phenol type or naphthol type coupler residues) and colorless coupler residues (e.g., indanone type and acetophenone type coupler residues), and in addition, the heterocyclic type coupler residues described in U.S. Pat. Nos. 4,315,070, 4,183,752, 3,961,959 and 4,171,223 may also be used.

The compounds of the Formula (I) preferably have a non-diffusible group. The non-diffusible group prevents the compound of formula (I) from moving from the layer initially containing the compound, to diffuse to any other layer. In general, an organic substituent to enlarge the molecular weight is used as the non-diffusible group.

In the formula (I), when the group Cp is a yellow coupler residue, a magenta coupler residue or a cyan coupler residue, the non-diffusible group is contained in the group X in a preferred embodiment. In this case, X may contain one or more Cp groups, for example, to form a bis-type, telomer-type or polymer-type coupler.

In formula (I), when the group Cp is a color-less coupler residue, the non-diffusible group may be contained in either of the groups Cp and X. In this case, the Cp group may contain two or more color less coupler residues, or X may contain one or more Cp groups to form a bis-type, telomer-type or polymer-type coupler.

In the formula (I), X represents a coupling-off group, and after being released, X may be either a group capable of reacting with the oxidation product of a developing agent or a group incapable of reacting with the oxidation product. When X represents a group capable of reacting with the oxidation product of a developing agent, X is a coupler group after release from Cp (coupler precursor), or is a redox group after release from Cp (redox group precursor).

When X represents a coupler group precursor, for example, a phenol-type coupler precursor, the group is bonded to Cp via the oxygen atom in the hydroxyl group. When X represents a 5-pyrazolone-type coupler precursor, the group is bonded to Cp via the oxygen atom in the hydroxyl group in the 5-hydroxypyrazole tautomer form. In these examples, X becomes a phenol-type coupler or a 5-pyrazolone-type coupler only after being released from Cp. Preferably, the couplers have a non-diffusible group-containing coupling-releasing group at the coupling position thereof.

When X in formula (I) represents a redox group precursor, X is preferably a hydroquinone, catechol, pyrogallol, 1,4-hydroxynaphthol or 1,2-hydroxynaphthol.

The reducing agent preferably has a non-diffusible group. After being released, the group which does not react with the oxidation product of a developing agent is a normal coupling-off group, which is, for example a halogen atom.

Preferred embodiments of the compounds of the formula (I) are described in detail below. Specifically, preferred couplers are compounds represented by formula (II):

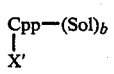

(II)

in which Sol represents an alkali-soluble group; b is an integer of from 1 to 3;

Cpp represents a group of capable releasing X' by a coupling reaction with the oxidation product of a developing agent; and X' represents a coupling-off group containing a non-diffusible group.

In formula (II), Sol represents a dissociatable group or a quaternary ammonium salt, preferably a carboxylic acid group or a salt thereof, a sulfonic acid group or a salt thereof, a sulfinic acid group or a salt thereof, or a hydroxyl group. The salts include, for example, sodium salts, potassium salts or ammonium salts.

Sol is especially preferably a carboxylic acid group of a sulfonic acid group or a salt thereof.

Among the compounds of formula (II), those represented by the following formulae (Cp-1), (Cp-2), (Cp-3), (Cp-4), (Cp-5), (Cp-6), (Cp-7), or (Cp-8) are preferred.

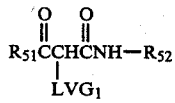

(Cp-1)

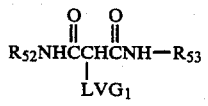

(Cp-2)

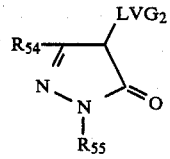

(Cp-3)

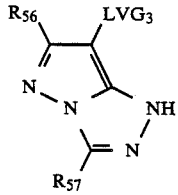

(Cp-4)

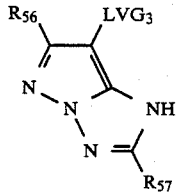

(Cp-5)

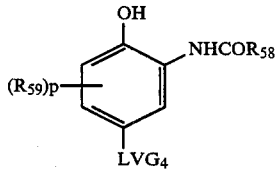

(Cp-6)

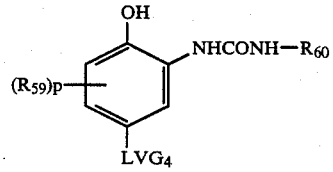

(Cp-7)

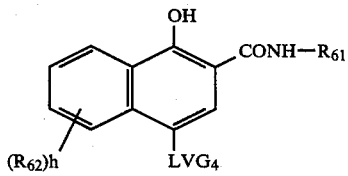

(Cp-8)

In these formulae, the total carbon number in each group of $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ is preferably 15 or less. $R_{51}$, $R_{52}$, $R_{53}$, $R_{55}$, $R_{58}$, $R_{60}$, or $R_{61}$ each represents a group which may contain Sol as a substituent.

$R_{54}$, $R_{56}$, $R_{57}$, $R_{59}$ or $R_{62}$ each represents a group which may contain sol or represents Sol itself.

In the following explanation, $R_{41}$ represents an aliphatic group, an aromatic group or a heterocyclic gorup; and $R_{43}$, $R_{44}$, and $R_{45}$, which may be the same or different, each represents hydrogen, an aliphatic group, an aromatic group or a heterocyclic group.

$R_{51}$ has the same meaning as $R_{41}$. $R_{52}$ and $R_{53}$, which may be the same or different each represents an aromatic group or a heterocyclic group. $R_{54}$ has the same meaning as $R_{41}$ or may further represent $$R_{41}\underset{\underset{R_{43}}{|}}{CON}-,\ R_{41}\underset{\underset{R_{43}}{|}}{N}-,\ R_{41}SO_2\underset{\underset{R_{43}}{|}}{N}-,$$

$$R_{41}S-,\ R_{43}O-,\ R_{45}\underset{\underset{R_{43}}{|}}{N}\underset{\underset{R_{44}}{|}}{CON}-,\ R_{43}OOC,$$

$$R_{44}\underset{\underset{R_{43}}{|}}{N}CO-\ \text{or}\ N\equiv C-.$$

$R_{55}$ has the same meaning as $R_{41}$. $R_{56}$ and $R_{57}$, which may be the same or different, each has the same meaning as $R_{43}$ or may further represent $R_{41}S$—, $R_{43}O$— a carboxyl group, $$R_{41}\underset{\underset{R_{43}}{|}}{CON}-,\ R_{41}\underset{\underset{R_{43}}{|}}{N}-,\ R_{41}O\underset{\underset{R_{43}}{|}}{CON}-,\ R_{43}\underset{\underset{R_{44}}{|}}{N}\underset{\underset{R_{45}}{|}}{CON}-,\ \text{or}\ R_{41}SO_2\underset{\underset{R_{43}}{|}}{N}-.$$

$R_{58}$ has the same meaning as $R_{41}$. $R_{59}$ has the same meaning as $R_{41}$ or may further represent $$R_{41}\underset{\underset{R_{43}}{|}}{CON}-,\ R_{41}O\underset{\underset{R_{43}}{|}}{CON}-,$$

$$R_{41}SO_2\underset{\underset{R_{43}}{|}}{N}-,\ R_{43}OOC-,\ R_{43}\underset{\underset{R_{44}}{|}}{N}\underset{\underset{R_{45}}{|}}{CON}-,\ R_{44}\underset{\underset{R_{44}}{|}}{N}SO_2\underset{\underset{R_{45}}{|}}{N}-,$$

a sulfonic acid group or a salt thereof, $R_{41}O$—, $R_{41}S$—, a halogen atom or $$R_{41}\underset{\underset{R_{43}}{|}}{N}-.$$

p is 0 or an integer of 1 to 3. When p is 2 or 3, the plural $R_{59}$ groups may be the same or different, or the respective $R_{59}$ groups may be divalent groups linked to form a cyclic structure. Examples of the divalent groups for forming a cyclic structure are as follows:

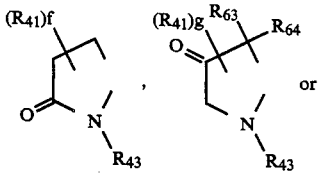

or

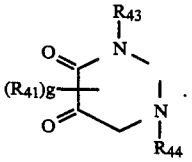

In these groups, f is 0 or an integer of 1 to 4; and g is 0, 1 or 2.

$R_{60}$ has the same meaning as $R_{41}$. $R_{61}$ has the same meaning as $R_{41}$. $R_{62}$ has the same meaning as $R_{41}$ or may further represent $R_{41}CONH$—, $R_{41}OCONH$—, $R_{41}SO_2NH$—, a carboxyl group, a sulfonic acid group or a salt thereof, $$R_{43}\underset{\underset{R_{44}}{|}}{N}\underset{\underset{R_{45}}{|}}{CON}-,\ R_{43}\underset{\underset{R_{44}}{|}}{N}SO_2\underset{\underset{R_{45}}{|}}{N}-,$$

$R_{43}O$—, $R_{41}S$—, a halogen atom or $$R_{41}\underset{\underset{R_{43}}{|}}{N}-.$$

$R_{63}$ and $R_{64}$, which may be the same or different each represents an alkyl group and these may be linked to form a ring. h is 0 or an integer or rom 1 to 4. Plural $R_{62}$ groups may be the same or different.

In the above-mentioned formulae, the aliphatic group is a saturated or unsaturated, chain-like or cyclic linear to branched, substituted or unsubstituted aliphatic hydrocarbon group having from 1 to 15, preferably from 1 to 8, carbon atoms. Specific examples of the group include methyl, ethyl, propyl, isopropyl, butyl (t)-butyl, (i)-butyl, (t)-amyl, hexyl and cyclohexyl groups.

The aromatic group is preferably a substituted or unsubstituted phenyl group having from 6 to 10 carbon atoms.

The heterocyclic group is a substituted or unsubstituted heterocyclic group having from 1 to 15, preferably having from 1 to 15 carbon atoms and containing at least one hetero atom selected from the group consisting of a nitrogen atom, an oxygen atom and a sulfur atom, and preferably 3-membered to 6-membered heterocyclic group. Specific examples of the heterocyclic group include 2-pyridyl, 4-pyridyl, 2-thienyl, 2-furyl, 1-imidazolyl, phthalimido, 1,3,4-thiadiazol-2-yl, 2-quinolyl, tetraazolyl, 2,4-dioxo-1,3-imidazolidin-5-yl, 2,4-dioxo-1,3-imidazolidin-3yl, succinimido, 1,2,4-triazol-2-yl and 1-pyrazolyl groups.

The above-mentioned aliphatic hydrocarbon group, aromatic group and heterocyclic group may have substituents(s), and specific examples of the substituents include a halogen atom, $R_{46}$—, $R_{47}O$—, $R_{46}S$—, $$R_{47}\underset{\underset{R_{46}}{|}}{CON}-,\ R_{47}\underset{\underset{R_{48}}{|}}{N}CO-,\ R_{46}O\underset{\underset{R_{47}}{|}}{CON}-,\ R_{46}SO_2\underset{\underset{R_{47}}{|}}{N}-,$$

$$\begin{matrix}R_{47}\\R_{46}\end{matrix}\!\!>\!=N-,\ R_{47}\underset{\underset{R_{48}}{|}}{N}SO_2-,\ R_{46}SO_2-.\ R_{47}OCO-,$$

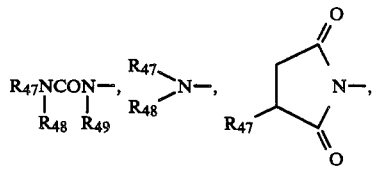

$R_{46}COO$—, a phosphonic acid group or a salt thereof, $R_{47}OSO_2$—, a cyano group and nitro group. On these group, $R_{46}$ represents an aliphatic group, an aromatic group or a heterocyclic group; and $R_{47}$, $R_{48}$, and $R_{49}$, which may be the same or different, each represents an aliphatic group, an aromatic group, a heterocyclic group or hydrogen. The aliphatic group, aromatic group and heterocyclic group have the same meaning as defined above.

Next, the preferred groups for each $R_{51}$ to $R_{62}$ and p and h will be mentioned below.

$R_{51}$ is preferably an aliphatic group or an aromatic group. $R_{52}$, $R_{53}$ and $R_{55}$ each are preferably an aromatic group. $R_{54}$ is preferably $R_{41}CONH$— or $$R_{41}-\underset{\underset{R_{43}}{|}}{N}-.$$

$R_{56}$ and $R_{57}$ each are preferably $R_{41}O$— or $R_{41}S$—. $R_{58}$ is preferably an aliphatic group or an aromatic group. In the formula (Cp-6), $R_{59}$ is preferably a chlorine atom a fluorine atom, an aliphatic group or $R_{41}CONH$—. In the formulae (Cp-6) and (Cp-7), p is preferably 0 or an integer of 1 to 2. $R_{60}$ is preferably an aromatic group. In the formula (Cp-7), $R_{59}$ is preferably a chlorine atom or $R_{41}CONH$—. In the formula (Cp-7), h is preferably 0 or 1. $R_{61}$ is preferably an aliphatic group or an aromatic group. In the formulae (Cp-7), h is preferably 0 or 1. $R_{62}$ is preferably $R_4OCONH$—, $R_{41}CONH$— or $R_{41}SO_2NH$—, and the group is preferably substituted on the 5-position of the naphthol ring.

Specific examples of the groups $R_{51}$ to $R_{62}$ are as follows, but the present invention is not to be construed as being limited thereto.

$R_{51}$ typically includes (t)-butyl, 4-methoxyphenyl, phenyl, methyl 4-carboxyphenyl and 2-chlorophenyl groups. $R_{52}$ and $R_{53}$ typically include 3-carboxyphenyl, 3,5-dicarboxyphenyl, 2-chloro-5-methoxycarbonylphenyl, 2-chloro-5-(3-carboxypropanamido)phenyl, 2-chloro-5-ethoxycarbonylphenyl, phenyl, 2-methoxy-5-methoxycarbophenyl and 2-pyridyl groups.

$R_{54}$ typically includes 3-acetamidobenzamido, benzamido, 3-phenoxypropanamidobenzamido, 3-carboxybenzamido, 2-chloro-5-ethaneamidoanilino, anilino, 5-phenoxyacetamidoanilino, 3-carboxyanilino and 3,5-dicarboxyanilino groups.

$R_{55}$ typically include 2,4,6-trichlorophenyl,2-chlorophenyl, 4-carboxyphenyl, 2,5-dichlorophenyl, 4-sulfophenyl, 2,3-dichlorophenyl and 2,6-dichloro-4-carboxyphenyl groups.

$R_{56}$ typically includes methyl, ethyl, 2-carboxyethyl, isopropyl, propyl, methoxy, ethoxy, methylthio, phenyl, ethylthio, and 3-phenylureido groups.

$R_{57}$ typically includes 3-phenoxypropyl, t-butyl, 3-(2-methoxyethoxyphenyl)propyl, carboxymethoxy, ethoxy, carboxymethylthio, 4-carboxyphenyl, ethylthio, methyl, carboxyethyl and phenyl groups.

$R_{58}$ typically includes 2-chlorophenyl, 3-carboxypropyl,2-carboxyethyl, carboxymethyl, 3,5-dicarboxyphenyl, butyl, ethyl, methyl and furyl groups.

$R_{59}$ typically includes chlorine and fluorine atoms, and methyl, carboxyl, ethyl, butyl, isopropyl, 2-carboxyethyl and 2-phenoxyacetamido groups.

$R_{60}$ typically includes 4-cyanophenyl, 2-cyanophenyl, 4-methanesulfonylphenyl, 2-carboxylethyl, 4-carboxyphenyl and 3-methoxycarboanylphenyl groups.

$R_{61}$ typically includes 2-carboxyethyl, 4-carboxyphenyl, butyl, 3-phenoxypropyl, 1-carboxymethyl, 1-carboxyethyl, 3-phenoxybutyl and 1-naphthyl groups.

$R_{62}$ typically includes isobutyloxycarbonylamino, methanesulfonamido and acetamido groups.

Next, $LVG_1$ to $LVG_4$ are described.

$LVG_1$ preferably represents $R_{65}O$—, an imido group bonded to the coupling position via nitrogen atom, a 5-membered or 6-membered unsaturated nitrogen-containing heterocyclic group bonded to the coupling position via a nitrogen atom or $R_{66}S$—.

$LVG_2$ preferably represents $R_{66}S$—, $R_{65}O$—, $R_{65}N{=}N$— or a 5-membered or 6-membered unsaturated nitrogen-containing heterocyclic group bonded to the coupling position via a nitrogen atom.

$LVG_3$ preferably represents $R_{66}S$—, or a 5-membered or 6-membered unsaturated nitogen-containing heterocyclic group bonded to the coupling position via a nitrogen atom.

$LVG_4$ preferably represents $R_{66}O$—, $R_{66}N{=}N$— or $R_{66}S$—.

In the above-mentioned substituents, $R_{65}$ represents an aromatic group or a heterocyclic group; and $R_{66}$ represents an aliphatic group, an aromatic group or a heterocyclic group. The aliphatic group, the aromatic group, heterocyclic group for these substituents have the same meanings as for $R_{41}$, but the number of total carbon atoms contained in $R_{65}$ or $R_{66}$ is from 10 to 40, preferably from 12 to 40.

When $LVG_1$, $LVG_2$ or $LVG_3$ represents an unsaturated nitrogen-containing heterocyclic group, examples of the ring structure of the heterocyclic group include 1-pyrazolyl, 1-imidazolyl and 1,2,4-triazolyl groups.

The heterocyclic group may optionally have substituents(s) and the number of the total carbon atoms of the group including the substituent(s) is from 10 to 40, preferably from 12 to 40. The substituents for the group, include the specific examples of the substituents for the heterocyclic group $R_{41}$.

When $LVG_1$ represents an imido group, examples of the ring structure of the imido group include 2,4-dioxo-1,3-imidazolidin-3-yl, 2,4-dioxo-1,3-oxazolidin-3-yl, 3,5-dioxo-1, 2,4-triazolidin-4-yl and octadecenylsuccinimido groups. The imido group may optionally have substituent(s) and the number of the total carbon atoms of the group inclusive of the substituent(s) thereon, if any, is from 10 to 40, preferably from 12 to 40. The substituents for the group include the specific examples of the substituents for the heterocyclic group $R_{41}$.

Specific examples of $LVG_1$, $LVG_2LVG_3$, and $LVG_4$ are as follows but the present invention is not to be construed as being limited thereto.

$LVG_1$ typically includes 1-benzyl-5-hexadecyloxy-2,4-dioxo-1,3-imidazolidin-3-yl, 1-benzyl-5,5-dioctyl-2,4-dioxo-1,3-imidazolidin-3-yl, 4-(4-hexadecyloxyphenylsulfonyl)phenoxy and 1-(3-hexadecyloxycarbonylphenyl)tetrazolyl-5-thio groups.

$LVG_2$ typically includes 4-[3-(2-decyl-4-methylphenoxy)-acetyloxy]propyl-1-pyrazolyl, 4-tetradecyloxyphenylazo, 2-butoxy-5-(1,1-dimethyl3,3-dimethylbutyl)phenylthio and 4-tetradecylcarbamoylphenoxy groups.

$LVG_3$ typically includes 2-butoxy-5-(1,1-dimethyl-3,3-dimethylbutyl)phenylthio and 2-methoxyethoxy-5-(1,1-dimethyl-3,3-dimethylbutyl)phenylthio groups.

$LVG_4$ typically includes 4-(1,1-dimethyl-3,3-dimethylbutyl)phenoxy,4-{4-(2,4-di-t-amylphenoxy)-butanamido}phenoxy,4-{2-(2,4-di-t-amylphenoxy)-butanamido}phenoxy, 3-(2,4-di-t-amylphenoxy)propylcarbamoylmethoxy or 4-(2,4-di-t-amylphenoxy)butylcarbamoylmethylthio groups.

Among the couplers of the formulae (Cp-1) to (Cp-8), those of formulae (Cp-6) to (Cp-8) are especially preferred.

The compounds of formula (I) may be dispersed in a hydrophilic colloid in accordance with conventional methods of dispersion of image-forming couplers (for example, oil-in-water dispersion method, polymer dispersion method). Alternatively, those having an alkali-soluble group may be added to a hydrophilic colloid in the form of an aqueous solution.

The compound of formula (I) used in the present invention is incorporated into a photosensitive layer or an intermediate layer of the photosensitive layer, or an intermediate layer of the photosensitive layers of picture-taking photographic material or color-printing photogrpahic material, preferably into the intermediate layer of the photosensitive layers.

The amount of the compound of formula (I) used in the present invention is not specifically limited but is typically from about $10^{-6}$ to about $10^{-1}$ mol per mol of silver halide in the photographic material to be processed by the invention.

The amount of the compound fo formula (I) used in the present invention is preferably about 0.001 g to about 1.0 g preferably about 0.01 g to about 0.05 g per $m^2$ of an interlayer, when the compound of formula (I) is incorporated into an interlayer.

Specific examples of the compounds of the formula (I) for use in the present invention are described below, but the present invention is not to be construed as being limited thereto.

I-(1)

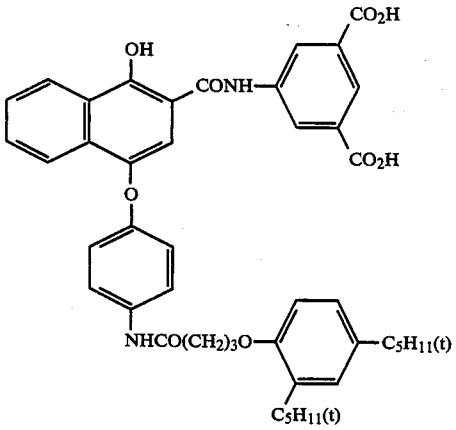

I-(2)

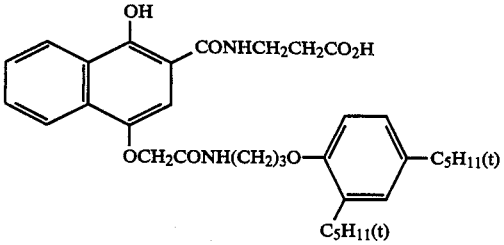

-continued

I-(3)

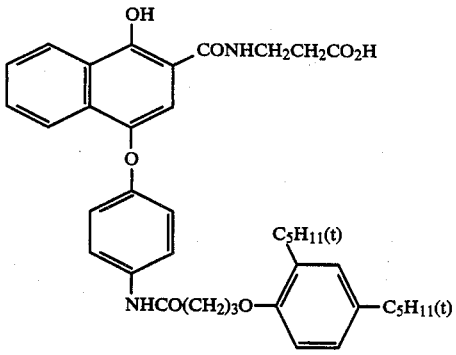

I-(4)

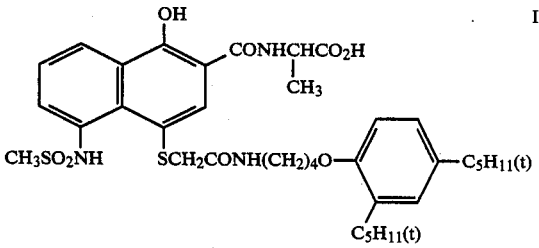

I-(5)

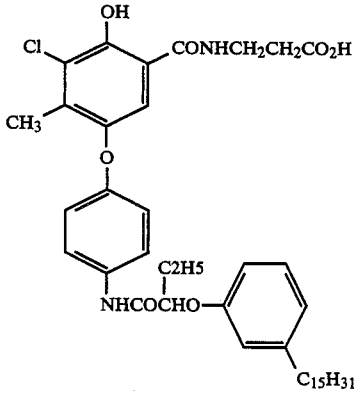

I-(6)

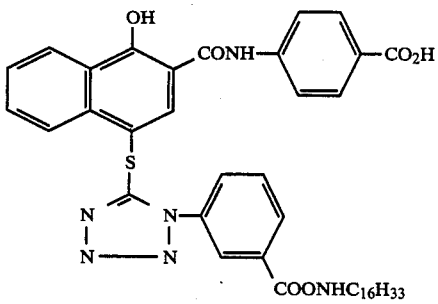

I-(7)

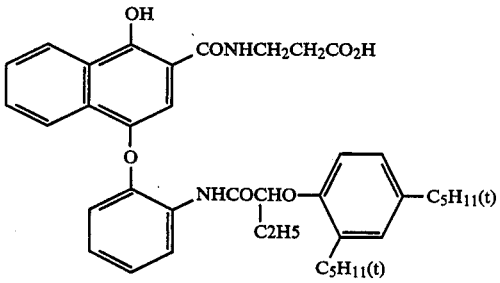

-continued
I-(8)
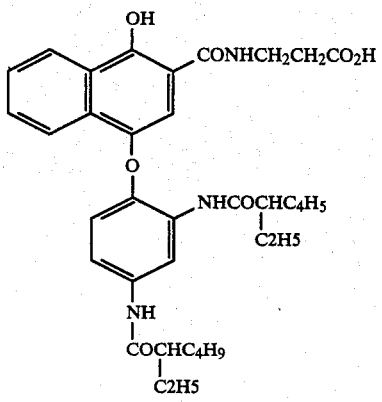
I-(9)
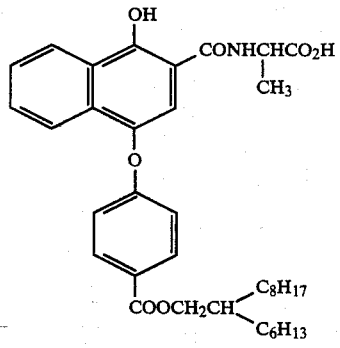
I-(10)
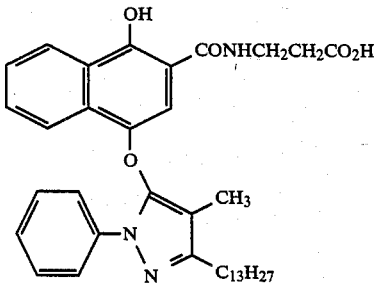
I-(11)
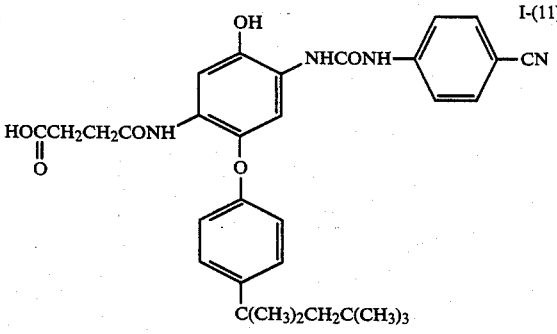
-continued
I-(12)
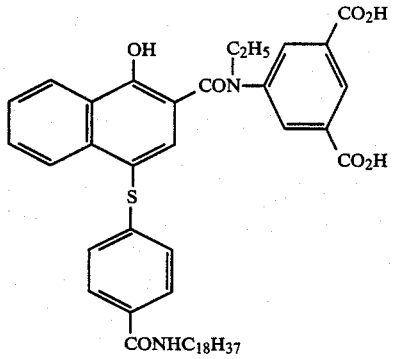
I-(13)
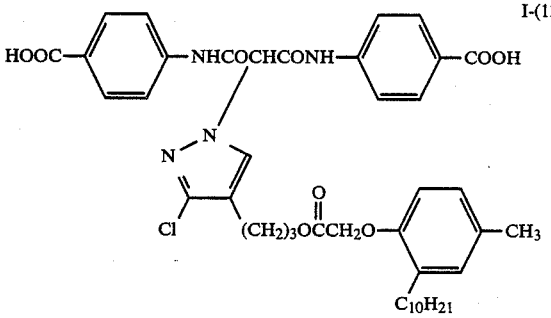
I-(14)
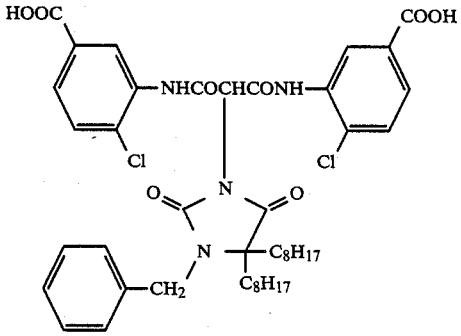
I-(15)
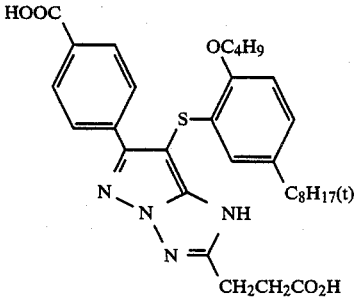
I-(16)
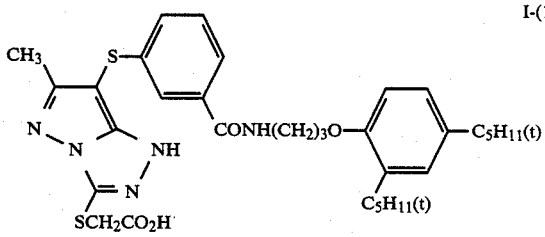

-continued
I-(17)
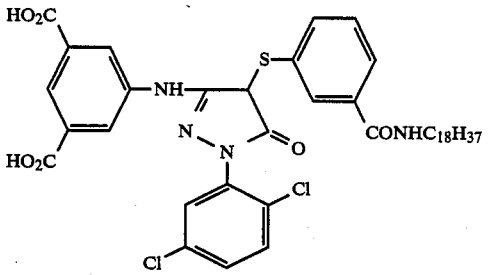
I-(18)
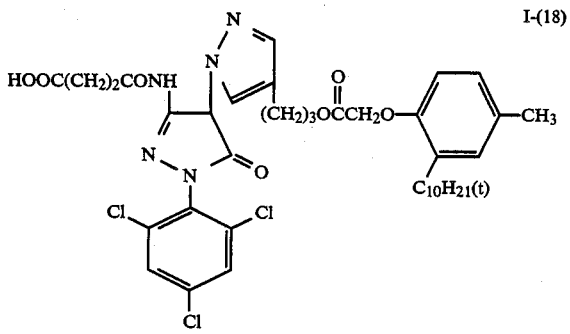
I-(19)
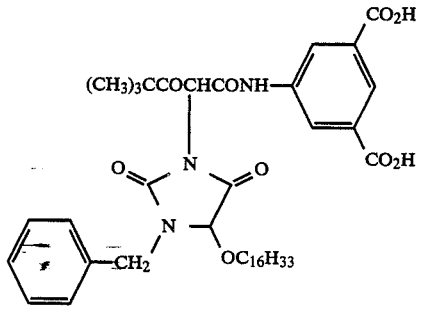
I-(20)
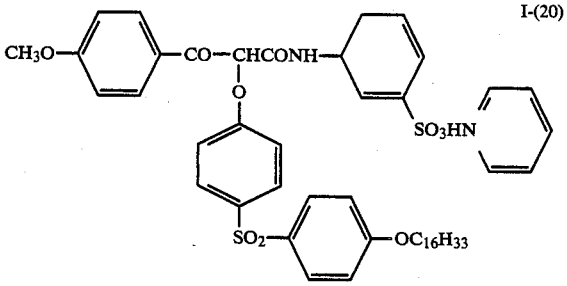
I-(21)
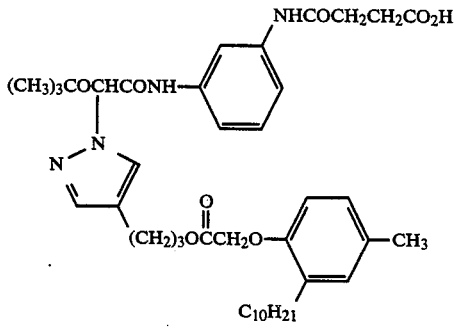
-continued
I-(22)
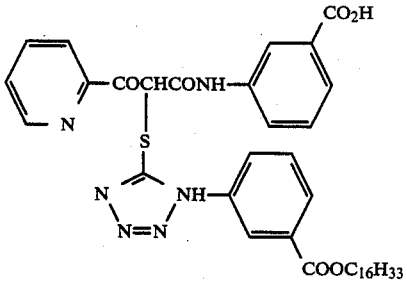
I-(23)
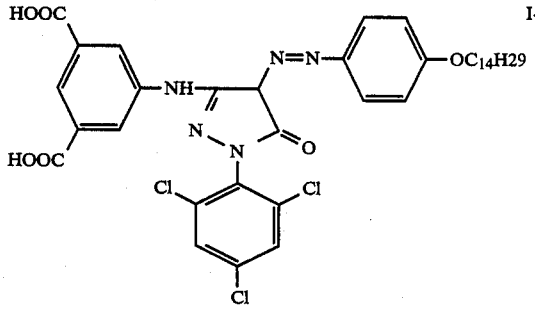
I-(24)
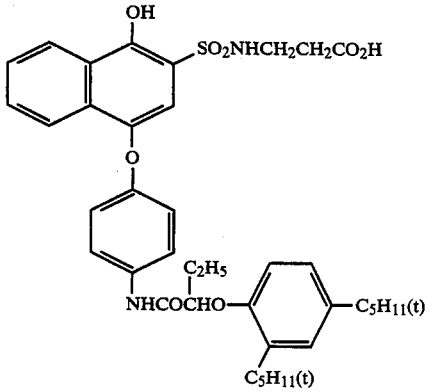
I-(25)
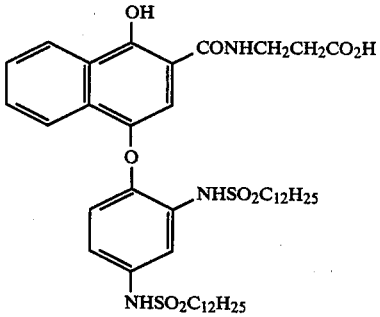
I-(26)
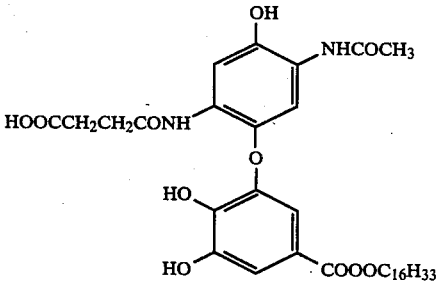
The compounds for use in the present invention may be produced in the same manner as the production of known 2-equivalent couplers. For example, they may be produced in accordance with the production methods described in JP-A-61-86751, 59-113438, 59-113440 and 59-171955 or by similar methods with variation of substituents.

The taking color photographic materials and the printing color photographic materials for use in the present invention generally contain yellow couplers, magenta couplers and cyan couplers which may color in yellow, magenta and cyan, respectively, after coupling with the oxidation product of an aromatic amine developing agent, as color image-forming compounds.

As yellow couplers for use in the present invention, acylacetamide derivatives such as benozylacetanilides or pivaloylacetanilides are preferred.

In particular, the compounds are represented by the following formula (Y-1) and (Y-2) are especially preferred as yellow couplers.

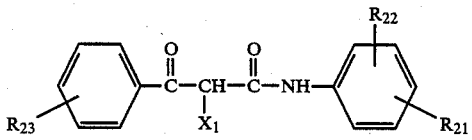
[Y-1]

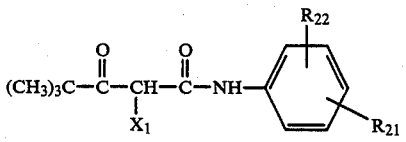
[Y-2]

in which $X_1$ represents a hydrogen or a coupling-releasing group; $R_{21}$ represents a non-diffusible group having from 8 to 32 carbon atoms in all; $R_{22}$ represents hydrogen, or one or more substituents selected from a halogen atom, a lower alkyl group, a lower alkoxy group and a non-diffusible group having from 8 to 32 carbon atoms in all; and $R_{23}$ represents hydrogen or one or more substituents, and when the formula has two or more $R_{23}$'s, they may be same or different. The substituents for $R_{23}$ are the same as the substituents for $R_{22}$.

Suitable pivaloylacetanilide type yellow couplers are described in U.S. Pat. No. 4,622,287, from column 3, line 15 to column 8, line 39 and U.S. Pat. No. 4,623,616, from column 14, line 50 to column 19, line 41.

Suitable benzolacetanilide type yellow couplers are described in U.S. Pat. Nos. 43,408,194, 3,933,501, 4,046,575, 4,133,958 and 4,401,752.

Among the above-mentioned couplers, those having a nitrogen atom as a releasing atom are especially preferred.

As the magenta complex for use in the present invention, there are oil protected type indazolone or cyanoacetyl couplers, and preferably 5 -pyrazolone magenta couplers and other pyrazoloazole couplers such as pyrazolotriazoles. As the 5-pyrazolone couplers, those substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896 and 3,963,015. As the releasing groups for the 2-equivalent 5-pyrazolone couplers, the nitrogen atom releasing groups described in U.S. Pat. No. 4,310,619 and the arylthio groups described in U.S. Pat. No. 4,351,897 are preferred. Furthermore, the 5-pyrazolone magenta couplers having a ballast group described in European Pat. No. 73,636 give high coloring density.

As the pyrazoloazole couplers, there may be mentioned the pyrazolobenzimidazoles described in U.S. Pat. No. 3,369,879, preferably the pyrazolo [5,1-c] [1,2,4] triazoles described in U.S. Pat. No. 3,725,067, the pyrazolotetrazoles described in Research Disclosure, Item 24220 (June, 1984) and the pyrazolopyrazoles described in Research Disclosure, Item 24230 (June, 1984). The abovementioned couplers may all be in the form of a polymer coupler.

Specifically, these compounds are represented by the following general formula (M-1), (M-2) or (M-3):

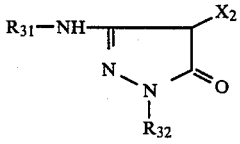
(M-1)

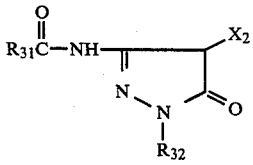
(M-2)

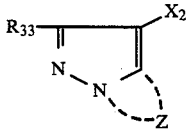
(M-3)

in which $R_{31}$ represents a non-diffusible group having from 8 to 32 carbon atoms in all; $R_{32}$ represents a phenyl group or a substituted phenyl group; $R_{33}$ represents hydrogen atom or a substituent which is the same as that for $R_{32}$. Z represents a non-metallic atomic group necessary for forming a 5-members azole ring containing from 2 to 4 nitrogen atoms, and the azole ring may optionally have substituent(s) or may optionally be condensed to form a condensed ring; and X2 represents hydrogen or a releasing group. The details of the releasing group are disclosed in U.S. Pat. No. 4,540,654.

The substituents for $R_{33}$ and the substituents on the azole ring are described, for example, in U.S. Pat. No. 4,540,654, from column 2, line 41 to column 8, line 27.

Among the pyrazoloazole couplers, the imidazo [1,2-b]-pyrazoles described in U.S. Pat. No. 4,500,630 are preferred because of the small yellow side-absorption of the colored dye and of the sufficient light-fastness thereof, and in particular, the pyrazolo [1,5-b] [1,2,4] triazoles described in U.S. Pat. No. 4,540,654 are especially preferred.

In addition, the pyrazolotriazole couplers having a branched alkyl group directly bonded to the 2-, 3- or 6-position of the pyrazolotriazole ring as described in JP-A-61-65245; the pyrazoloazole couplers having a sulfonamido group in the molecule described in JP-A-61-65246; the pyrazoloazole couplers having an alkoxyphenylsulfonamido ballast group described in JP-A-61-147254; and the pyrazolotriazole couplers having an alkoxy group or an aryloxy group at the 6-position described in European Patent Application (OPI) No. 226,849 may also be preferably used in the present invention.

As the cyan couplers for use in the present invention, phenol cyan couplers and naphthol cyan couplers are most typical.

The phenol cyan couplers for use in the present invention, include those having an acylamino group at the 2-position and an alkyl group at the 5 -position (including polymer couplers) described in U.S. Pat. Nos. 2,369,929, 4,518,687, 4,511,647 and 3,772,002.

In addition, the 2,5-diacylaminophenol couplers described in U.S. Pat. Nos. 2,772,162, 2,895,826, 4,334,011 and 4,500,653 and JP-A-59-164555 may also be used as the phenol cyan couplers in the present invention.

Further, the phenol cyan couplers for use in the present invention, include those having a nitrogen-containing hetero-ring condensed with the phenol nucleus described in U.S. Pat. Nos. 4,327,173, 4,564,586 and 4,430,423, JP-A-61-390441 and Japanese Patent Application No. 61-100222.

Still further, the ureido couplers described in U.S. Pat. Nos. 4,333,999, 4,451,559, 4,444,872, 4,427,767 and 4,579,813 and European Patent 067,689B1 may be used as the phenol cyan couplers for use in the present invention.

The naphthol cyan couplers for use in the present invention include naphthol couplers having an N-alkyl-N-arylcarbamoyl group at the 2-position of the naphthol nucleus (for example, those described in U.S. Pat. No. 2,313,586), naphthol couplers having an alkylcarbamoyl group at the 2-position of the naphthol nucleus (for example, those described in U.S. Pat. Nos. 2,474,293 and 4,282,312), napthol couplers having an arylcarbamoyl group at the 2-position of the naphthol nucleus (for example, those described in JP-B-50-14523), naphthol couplers having a carbonamido or sulfonamido group at the 5-position of the napthol nucleus (for example those described in JP-A-60-237448, 61-145557 and 61-153640), naphthol couplers having an aryloxy-releasing group (for example, those described in U.S. Pat. No. 3,476,563), naphthol couplers having a substituted alkoxy-releasing group (for example, those described in U.S. Pat. No. 4,296,199) and naphthol couplers having a glycolic acid-releasing group (for example, those described in JP-B-60-39217).

Specifically, cyan couplers represented by the following formulae (C-1) or (C-2) are advantageously used in the present invention.

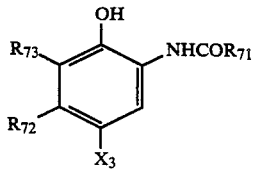

(C-1)

-continued

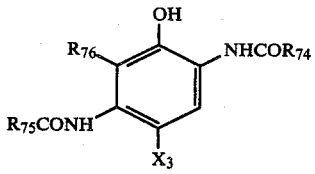

(C-2)

in which $R_{71}$, $R_{74}$ and $R_{75}$, which may be the same or different, each represents an aliphatic group, an aromatic group, a heterocyclic group, an aliphatic amino group, an aromatic amino group or a heterocyclic amino group; $R_{72}$ represents an aliphatic group; $R_{73}$ and $R_{76}$, which may be the same or different, each represents hydrogen, a halogen atom, an aliphatic group, an aliphatic oxy group or an acylamino group. The aliphatic group The aliphatic group includes a linear, branched or cyclic alkyl, alkenyl or alkynyl group.

$R_{75}$ and $R_{76}$ may be linked to form a 5-, 6- or 7-membered ring component of a condensed ring of carbostyryl or oxyindole. $R_{72}$ and $R_{73}$ may be linked to form an optionally substituted naphthol ring.

$R_{71}$, $R_{72}$, $R_{73}$ or $X_3$; or $R_{74}$, $R_{75}$, $R_{76}$ or $X_3$ may form a dimer or higher polymer.

$X_3$ represents hydrogen or a coupling-off group.

The couplers for use in the present invention may be incorporated into the photographic materials by various dispersion methods, for example, an oil-in-water dispersion method or polymer dispersion method.

High boiling point organic solvents are used in the oil-in-water dispersion method, and examples of the solvents are described in U.S. Pat. No. 2,322,027.

The polymer dispersion method includes the latex dispersion method, and the steps of the method, the effect by the method and examples of latexes used in the method for impregnation are described in U.S. Pat. No. 4,199,363, West German Patent Application (OLS) Nos. 2,541,274 and 2,541,230.

It is preferred that the couplers in dispersed together with the acrylamide polymer described in JP-A-52-102722 (U.S. Pat. No. 4,120,725).

Specific examples for the couplers which are preferably used in the taking color photographic materials or printing color photographic materials of the present invention for formation of color images in the materials are described below, but the present invention is not to be construed as being limited thereto.

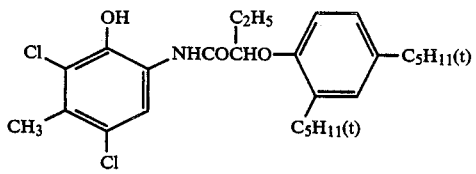

C-(1)

-continued
C-(2)
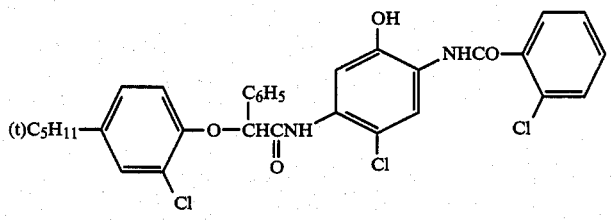
C-(3)
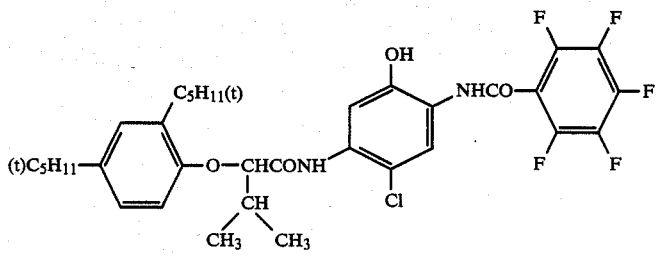
C-(4)
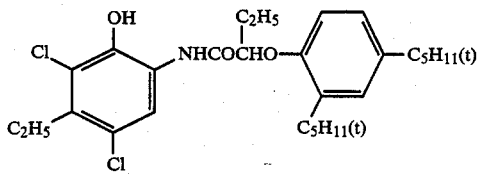
C-(5)
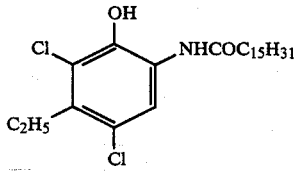
C-(6)
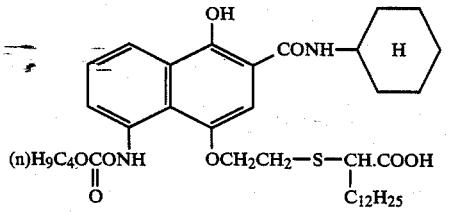
C-(7)
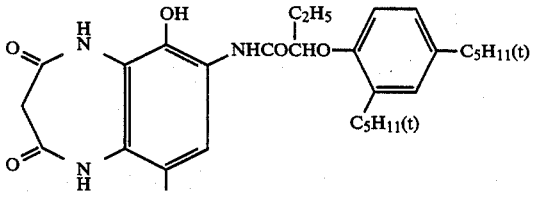
C-(8)
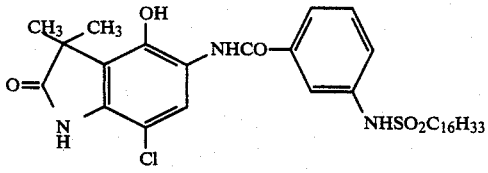
C-(9)
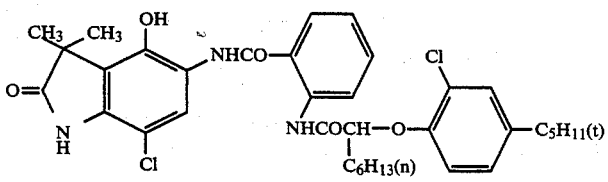

-continued
C-(10)
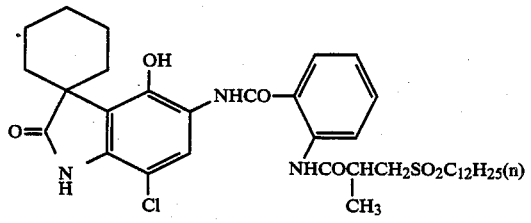
C-(11)
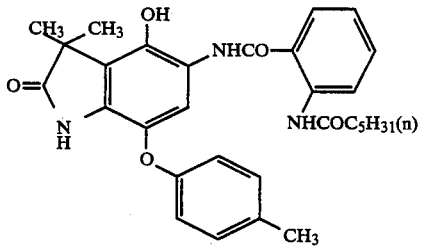
C-(12)
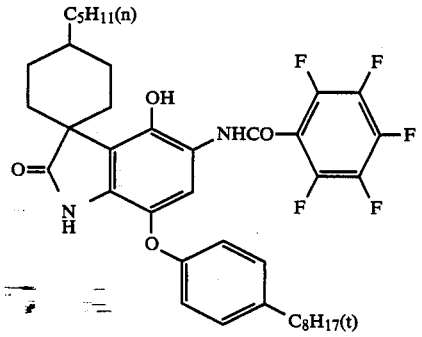
C-(13)
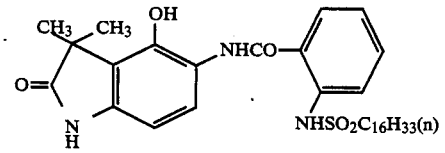
C-(14)
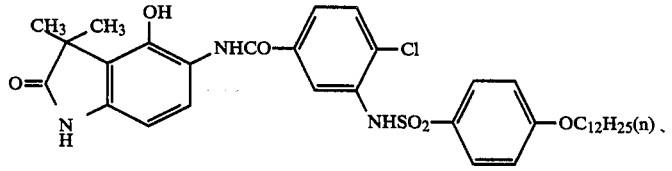
C-(15)
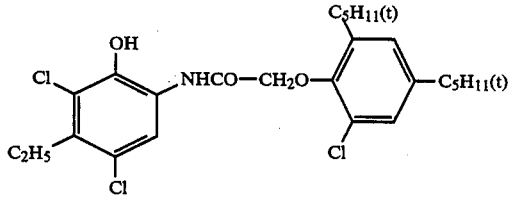

-continued
C-(16)
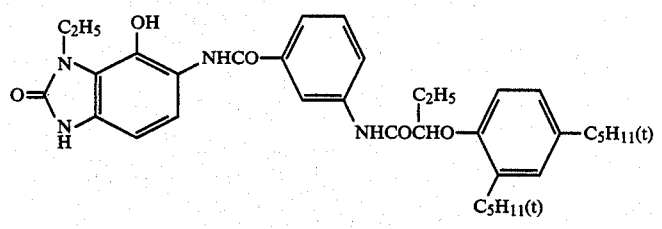

| Compound | $R_{33}$ | $R_{34}$ | $X_2$ |
|---|---|---|---|
| | | 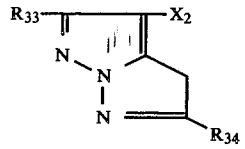 | |
| M-1 | CH3— | 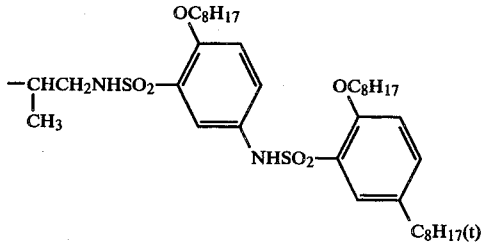 | Cl |
| M-2 | CH3— | 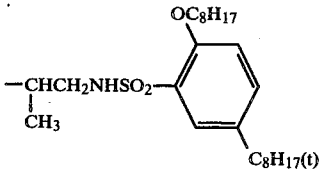 | Cl |
| M-3 | CH3— | 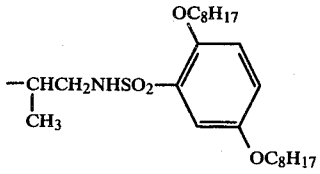 | 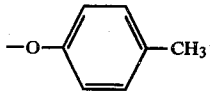 |
| M-4 | 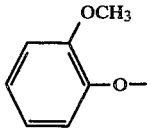 | 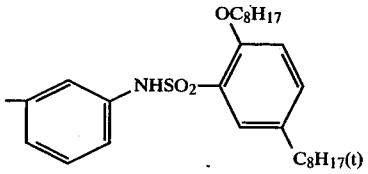 | 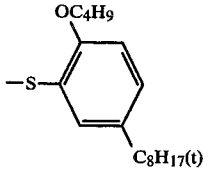 |

-continued
| Compound | $R_{33}$ | $R_{34}$ | $X_2$ |
|---|---|---|---|
| M-5 | CH3— | 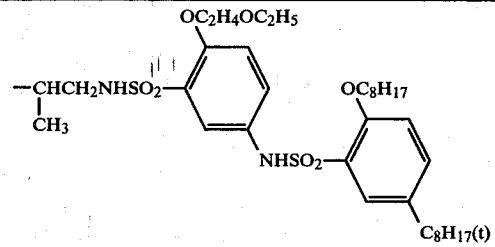 | Cl |
| M-6 | CH3— | 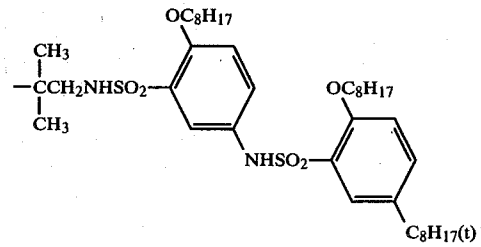 | Cl |
| M-7 | 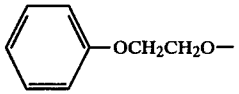 | 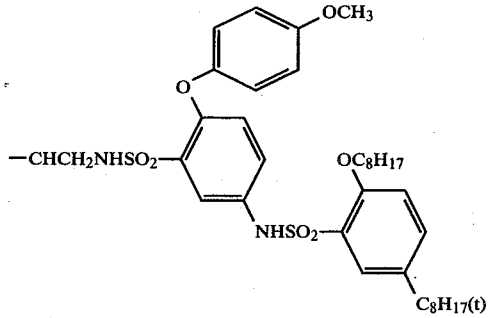 | 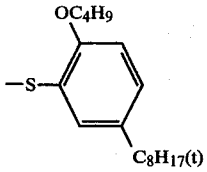 |
| M-8 | $CH_3CH_2O$— | " | " |
| M-9 | 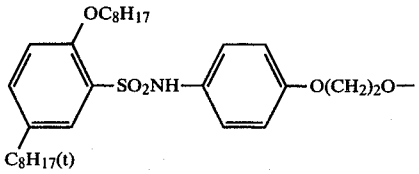 | 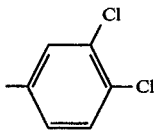 | " |

-continued
| Compound | $R_{33}$ | $R_{34}$ | $X_2$ |
|---|---|---|---|
| M-10 | 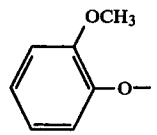 | 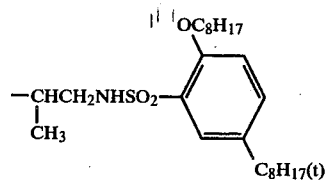 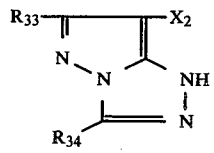 | Cl |
| M-11 | CH3— | 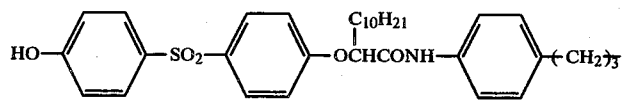 | Cl |
| M-12 | CH3— | 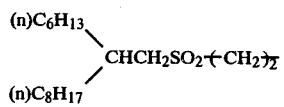 | Cl |
| M-13 | 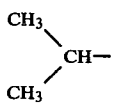 | 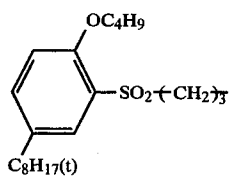 | Cl |
| M-14 | 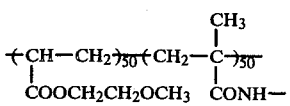 | 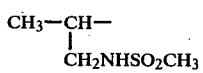 | Cl |

-continued
| Compound | $R_{33}$ | $R_{34}$ | $X_2$ |
|---|---|---|---|
| M-15 | 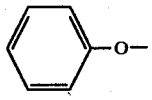 | 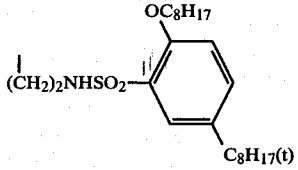 | Cl |
| M-16 | 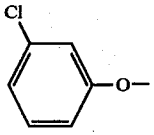 | 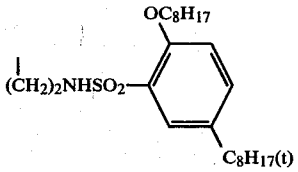 | 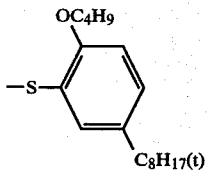 |

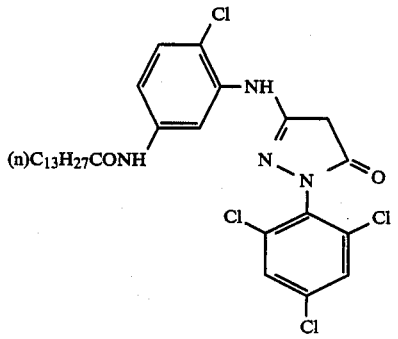
M-(17)
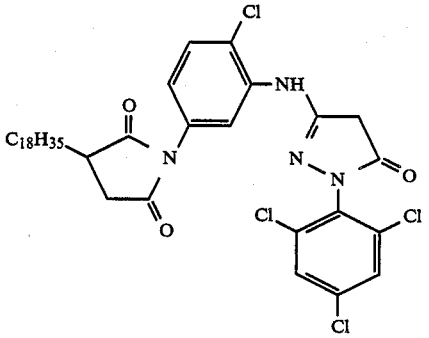
M-(18)
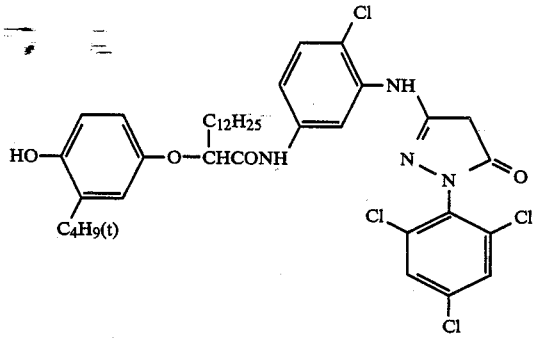
M-(19)
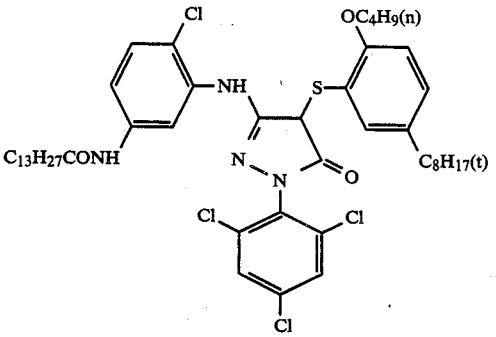
M-(20)

-continued
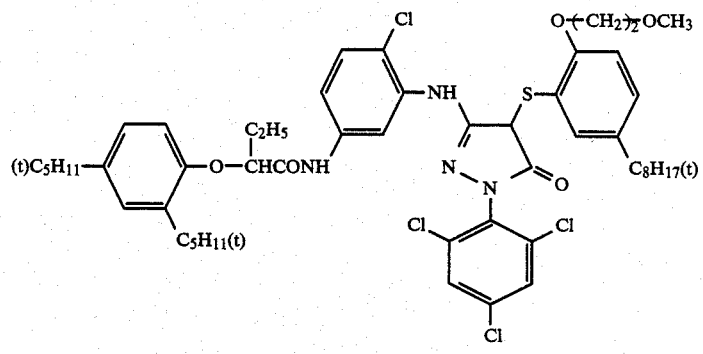
M-(21)
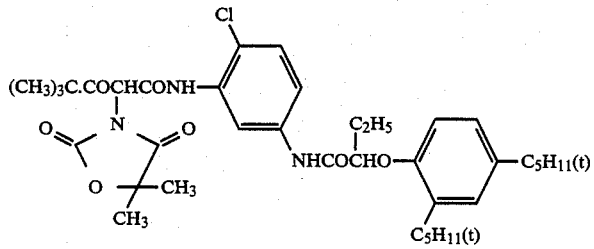
Y-(1)
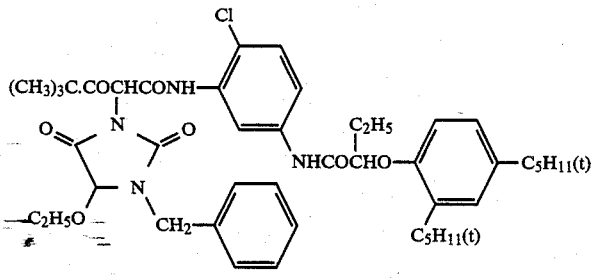
Y-(2)
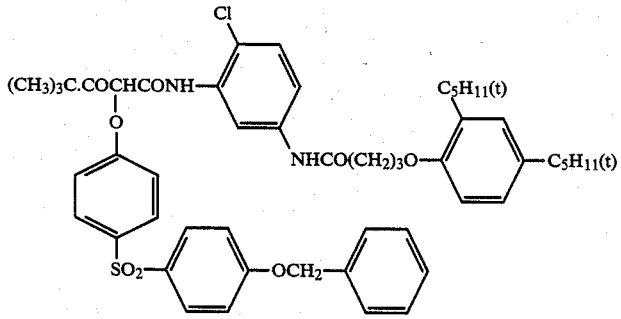
Y-(3)
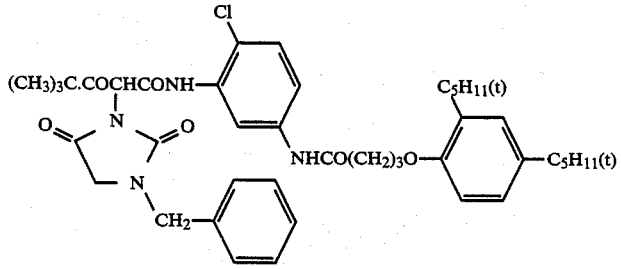
Y-(4)

-continued
Y-(5)
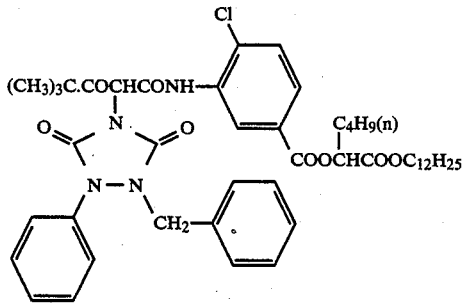
Y-(6)
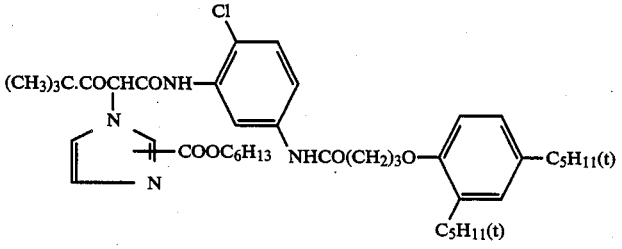
Y-(7)
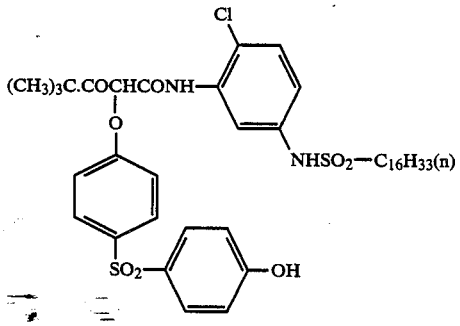
Y-(8)
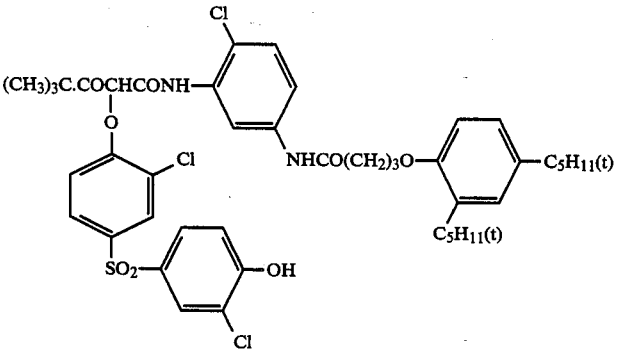
Y-(9)
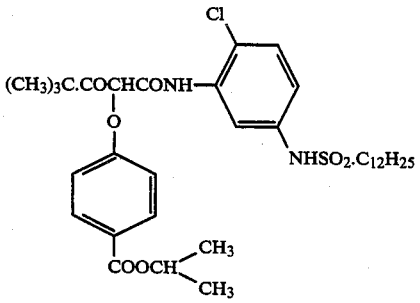

-continued

Y-(10)

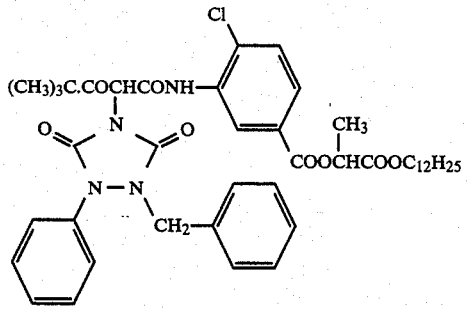

Y-(11)

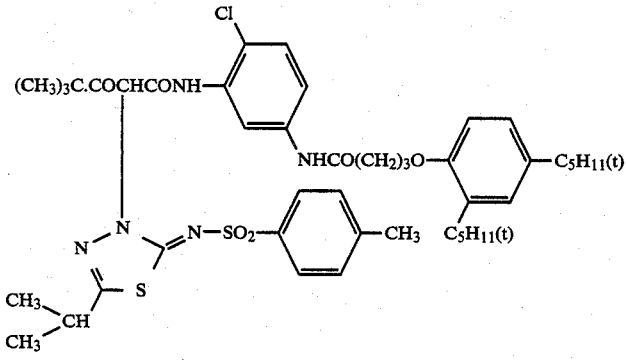

Y-(12)

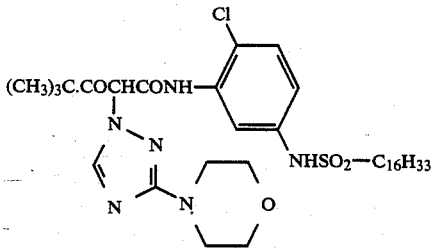

Colored couplers for correcting the unnecessary absorption of colored dyes may be incorporated into the photographic materials of the present invention, and examples of such colored couplers are described in Research Disclosure, Item 17643, VII-G, U.S. Pat. No. 4,163,670, JP-B-57-39413, U.S. Pat. Nos. 4,004,929 and 4,138,258 and British Pat. No. 1,146,368, and these are preferably used in the present invention.

Couplers capable of giving colored dyes with a suitable diffusibility may also be used in the present invention, and those described in U.S. Pat. No. 4,366,237, British Pat. No. 2,125,570, European Patent No. 96,570 and West German Patent Application (OLS) No. 3,234,533 are preferred.

Typical examples of polymerized dye-forming couplers are described in U.S. Pat. Nos. 3,451,820, 4,080,211 and 4,367,282 and British Pat. No. 2,102,173.

Couplers capable of releasing a photographically useful group with coupling may also preferably be used in the present invention. As DIR couplers which release a development inhibitor, those described in the patent publications mentioned in Research Disclosure, Item VII-F, as well as in JP-A-57-151944, 57-154234 and 60-184248 and U.S. Pat. No. 4,248,962 are preferred.

As couplers which imagewise release a nucleating agent or a development accelerator during development, those described in British Pat. Nos. 2,097,140 and 2,131,188 and JP-A-59-157638 and 59-170840 are preferred.

As other couplers which may be used in the photographic materials of the present invention, there are the competing couplers described in U.S. Pat No. 4,130,427, the poly-equivalent couplers described in U.S. Pat. Nos. 4,283,472, 4,338,393 and 4,310,618, the DIR redox compound-releasing couplers described in JP-A-60-185950, and the couplers capable of releasing a dye which may recolor after release, described in European Patent No. 173,302A.

In the present invention, where the spectral transmittance of the coupler in the taking color photographic material has an influence on the spectral exposure distribution in printing, the magenta coloring substance and the yellow coloring substance in the material are important. Accordingly, the pyrazoloazole type magenta couplers represented by the formula (M-3) are especially advantageous. These have the advantage that the masking color substance for the yellow coloring substance in the material are important. Accordingly, the pyrazoloazole type magenta couplers represented by the formula (M-3) are especially advantageous. These have the advantage that the masking color substance for the yellow coloring substance in the long wavelength range and the filter coloring substance as applied to improve the spectral exposure distribution in printing of the green-sensitive layer of the printing color photographic material may be used with ease. Accordingly, the thickness of the light-sensitive layer may be reduced and the image sharpness may be improved by the use of a benzoyl-acetanilide type yellow coupler.

The preferred silver halide to be contained in the photographic emulsion in the taking color photographic material used in the present invention is silver iodobromide, silver iodochloride or silver iodochlorobromide containing silver iodide in an amount of about 30 mol% or less. Especially preferably, the silver halide is a silver iodobromide containing silver iodide in an amount of from about 2 mol% to about 25 mol%.

The silver halide grains in the photographic emulsion may be regular grains having a regular crystal for such as a cubic, octahedral or tetradecahedral crystal form, or irregular grains having an irregular crystal form such as a spherical or tabular crystal form, or grains having a crystal defect such as a twin plane, or grains having a composite form of these crystal forms.

Regarding the grain size of the silver halide grains, the grains may be fine grains of about 0.2 μm or less or large size grains having a projected area diameter of up to about 10 μm. The silver halide emulsion may be either a monodisperse emulsion or a polydisperse emulsion.

The silver halide photographic emulsions for use in the present invention can be prepared, for example, by the methods described in *Research Disclosure,* Item 17643 (December, 1978), pages 22 to 23, "I. Emulsion Preparation and Types", ibid., Item 18716 (November 1979), page 648, P. Glafkides, *Chemie et Phisique Photographique* (Paul Montel, 1967, pages 293 to 513 (part II)), G. F. Duffin, *Photographic Emulsion Chemistry* (Focal Press, 1966), V. L. Zelikman et al., *Making and Coating Photographic Emulsion* (Focal Press, 1964).

The monodisperse emulsions described in U.S. Pat. Nos. 3,574,628 and 3,655,394 and British Pat. No. 1,413,748 are also preferred for use in the present invention.

In addition, tabular silver halide grains having an aspect ratio of about 5 or more may also be used in the present invention. The tabular grains may easily be prepared by the methods described in Gutoff, *Photographic Science and Engineering,* Vol. 14, pages 248 to 257 (1970), U.S. Pat. Nos. 4,434,226, 4,414,310, 4,433,048 and 4,439,520 and British Pat. No. 2,112,157.

The crystal structure of the silver halide grains for use in the present invention may be uniform in the outer and inner parts thereof, or the outer part and the inner part of the grains may have different halogen compositions, or the two parts may form a layered structure. Further, the grains may have different silver halide compositions bonded by an epitaxial junction, and they may also have any other compounds than silver halides, such as silver rhodanide or lead oxide, bonded to the grains.

In addition, a mixture of grains of different crystal forms may also be used in the present invention.

The emulsions for use in the present invention are generally physically ripened, chemically ripened and/or spectrally ripened before use. Additives to be used in these steps are described in Research Disclosure, Item 17643 and Item 18716. (as summarized in the Table below.)

In accordance with the present invention, the silver halide emulsion used in the printing color photographic material, especially in the green-sensitive layer (GL) or the red-sensitive layer (RL) thereof, is preferred to have a strong intrinsic sensitivity in the longer wavelength range than the wavelength range of the blue-sensitive layer (BL) of the material.

Silver halide light-sensitive emulsions generally have a sensitivity light in a shorter wavelength range than about 540 nm for silver iodobromide emulsion, a shorter wavelength range than about 500 nm for silver bromide emulsion or a shorter wavelength range than about 420 nm for silver chloride, thereby to give a latent image. The details of the light-sensitivity of silver halide light-sensitive emulsions are described in T. H. James, The Theory of the Photographic Process (1977, 4th Ed.), pages 39 to 44. Accordingly, the halogen composition of the silver halide grains in the photographic materials of the present invention as well as the method of formation of crystals of the grains is important in the present invention.

As a preferred embodiment of the present invention, the silver halide emulsions to be used in the photographic materials, especially in the printing color photographic material, contain substantially silver iodide-free silver chlorobromide emulsion which is composed of crystals of silver chloride or silver bromide or mixed crystals thereof essentially composed of (100) planes, as described in EP-A-0280238, 0273429, and 0273430. Further, a substantially silver iodide-free silver chlorobromide emulsion which is composed of crystals of silver chloride or silver bromide or mixed crystals thereof essentially composed of (111) planes, as described in Japanese Patent Application Nos. 62-47225 and 62-150320, is also preferred.

The term "substantially silver iodide-free silver halide emulsion" referred to herein means that the content of silver iodide in the total silver halide is 2 mol% or less, preferably 1 mol% or less, more preferably 0.5 mol% or less, and most preferably, the silver halide contains no silver iodide. Inclusion of silver iodide in the silver halide emulsion may often be advantageous in view of the light-sensitivity of the emulsion in that the amount of light absorbed may be increased, the adsorption of spectral sensitizing dye would be enhanced or densenitization by spectral sensitizing dyes would be reduced. However, in the photographic system of the present invention, the reduction of the developing rate for the silver iodide-containing emulsion would cause the reduction of the developing rate of all the silver halide grains in case of rapid processing effected in a short period of time, which, therefore, would be an extreme disadvantage to the desired reduction of the mean color mixing degree to be attained by the present invention. Inclusion of 0.4 mol% or less silver iodide may often be advantageous for adsorption of spectral sensitizing dyes, but in the present invention, it is preferred to use basically silver iodide-free silver halide emulsions.

The effect by the use of the band-stop-filter in accordance with the present invention may be attainable in any case of using various silver bromide, silver chlorobromide or silver chloride emulsions. However, in order to more efficiently attain the improvement of color-reproducibility by the present invention, it is preferred that the silver halide emulsion in the printing color photographic material comprises silver chlorobromide having a silver bromide content of 30 mol% or less, or silver chlorobromide having a silver iodide content of 0.4 mol% or less and a silver bromide content of 10 mol% or less, or silver chloride.

The halogen composition of the silver halide emulsions for sue in the present invention is further related to the remaining side-coloration of dyes and desilverability in color development, the inclusion of too much silver iodide in the emulsion is disadvantageous in this respect. The characteristics associated with the halogen composition cannot be determined only by the mean halogen composition of the complete grains, but depends upon the halogen composition distribution in the inside of the respective grains. Accordingly, the silver halide emulsions for use in the present invention may have a halogen composition distribution or structure in the inside of the respective grains. One typical embodiment of the grains is multilayer-structural grains in which the halogen composition differs in the inside core of the grain and a part or all of the surface layer shell thereof. In such grains, for example, the shape of the core may be same as or different from that of the shell-coated complete grain. Specifically, the core is cubic and the shell-coated grain is also cubic; or the core is octahedral while the shell-coated grain is cubic. As another example, the core is a distinct regular crystal while the shell-coated grain is somewhat irregular. Further, the grains may have not only a two-layered structure but also a three-layered or higher multi-layered structure. The surface of the core/shell two-layered grain may further by coated with a thin coat containing a silver halide having a different halogen composition.

Regarding the silver halide grains having an internal structure for use in the present invention, not only the above-mentioned core/shell grains but also junction structured grains may be used in the present invention. The junction structured grains (junction grains) may be formed by growing crystals of different halogen composition on the edges or corners of the host crystal or on the planes thereof. In the junction grains formed as mentioned above, the host crystal may have a uniform halogen composition or may have a core/shell or the like layered structure. In the core/shell or the like layered structure, host grain, for example the core part may have a higher silver bromide content and the shell part a lower silver bromide content, and vice versa. Also in the junction structured grains, the host crystal may have a higher silver bromide content and the guest crystal a relatively lower silver bromide content, and vice versa.

In these structured grains, the boundary part between the parts each having a different halogen composition may be a distinct boundary or may be an indistinct bondary, forming a mixed crystal by the composition difference, or still alternatively, the grains may have a continuous structure variation.

In accordance with the present invention, emulsions of structured grains, such as the above core/shell grains or junction grains, are more preferably used than emulsions of uniform halogen composition-having grains.

Emulsions containing silver halide grains whose development-initiating point has been controlled or those whose halogen conversion has been inhibited sensitizing dyes, as described in Japanese Patent Application Nos. 62-86163, 62-86164, 62-86165 and 62-150320, are preferably used in the present invention.

The mean grain size (average of diameters corresponding to a sphere calculated on the basis of volume) of the grains in the silver halide emulsions to be used in the printing color photographic material in the present invention is preferably from 0.1 μm to 2 μm, especially preferably from 0.15 μm to 1.4 μm.

The grain size distribution is referably narrow, and monodisperse emulsions are preferred. In particular, regular grains-containing monodispersed emulsions are preferred in the present invention. In particular, emulsions in which grains having a grain size which falls within the mean grain size ±20% account for 85% or more, especially 90% or more, by number or by weight of the total grains are preferred for use in the present invention.

The silver halide grains for use in the present invention may be formed or physically ripened in the presence of a cadmium salt, a zinc salt, a lead salt, a thallium salt, an iridium salt or a complex salt thereof, a rhodium salt or a complex salt thereof, or an iron salt or a complex salt thereof.

In particular, an iridium salt or a complex salt thereof may be used in an amount of from 10–9 to 10–4 mol, more preferably from 10–8 to 10–5 mol, per mol of the silver halide. As compared with silver halide grains formed in the absence of an iridium salt or a complex salt thereof, those formed in the presence of the salt or complex are especially advantageous for obtaining rapid processability and stability in the process of high intensity exposure or low intensity exposure outside the pertinent exposure intensity range.

Physical ripening in the presence of a known silver halide solvent (for example, ammonia, potassium thiocyanate, or the thioethers and thione compounds described in U.S. Pat. No. 3,271,157, JP-A-51-12360, 53-82408, 53-144319, 54-100717 and 54-155828) is preferred to as to obtain a monodisperse silver halide emulsion containing regular crystal grains and having a narrow grain size distribution.

For removal of soluble salts from the physically ripened emulsion, noodle washing, flocculation sedimentation or ultrafiltration may be utilized.

The silver halide emulsions for use in the present invention may be chemically sensitized by sulfur sensitization, selenium sensitization, reduction sensitization or noble metal sensitization or a combination thereof. Sulfur sensitization using an active gelatin or a sulfur-containing compound capable of reacting with silver ion (for example, thiosulfates, thiourea compounds, mercapto compounds, rhodanine compounds), reduction sensitization using a reducing substance (for example, stannous salts, amine salts, hydrazine derivatives, formamidinesulfinic acid, silane compounds) and noble metal sensitization using a metal compound (for example, gold complexes, or complexes of metals of Group VIII of the Periodic Table such as Pt, Ir, Pd, Rh, Fe) can be utilized for the chemical sensitization, singly or in combination. For the monodisperse silver chlorobromide emulsion for use in the present invention, sulfur sensitization or selenium sensitization is preferably used, and it is preferred to use a hydroxyazaindene compound in the sensitization.

The silver halide emulsion to be used in the direct positive color printing photographic material of the present invention is preferably a silver halide emulsion containing multilayered structure internal latent image type silver halide grains, for example, those described in JP-A-63-193146 and having the above-mentioned halogen composition.

As the silver halide emulsion used in the color reversal printing photographic material of the present invention, for example, the emulsions described in European Patent 0217353A and JP-A-61-39043 and 61-61156 are preferred.

In printing a printing color photographic material by the method of the present invention, the distribution of the amount of the spectral light to be imparted to the respective light-sensitive layers of the material may be made independent of each other so as to improve the color-reproducibility of the material, and for this, it is preferred to apply J-type spectral sensitization to the blue-sensitive layer of the printing color photographic material, J-type spectral sensitization to the green-sensitive emulsion layer thereof and J-type or M-type spectral sensitization to the red-sensitive layer thereof.

For such spectral sensitization spectral sensitizing dyes can be used selected from the group consisting of cyanine dyes, merocyanine dyes, complex cyanine dyes, complex merocyanine dyes, holopolar cyanine dyes, hemicyanine dyes, styryl dyes, and hemioxonole dyes. In particular, the sensitizing dyes described in Japanese patent application No. 62-206589, pages 25 to 49 are preferably used. In addition, combinations of sensitizing dyes as well as combinations with additional mercaptoheterocyclic compounds, azaindene compounds, aminostylbene compounds or aromatic organic acid-formaldehyde condensation products for super color sensitization is preferred.

The taking color photographic material is especially preferably spectrally sensitized with the sensitizing dyes described in Japanese patent application No. 62-175516.

Other photographic additives which may be used in the present invention are described in the following two *Research Disclosure's,* as summarized below.

| Kinds of Additives | RD 17643 | RD 18716 |
|---|---|---|
| 1. Chemical Sensitizer | p. 23 | p. 648, right column |
| 2. Sensitivity-enhancer | | " |
| 3. Spectral Sensitivizer Super Color Sensitizer | pp. 23–24 | from p. 648, right column to p. 649, right column |
| 4. Brightening Agent | p. 24 | |
| 5. Anti-foggant Stabilizer | pp. 24–25 | p. 649, right column |
| 6. Light Absorbent Filter Dye UV Absorbent | pp. 25–26 | from p. 649, right column to p. 650, left column |
| 7. Stain Inhibitor | p. 25, right column | p. 650, from left to right column |
| 8. Color Image Stabilizer | p. 25 | |
| 9. Hardening Agent | p. 26 | p. 651, left column |
| 10. Binder | p. 26 | " |
| 11. Plasticizer Lubricant | p. 27 | p. 650, right column |
| 12. Coating Aid Surfactant | pp. 26–27 | " |
| 13. Antistatic Agent | p. 27 | " |

Supports which are suitably used in the present invention are described, for example, in *Research Disclosure,* Item 17643, page 28 and ibid., Item 18716, from page 647, right-hand column to page 648, left-hand column.

The color photographic materials of the present invention may be developed by conventional methods, for example, by the methods described in *Research Disclosure,* Item 17643, pages 28 to 29 and ibid., Item 18716, page 651, left to light-hand column.

The silver halide color photographic materials of the present invention are generally subjected to rinsing in water and/or stabilization, after being desilverized by fixation or bleach-fixation.

The amount of the water used in the rinsing step can be set in a broad range, in accordance with the characteristics of the photographic material being processed (for example, depending upon the raw material components, such as coupler) or the use of the material, as well as the temperature of the rinsing water, the number of the rinsing tanks (the number of the rinsing stages), the replenishment system (normal current or counter-current) and other various conditions. Among these conditions, the relation between the number of the rinsing tanks and the amount of the rinsing water in a multi-stage countercurrent rinsing system can be determined by the method described in *Journal of the Society of Motion Picture and Television Engineers,* Vol. 64, pages 248 to 253 (May, 1955).

According to the multi-stage countercurrent system described in this publication, the amount of the rinsing water to be used can be reduced noticeably, but because of the prolongation of the residence time of the water in the rinsing tank, bacteria propagate in the tank so that the floating substances generated by the propagation of bacteria adhere to the surface of the material being processed. Accordingly, this system often has problems. In the practice of the present invention for processing color photographic materials, the method of reducing calcium and magnesium, which is described in Japanese patent application No. 61-131632 can effectively be used for overcoming this problem. In addition, the isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fundigical Agents* pages 102 to 137, pagesa 193 to 260 (October 1982), and *Bactericidal and Fungicidal Techniques to Microorganisms,* edited by Association of Sanitary Techniques, Japan, and *Encyclopeadia of Bactericidal and Fungicidal Agents* pages 72 to 321 (August, 1986), edited by Nippon Bactericide and Fungicide Association can also be used.

The pH value of the rinsing water to be used in the method of the present invention for processing photographic materials is from 4 to 9, preferably from 5 to 8. The temperature of the rinsing water and the rinsing time can also be varied in accordance with the characteristics of the photographic material being processed as well as the use thereof, but in general, the temperature is from 15° to 45° C. and the time is from 20 seconds to 10 minutes; and preferably the temperature is from 25° to 40° C. and the time is from 30 seconds to 5 minutes.

Alternatively, the photographic materials of the present invention can be processed directly with a stabilizing solution in place of being processed with the above-mentioned rinsing water. An such stabilization processes described in JP-A-57-8543, 58-14834, 59-184343, 60-220345, 60-238832, 60-239784, 60-239749, 61-4054 and 61-118749 can be used. In particular, stabilizing baths containing 1-hydroxyethylidene-1, 1-diphosphonic acid, 5-chloro-2-methyl-4-isothiazolin-3-one, bismuth compounds or ammonium compounds are preferably used.

Further, the stabilization step may follow the above-mentioned rinsing step. As one example of the system, there is a stabilizing bath containing formalin and a surfactants, which is used as a final bath for taking color photographic materials.

As the silver halide color photographic materials for use in the present invention, negative-positive type or positive-positive type printing color photographic materials, such as general printing color photographic paper, color reversal photographic paper, color reversal photographic film, silver dye-bleach type color photographic paper, direct positive-type color photographic paper, diffusion transfer-type color photographic paper, and heat-developing diffusion transfer-type color photographic paper or film, etc. are preferred. Using such color photographic materials, objects may directly be photographed. Accordingly, the band stop filter of the present invention is applied to the exposing device, printer or printer part in a minilaboratory system as well as copying device for these color photographic materials. For example, the band stop filter of the present invention can be used in the printing methods described in Japanese patent application Nos. 62-150320, 62-195222, 62-206589, 62-229856, 62-223053, 62-239032, 62-260357 and 62-285998. Further, the band stop filter of the present invention can be applied to the exposure device described in Japanese patent application Nos. 62-146542, 62-200508, 62-146544, 62-191187 and 62-255048, as well as to an auto-printer used for printing of general printing color photographic paper by a white light subtractive process.

The silver halide color photographic materials used in the present invention typically have at least three light sensitive layers as formed on a support, in which one light sensitive layer is a blue-sensitive layer having a spectral sensitivity in the range of from 390 to 485 nm and the others are a green-sensitive layer having a spectral sensitivity in the range of from 475 to 600 nm and a red-sensitive layer having a spectral sensitivity in the range of from 575 to 740 nm. As mentioned in Japanese patent application No. 62-195222, the effective spectral light amount distribution ($E(\lambda)$) is obtained from the product of the spectral transmittance of the corresponding coloring material to the color original, the spectral sensitivity of the corresponding light-sensitive layer in the printing color photographic material and the spectral energy distribution of the exposure light source.

Preferably, the band stop filter to be used in the present invention has a maximum absorption wavelength, preferably, an absorption wavelength range in the wavelength range outside either the wavelength range of the maximum light-sensitive wavelength of the blue-sensitive layer, green-sensitive layer or red-sensitive layer of the color photographic material being used, or the maximum wavelength of the effective spectral light amount distribution, $\pm 15$ nm, preferably $\pm 20$ nm.

In accordance with the image-forming method of the present invention, the band stop filter is set between the light source or object and the color photographic material, and the material is imagewise exposed and then subjected to color development. Next, the color development process for the materials of the present invention is described.

The method of the present invention may be applied to a processing solution (color developer) containing a sulfite ion in a reduced amount or not containing sulfite ion. Preferably, the sulfite concentration is the processing solution to be used in the method of the present invention is from 0 to 0.02 mol/liter or so.

When the sulfite ion in the processing solution is reduced, the coloring capacity can be elevated without increasing the amount of the silver halides or color couplers to be used. However, the reduction of the sulfite ion causes an increase of color mixing and deterioration of color-reproducibility. However, by using the image-forming method of the present invention, such color mixing may be prevented and coloring capacity may be augmented.

In addition, the sulfite ion acts as a solvent for a silver halide emulsion having a high chlorine content (high silver chloride emulsion) to cause extreme reduction of the sulfite ion concentration. When the sulfite ion concentration in a color developer varies because of this action, the variation causes fluctuation of the photographic characteristic, and accordingly, the printer condition is always varied in the case of processing a printing photographic material.

More preferably, the processing solution color developer for use in the present invention contains a reduced amount of benzyl alcohol or contains substantially no benzyl alcohol in order that the environmental pollution by the processing solution may be reduced and color mixing and staining by the solution may also be reduced.

If benzyl alcohol is incorporated into the processing solution, diethylene glycol or triethylene glycol would be necessary as a solvent, since benzyl alcohol is poorly soluble in water. However, these compounds inclusive of benzyl alcohol have high environmental pollution load values of BOD or COD, and accordingly, it is desired to omit benzyl alcohol from the processing solution in view of the object of reducing environmental pollution. Furthermore, even if the solvent is used, a longer time is necessary to dissolve benzyl alcohol in the processing solution, and therefore, it is better not to use benzyl alcohol for the purpose of reducing the time for preparation of the processing solution.

In addition, if benzyl alcohol is brought into the post bath, a bleaching bath or a bleach-fixing bath, this causes formation of a leuco dye form the cyan dye in the photographic material processed and thereby causes lowering of the color density of the material processed. Further, benzyl alcohol often causes delay of the washing-out of the developer components form the photographic material processed, and therefore, benzyl alcohol often badly affects the image storability of the photographic material processed. On these grounds, it is better not to use benzyl alcohol in the processing solution.

In accordance with the present invention, the processing solution contains substantially no sulfite ion, which means that the solution may contain a sulfite ion in such amount that would not have an influence on the photographic properties of the solution. For example, the content of the sulfite ion in the processing solution is from 0 to 0.02 mol/liter, preferably from 0 to 0.002 mol/liter. The processing solution color developer contains substantially no benzyl alcohol, which means that the solution contains 5.0 ml or less, preferably 2 ml or less, per liter of the solution. More preferably, however, the solution contains no benzyl alcohol.

In accordance with the present invention, it is preferred that the processing solution contains an organic preservative, described below, in place of sulfite ion.

By incorporation of an preservative, the color developer may be stabilized so that color mixing may be prevented without lowering the coloring capacity of the photographic material to be processed with the color developer.

The organic preservative to be used in the present invention for this purpose includes any and every organic compound which may be added to processing solutions for color photographic materials so as to prevent the deterioration of the aromatic primary amine color developing agent in the solution. Such organic preservatives include organic compounds having a function of preventing aerial oxidation of color developing agents, and above all, hydroxylamines, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and condensed cyclic amines are especially effective organic preservatives. These are illustrated in JP-A-63-21647, 63-53551, 63-44656, 63-44657, 63-43140, 63-56654, 63-58346, 63-43138, 63-170642 and 63-44655, Japanese patent application Nos. 61-147823, and 61-173595, U.S. Pat. Nos. 3,615,503 and 2,494,903, JP-A-52-143020 and JP-B-48-30496.

Other techniques of using organic preservatives, include the technique of using an alkanolamine described in JP-B-60-57586 and the technique of using a polyalkyleneimine described in JP-A-56-94349.

The amount of the organic preservative to be added to the color developer for use in the present invention is from 0.005 mol/liter to 0.5 mol/liter, preferably from 0.03 mol/liter to 0.1 mol/liter.

The color developer for use in the present invention is preferably an aqueous alkaline solution containing mainly an aromatic primary amine color developing agent. As the color developing agent, p-phenylenediamine compounds are preferably used, although aminophenol compounds may also be used. Specific examples of p-phenylenediamine compounds for the agent include 3-methyl-4-damino-N, N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides or p-toluenesulfonates thereof. Two or more of these compounds may be used in combination. In particular, 3-methyl-4-amino-N-etyhyl-N-β-methanesulfonamido-ethylaniline is preferred in the present invention.

The color developer generally contains a pH buffer such as alkali metal carbonates, borates or phosphates as well as a development inhibitor or an antifoggant such as bromides, iodides, benzimidazoles, benzothiazoles or mercapto compounds. If necessary, the color developer may also contain an organic solvent such as ethylene glycol or diethylene glycol, a development accelerator such as polyethylene glycol, quaternary ammonium salts or amines, a color-forming coupler, a competing coupler, an antifoggant such as sodium boron hydride, an auxiliary developing agent such as 1-phenyl-3-pyraozlidone, a tackifier, or a chelating agent such as aminopolycarboxylic acids, aminopolyphosphonic acids, alkylphosphonic acids or phosphonocarboxylic acids. A specific examples of such chelating agents, there are ethylenediamine-tetraacetic acid, nitrilo-triacetic acid, diethylenetriamine-pentaacetic acid, cyclohexanediamine-tetraacetic acid, hydroxyethyliminodiacetic acid, 1-hydroxyethylidene-1, 1-diphosphonic acid, nitrilo-N,N,N-trimethylenephosphonic acid, ethylenediamine-N,N,N',N'-tetramethylenephosphonic acid, ethylenediamine-di (o-hydroxyphenylacetic acid) and salts thereof.

For reversal processing, the photographic material is first subjected to black-and-white development and then to color development. The black-and-white developer for the former development may contain one or more known black-and-white developing agents such as dihydroxybenzenes (e.g., hydroquinone), 3-pyrazolidones (e.g., 1-phenyl-3-pyrazolidone) or aminophenol (e.g., N-methyl-p-aminophenol).

The color developer and black-and-white developer generally have a pH value of from 9 to 12. The amount of the replenisher used for the respective developers is, in general, 3 liters or less per $m^2$ of the color photographic material being processed, though depending upon the kind of the material. When the bromide ion concentration in the replenisher is reduced, the amount of the replenisher may be 500 ml or less per $m^2$ of the material. When the amount of the replenisher is reduced, it is desired to minimize the surface area of the processing solution to be contacted with air so as to prevent the evaporation of the solution or aerial oxidation of the solution. By preventing accumulation of bromide ion in the developer, the amount of the replenisher used may be reduced.

After color-development, the photographic emulsion layer is generally bleached. The bleaching may be conducted simultaneously with fixation (bleach-fixation) or may be conducted separately from fixation. For the purpose of rapid photographic processing, bleach-fixation may be carried out after bleaching. Further, bleach-fixation may be carried out after bleaching. Further, bleach-fixation may be carried out using two continuous bleach-fixing tanks; fixaton may be carried out prior to bleach-fixation; or bleaching may be carried out after bleach-fixation. The system may freely be selected in accordance with the object thereof. As a bleaching agent can be used, for example, compounds of a polyvalent metals such as iron (III), cobalt (III), chromium (VI) or copper (II) as well as peracids, quinones and nitro compounds. As specific examples of bleaching agents, there are ferricyanides, bichromates; organic complexes of iron (III) or cobalt (III), for example, complexes with aminopolycarboxylic acids such as ethylenediamine-tetraacetic acid, diethylenetriamine-pentaacetic acid, cyclohexanediamine-tetraacetic acid, methylimino-diacetic acid, 1,3-diaminopropane-tetraacetic acid or glycol etherdiamine-tetraacetic acid or organic acids such as citric acid, tartaric acid or malic acid; persulfates; hydrobromides; permanganates; and nitrobenzenes. Among them, aminopolycarboxylic acid/iron (III) complexes such as ethylenediamine-tetraacetic acid/iron (III) complex or diethylenetriamine-pentaacetic acid/iron (III) complex as well as persulfates are preferred in view of the rapid processability thereof and of prevention of environmental pollution. In particular, aminopolycarboxylic acid/iron (III) complexes are especially useful both in a bleaching solution and in a bleach-fixing solution. The bleaching soluton or bleach-fixing solution containing such an aminopolycarboxylic acid/iron (III) complex generally has a pH value of from 5.5 to 8, but may have a lower pH value for the purpose of accelerating the processing therewith.

A bleaching accelerator may be added to the bleaching solution or bleach-fixing solution or a previous bath thereof, if desired. Specific examples of useful bleaching accelerators include the mercapto group- or disulfido group-containing compounds described in U.S. Pat. No. 3,893,858, West German Patent 1,290,812, JP-A-53-95630 and *Research Disclosure,* Item 17129 )(July, 1978); the thiazolidine derivatives described in JP-A-50-140129; the thiourea derivatives described in U.S. Pat. No. 3,706,561; the iodides described in JP-A-58-16235; the polyoxyethylene compounds described in West German Patent 2,748,430; the polyamine compounds described in JP-B-45-8836; and bromide ion. Above all, the mercapto group- or disulfide group-containing compounds are preferred because of the high accelerating activity thereof, and the compounds described in U.S. Pat. No. 3,893,858, West German Patent 1,290,812 and JP-A-53-95630 are especially preferred. Further, the compounds described in U.S. Pat. No. 4,552,834 are also preferred. These bleaching accelerators may also be incorporated into photographic materials. When taking color photographic materials are bleach-fixed, the bleaching accelerators are especially useful.

As a fixing agent, thiosulfates, thiocyanates, thioether compounds, thioureas and a large amount of iodides may be used in the present invention. Among them, thiosulfates are generally used, and in particular, ammonium thiosulfate is used most widely. As a preservative for the bleaching-fixing solution, sulfites, bisulfites, sulfinic acids or carbonyl-bisulfite adducts are preferred.

The overflow solution following the replenishment to the above-mentioned rinsing water and/or stabilizing water may be re-used in the previous desilvering step or other steps.

The silver halide color photographic materials of the present invention may contain a color developing agent for the purpose of simplifying and accelerating the step of processing the photographic material. When the agent is incorporated into the material, it is applied to the material in the form of various precursors of the agent. For example, these include the indoaniline compounds described in U.S. Pat. No. 3,342,597, the Schiff base compounds described in U.S. Pat. No. 3,342,599 and *Research Disclosure,* Items 14850 (August 1976) and 15159 (November 1976), the aldole compounds described in *Research Disclosure,* Item 13924, the metal complexes described in U.S. Pat. No. 3,719,492, and the urethane compounds described in JP-A-53-135628.

The silver halide color photographic materials of the present invention may contain various kinds of 1-phenyl-3-pyrazolidones for the purpose of enhancing the developability thereof, if desired. Specific examples of the compounds are described in JP-A-56-64339, 57-144547 and 58-115438.

In accordance with the present invention, the processing solutions are used at a temperature of from 10° to 50° C. In general, they are used at a standard temperature of from 33° C. to 38° C., but the temperature may be made higher so as to accelerate the processing or to shorten the processing time, or on the contrary, the temperature may be made lower so as to improve the quality of the image to be formed in the material or to improve the stability of the processing solutions. For the purpose of economizing by reducing the silver content in the photographic material, the cobalt intensifier or hydrogen peroxide intensifier described in West German Pat. No. 2,226,770 or U.S. Pat. No. 3,674,499 may be utilized.

As the silver halide contained in the light-sensitive layers of the silver halide color photographic materials of the present invention, silver iodobromide, silver bromide, silver chlorobromide, silver chloride or silver chloroiodobromide is preferred. In particular, silver iodobromide or silver chloroiodobromide containing from about 10 to about 0.5 mol % of silver iodide is preferred for a color reversal printing photographic paper; and silver chlorobromide containing from about 80 to about 99.5 mol% of silver chloride is preferred for a color printing photographic paper. Regarding the halogen composition of the silver halide grains, the grains may have a uniform halogen composition throughout the grain structure, the multi-structural grains where different halogen compositions are layered or combined discontinuously and isolatedly are preferred for use in the present invention. In particular, core/shell structure multi-structural grains are preferred for direct positive type color photographic materials.

Various kinds of color couplers may be used in the present invention, and specific examples of couplers usable in the invention are described in the publications referred to in *Research Disclosure,* Item 17643, VII-C to G.

As yellow couplers for use in the present invention, for example, those described in U.S. Pat. Nos. 3,933,501, 4,022,620, 4,326,024 and 4,401,752, JP-B-58-10739 and British Patents 1,425,020 and 1,476,760 are preferred.

As magenta couplers, 5-pyrazolone and pyrazoloazole compounds are preferred, and in particular, those described in U.S. Pat. Nos. 4,310,619 and 4,351,897, European Patent 73636, U.S. Pat. Nos. 3,061,432 and 3,725,067, *Research Disclosure,* Vol. 242, Item 24220 (June, 1984) JP-A-60-33552, *Research Disclosure,* Vol. 242, Item 24230 (June, 1984), JP-A-60-43659 and U.S. Pat. Nos. 4,500,630 and 4,540,654 are especially preferred.

As cyan couplers, there are phenol and naphthol couplers, and those described in U.S. Pat. Nos. 4,052,212, 4,146,396, 4,228,233, 4,296,200, 2,369,929, 2,801,171, 2,771,162, 2,895,826, 3,772,002, 3,758,308, 4,334,011 and 4,327,173, West German Patent Application (OLS) No. 3,329,729, European Patent 121,365A, U.S. Pat. Nos. 3,446,622, 4,333,999, 4,451,559 and 4,427,767 and European Patent 161,626A are preferred.

The couplers for use in the present invention can be introduced into the photographic materials by various known dispersion methods.

Examples of high boiling point solvents which may be used in an oil-in-water dispersion method are described in U.S. Pat. No. 2,322,027.

Examples of the steps and effects of a latex dispersion method as well as examples of latexes to be used in the method for impregnation are described in U.S. Pat. No. 4,199,363, West German Patent (OLS) Nos. 2,541,274 and 2,541,230.

In a coupler-in-developer-type color reversal film, not a hydrophobic coupler but a coupler soluble in a developer is used, and the coupler is added to the color developer but not to the photographic material.

The internal latent image type emulsions and silver halide grains thereof which may be used in the direct positive system of auto-positive color films or auto-positive color papers of the present invention are described in JP-A-63-81337, from page 4, left lower column to page 5, right lower column.

The internal latent image type emulsion may be either a conversion type emulsion or a core/shell type emulsion, but the latter core/shell type emulsion is preferred.

The color couplers which may be used in the direct positive system are described in JP-A-63-81337, from page 6, left upper column to page 8, left upper column; and various compounds which may be incorporated into the photographic materials (for example, color-fogging inhibitor, anti-fading agent, dye) are described in the same JP-A-63-81337, page 8, from right upper column to right lower column.

When a direct positive color photographic material is used in accordance with the present invention, it is preferred that the material is first imagewise exposed and then, after or while being fogged with light or a nucleating agent, this is color developed with a surface developer which contains an aromatic primary amine color developing agent and which preferably has pH of 12 or less, and thereafter subjected to bleaching and fixation to obtain a direct positive color image on the material. The pH value of the developer is more preferably within the range of from 11.0 to 10.0.

For the fogging treatment to be employed in the present invention, either a "light-fogging method" in which the complete surface of the light-sensitive layer is subjected to a second exposure, or a "chemical-fogging method" in which the photographic material is developed in the presence of a nucleating agent may be used. Still alternatively, the photographic material may be developed in the presence of both a nucleating agent and light. Further, a photographic material containing a nucleating agent may be subjected to fogging exposure.

The "light-fogging method" is described in JP-A-81337, from page 9, left lower column to page 10, left upper column, and nucleating agent which may be used in the present invention are described in the same JP-A-63-81337, from page 10, right upper column to page 14, left lower column. In particular, the compounds of formula (N-1) and (N-2) described in the same JP-A-63-81337 are preferably used in the present invention.

Nucleating agent accelerators which may be used in the present invention are described in JP-A-63-81337, page 15, from left upper column to left lower column, and in particular, the compounds of (A-1) to (A-13) mentioned in the same page are preferred as the specific examples.

Regarding color diffusion transfer photographic materials which may be processed in accordance with the image-forming method of the present invention, those which use a dye developing agent are described in, for example, U.S. Pat. No. 3,415,644; those which use a diffusible dye-releasing coupler in, for example, T. H. James, *The Theory of the Photographic Process*, 4th Ed., Chap. 12 (1977); and those which use a diffusible dye-releasing redox compound in, for example, *Photographic Science and Engineering*, Vol. 20, No. 4, pages 155 to 164, July/August (1976).

Heat-developable color photographic materials which may be processed in accordance with the image-forming method of the present invention are described in, for example, JP-A-58-58543.

Methods to prepare a preferable band-stop filter used in the present invention are described in the following.

PREPARATION OF BAND-STOP FILTER (1)

A polished white glass plate having a thickness of 3 mm was washed with soapywater and dried and then dipped in an ultrasonic washing machine containing a freon liquid for 1 minute and 30 seconds and ultrasonically washed. The thus treated glass plate was set on a substrate holder in an electron beam heating type evaporation plating apparatus so as to form an interference filter on the glass plate as a substrate by evaporation plating.

Figure 2:
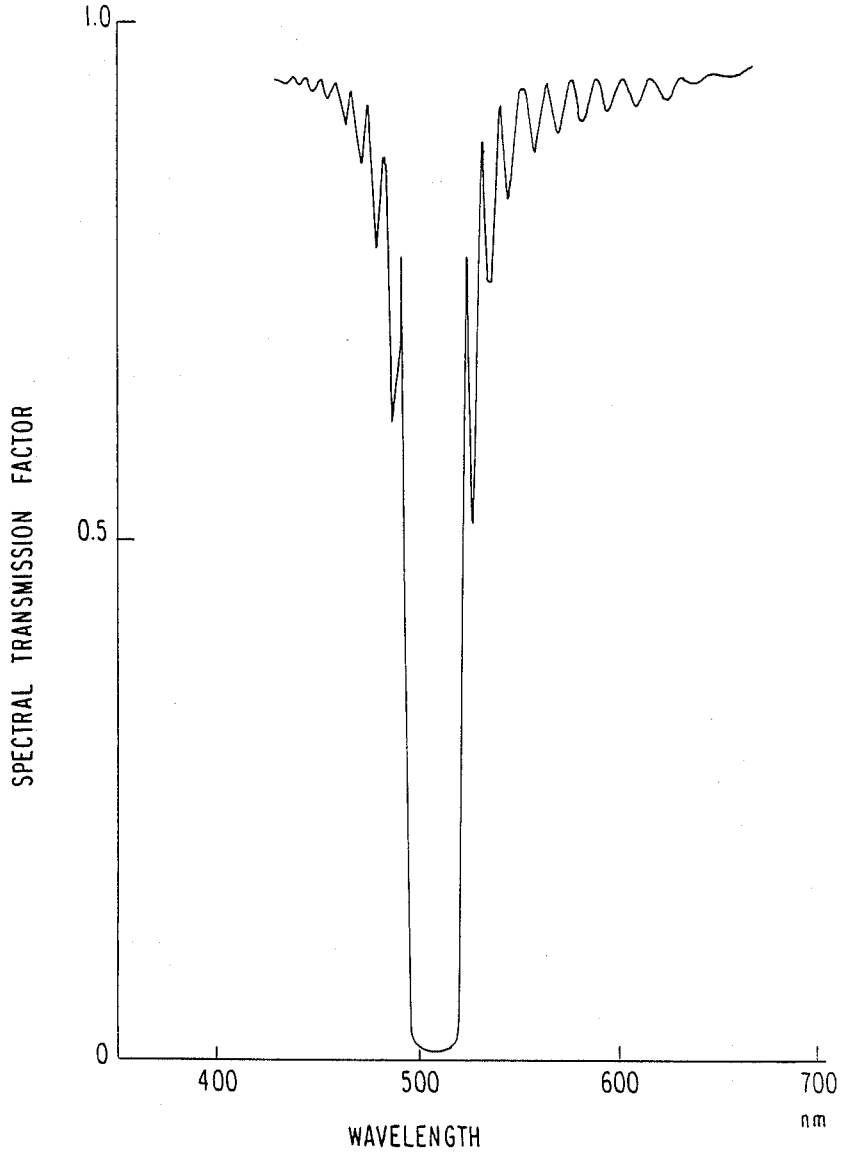

Silicon oxide pellets were put on one of the two evaporation source dishes, and aluminium oxide pellets were on the other dish. The amount of the respective pellets as put on each dish was 20 g. The apparatus was pre-exhausted for 10 minutes with a rotary pump and then exhausted for 20 minutes with an oil diffusion pump. When the vacuum degree in the inside of the apparatus reached $2\times10^{-5}$ Torr, the silicon oxide and aluminium oxide were alternatively evaporated and plated on the glass plate. During the evaporation and plating procedure, the inner temperature in the reactor was kept at about 350° C. with a halogen lamp. The electron bea heating conditions were 5 KV, 30 mA and 6 minutes for silicon oxide and 5 KV, 250 mA and 8 minutes for aluminium oxide. The thickness of the film to be formed was controlled by observation with an optical monitor. The thus prepared filter samples Nos. 1 and 2 had the film thickness as shown in Table 1 below. The characterisftics of the finished interference filters were measured wit Hitachi Spectrophotometer 307 Type, and the spectral transmission curves shown in FIG. 1 and FIG. 2 were obtained.

Figure 5:
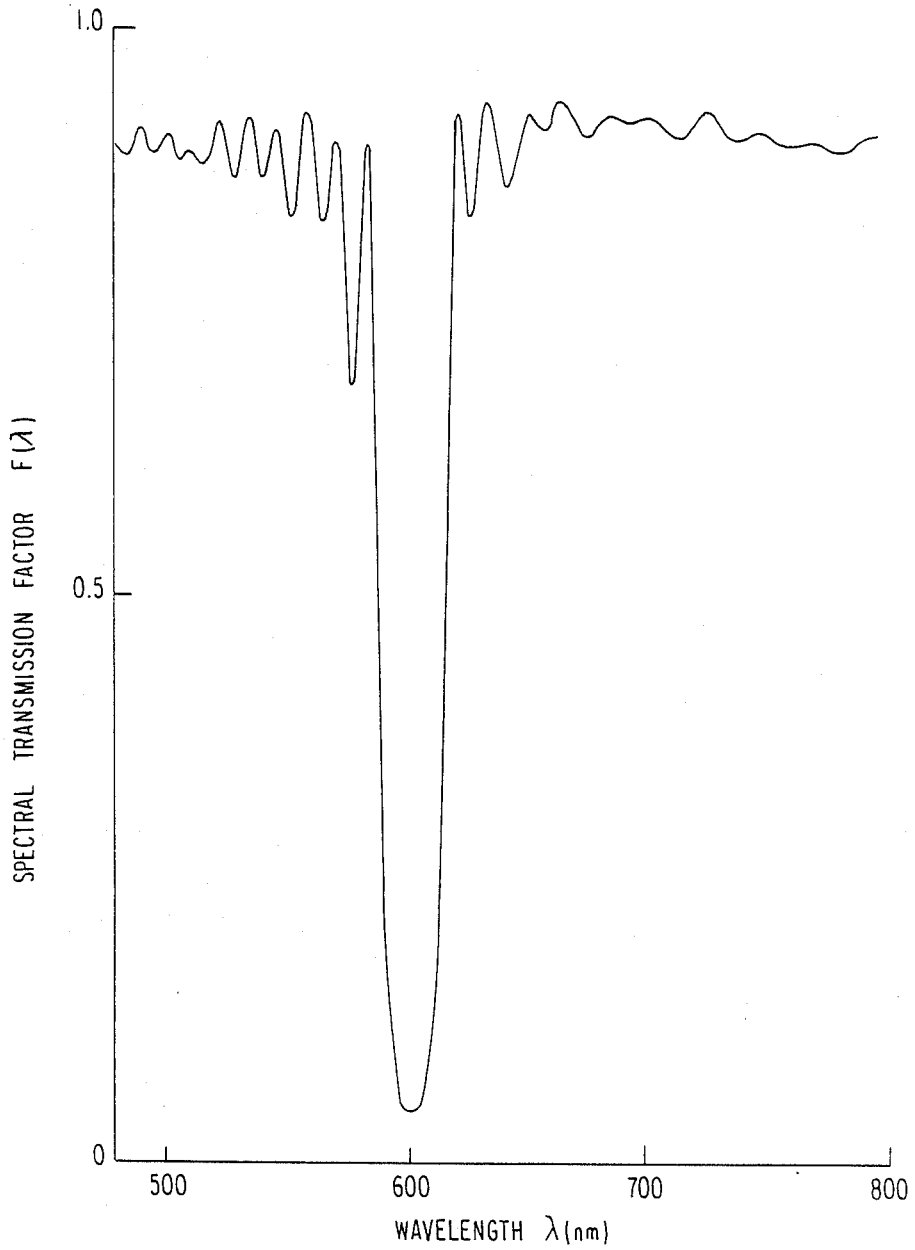

Separately a filter having the structure shown in FIG. 5 of U.S. Pat. No. 2,997,389 was prepared by vacuum evaporation plating. This was called Filter Sample (A).

The surface of each of the Filter Sample (A) and Sample No. 1 was scratched with an optical edge of the same aluminiumdie cast as that constituting the inserting bed of a band stop filter under almost the same pressure. In addition, the surface was rubbed with a dust-having cloth.

TABLE 1

| Filter Sample | Silicon Oxide Layer: Thickness of Layer (μ) | Silicon Oxide Layer: Number of Layers | Aluminium Oxide Layer: Thickness of Layer (μ) | Aluminium Oxide Layer: Number of Layers | Interference Wavelength Zone Half-value Width (nm) | $W_{\frac{1}{4}}W_{\frac{3}{4}}$ | Note |
|---|---|---|---|---|---|---|---|
| 1 | 0.057 | 23 | 0.106 | 23 | 488~522 | 0.67 | FIG.1 |
| | 0.500 | 1 | | | (34) | | |
| 2 | 0.057 | 50 | 0.106 | 50 | 492~518 | 0.80 | FIG.2 |
| | 0.500 | 1 | | | (26) | | |
| 3 | 0.069 | 23 | 0.118 | 23 | 564~612 | 0.62 | FIG.3 |
| | 0.500 | 1 | | | (48) | | |

The scratched scar remained on the surface of the Sample (A), while no scar on the surface of the Sample No. 1. Sample No. 1 was superior to Sample (A) in the point of scratch-resistance.

When the Filter (A) was left exposed to light in air at a high temperature (100° to 200° C.), the ZnS on the surface was greatly oxidized to lower the transmittance and the surface was thereby discolored.

On the other hand, even when the Samples 1 and 2 were left at 150° C. for one week, no variation was seen in the spectral characteristics thereof, and there were no practical problems with respect to scratch-resistance, light-resistance and heat-resistance.

A Macbeth Color Chart, a person and a natural flower were photographed with Fuji Color SUPER HR100 135-size color negative photographic materials under a light source of 5500° K. and the thus-photographed materials were subjected to CN-16 standard color development to obtain color negative films. Next in an Auto Printer FAP 3500 Type (manufactured by Fuji Photo Film Co., Ltd.) the band stop filter was set between the light source of the autoprinter and the negative film, and under these conditions, Fuji Color Super HR Paper was printed through the negative film. For comparison, the same process was repeated without the band stop filter. Next, the thus-printed papers were subjected to CP-20 standard color development to obtain color prints.

The color prints obtained by the use of the band stop filter sample No. 1 or No. 2 of the invention were better than those obtained with out the band stop, especially in the extreme improvement of the faithfulness and saturation in the green to yellow color reproduction.

PREPARATION OF BAND-STOP FILTER ) 2)

Figure 3:
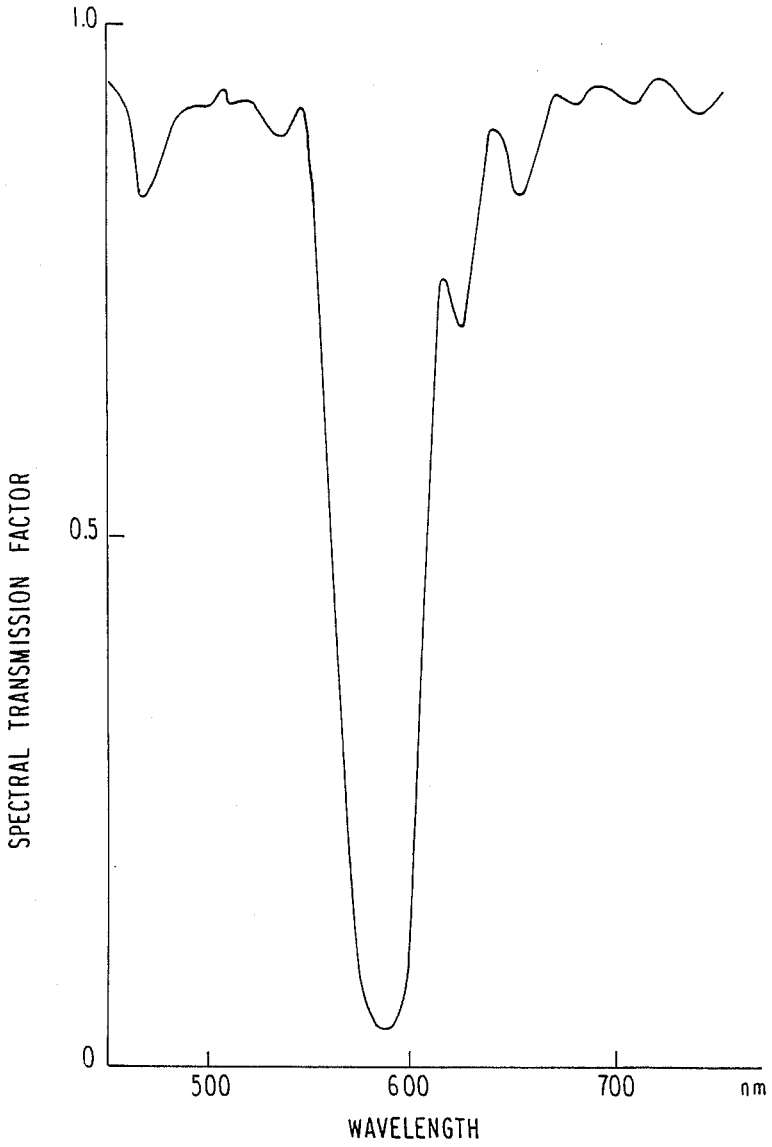

In the same manner as the preparation of the Sample No. 1 in Example 1, except that the thickness of the layer and the number of the constitutional layers were varied as indicated in Table 1 above, Sample No. 3 was prepared. The spectral transmission curve of Sample No. 3 is shown in FIG. 3.

The same objects as used in Example 1 were photographed with Eujichrome 100 D 135 size film (manufactured by Fuji Photo Film Co., Ltd.) and then subjected to CR-56P standard color reversal development to obtain transparent positive films.

Using Auto Printer 8 C 6910 II type (manufactured by Fuji Photo Film Co., Ltd.) where the Filter Sample No. 3 was inserted between the light source and the film original in the position nearer to the light source, Fujicolor RP Print was printed through the transparent positive film. Then the thus-printed material was subsequently subjeced to RP-303 standard color reversal development to obtain a color print. For comparison, the same process was repeated except that the Filter Sample No. 3 was not used, and comparative color prints were obtained.

The color prints obtained by the use of the band stop filter Sample No. 3 of the invention were better than those obtained without the filter in color reproducibility, and in particular, the saturation of the red image was extremely improved in the former over the latter.

Next, using both Sample No. 1 and Sample No. 2, color prints were also prepared in the same manner as above. As a result, both the faithfulness of the green color reproduction and the saturation of the red image were each improved.

The present invention is now described in more detail with reference to the following specific examples, but is not to be construed as being limited thereto. Unless otherwise indicated, all parts, percents and ratios are by weight.

EXAMPLE 1

Preparation of Taking Color Photographic Materials

Layers each having the composition described below were coated on a subbed cellulose triacetate film support to prepare a multilayer color photographic material (Sample No. 101).

Compositions of Light-sensitive Layers

The amount each component is in units of g/m$^2$. The amount of silver halide is the weight (g/m$^2$) of silver coated. The amount of sensitizing dye (EXS-1 to EXS-8) the molar ratio per mol of the silver halide in the same layer.

| | |
|---|---|
| **First Layer: Anti-halation Layer** | |
| Black Collidal Silver | 0.2 |
| Gelatin | 1.4 |
| UV-1 | 0.02 |
| UV-2 | 0.04 |
| UV-3 | 0.04 |
| Solv-1 | 0.05 |
| **Second Layer: Interlayer** | |
| Fine Silver Bromide Grains (mean grain size 0.07μ) | 0.08 |
| Gelatin | 1.1 |
| ExC-1 | 0.02 |
| ExM-1 | 0.06 |
| UV-1 | 0.03 |
| UV-2 | 0.06 |
| UV-3 | 0.07 |
| Cpd-1 | 0.1 |
| ExF-1 | 0.004 |
| Solv-1 | 0.1 |
| Solv-2 | 0.09 |
| **Third Layer: Low-sensitive Red-sensitive Emulsion Layer** | |
| Silver Iodobromide Emulsion (AgI 6.3 mol %, AgI-rich core type, c/s ratio 1/1; sphere-corresponding diameter 0.8 μm, fluctuation coefficient of sphere-corresponding diameter 25%, tabular grains, aspect ratio of diameter/thickness 2) | 1.5 as Ag |
| Gelatin | 1.7 |
| ExC-2 | 0.3 |
| ExC-3 | 0.02 |
| ExS-1 | $7.1 \times 10^{-5}$ |
| ExS-2 | $1.9 \times 10^{-5}$ |
| ExS-3 | $2.4 \times 10^{-4}$ |
| ExS-4 | $4.2 \times 10^{-5}$ |
| Solv-2 | 0.03 |
| **Fourth Layer: Middle-sensitive Red-sensitive Emulsion Layer** | |
| Silver Iodobromide Emulsion (AgI 4.8 mol %, AgI-rich core type, c/s ratio 1/4; sphere-corresponding diameter 0.9μ, fluctuation coefficient of sphere-corresponding diameter 50%, tabular grains, aspect ratio of diameter/thickness 1.5) | 1.4 as Ag |
| Gelatin | 2.1 |
| ExC-2 | 0.4 |
| ExC-3 | 0.002 |
| ExS-1 | $5.2 \times 10^{-5}$ |
| ExS-2 | $1.4 \times 10^{-5}$ |
| ExS-3 | $1.8 \times 10^{-4}$ |
| ExS-4 | $3.1 \times 10^{-5}$ |
| Solv-2 | 0.5 |
| **Fifth Layer: High-sensitive REd-sensitive Emulsion Layer** | |
| Silver Indobromide Emulsion (AgI 10.2 mol %, AgI-rich core type, c/s ratio 1/2, sphere-corresponding diameter 1.2 μm, fluctuation coefficient of sphere-corresponding diameter 35%, tabular grains, aspect ratio of diameter/thickness 3.5) | 2.1 as Ag |
| Gelatin | 2.0 |
| ExC-1 | 0.06 |
| ExC-4 | 0.04 |
| ExC-5 | 0.2 |
| ExS-1 | $6.5 \times 10^{-5}$ |
| ExS-2 | $1.7 \times 10^{-5}$ |

-continued

| | |
|---|---|
| ExS-3 | $2.2 \times 10^{-4}$ |
| ExS-4 | $3.8 \times 10^{-5}$ |
| Solv-1 | 0.1 |
| Solv 2 | 0.3 |
| **Sixth Layer: Interlayer** | |
| Gelatin | 1.1 |
| **Seventh Layer: Low-sensitive Green-sensitive Emulsion** | |
| Layer Silver Indobromide Emulsion (AgI 6.3 mol %, AgI-rich core type, c/s ratio 1/1, sphere-corresponding diameter 0.8μ, fluctuation coefficient of sphere-corresponding diameter 25%, tabular grains, aspect ratio of diameter/thickness 2) | 0.6 as Ag |
| Gelatin | 0.8 |
| ExM-2 | 0.3 |
| ExM-1 | 0.03 |
| ExY-1 | 0.03 |
| ExS-5 | $3.1 \times 10^{-5}$ |
| ExS-6 | $1.0 \times 10^{-4}$ |
| ExS-7 | $3.8 \times 10^{-4}$ |
| H-1 (2,4-dichloro-6-oxy-S—triazine Sodium Salt) | 0.04 |
| H-2 | 0.01 |
| Solv-2 | 0.2 |
| **Eighth Layer: Middle-sensitive Green-sensitive Emulsion** | |
| Layer Silver Iodobromide Emulsion (AgI 4,8 mol, %, AgI-rich core type, c/s ratio 1/4 sphere-corresponding diameter 0.9μ, 50%, tabular grains, aspect ratio of diameter/thickness 1.5) | 1.1 as Ag |
| Gelatin | 1.4 |
| ExM-4 | 0.02 |
| ExM-5 | 0.05 |
| ExM-1 | 0.01 |
| ExM-3 | 0.01 |
| ExY-1 | 0.02 |
| ExS-5 | $2.0 \times 10^{-5}$ |
| ExS-6 | $7.0 \times 10^{-5}$ |
| ExS-7 | $2.6 \times 10^{-4}$ |
| H-1 | 0.07 |
| H-2 | 0.02 |
| Solv-1 | 0.06 |
| Solv-2 | 0.4 |
| **Ninth Layer: High-sensitive Green-sensitive Emulsion Layer** | |
| Silver Iodobromide Emulsion (AgI 10.2 mol %, AgI-rich core type, c/s ratio 1/2, sphere-corresponding diameter 1.2μ, fluctuation coefficient of sphere-corresponding diameter 38%, tabular grains, aspect ratio of diameter/thickness 4) | 2.1 as Ag |
| Gelatin | 2.2 |
| ExC-2 | 0.02 |
| ExM-5 | 0.1 |
| ExM-1 | 0.05 |
| ExS-5 | $3.5 \times 10^{-5}$ |
| ExS-6 | $8.0 \times 10^{-5}$ |
| ExS-7 | $3.0 \times 10^{-4}$ |
| Solv-1 | 0.08 |
| Solv-2 | 0.7 |
| **Tenth Layer: Interlayer** | |
| Gelatin | 1.1 |

-continued

| | |
|---|---|
| **Eleventh Layer: Yellow Filter Layer** | |
| Yellow Collodal Silver | 0.08 |
| Gelatin | 1.0 |
| ExF-2 | 0.1 |
| Cpd-1 | 0.1 |
| Solv-2 | 0.08 |
| **Twelfth Layer: Low-sensitive Blue-sensitive Emulsion** | |
| Layer Silver Iodobromide Emulsion (AgI 9.0 mol %, AgI-rich core type, c/s ratio 1/2, sphere-corresponding diameter 0.75μ, fluctuation coefficient of sphere-corresponding diameter 21%, octahedral grains, aspect ratio of diameter/thickness 1) | 0.3 as Ag |
| Gelatin | 1.3 |
| ExY-2 | 0.7 |
| ExY-1 | 0.02 |
| H-1 | 0.03 |
| H-2 | 0.01 |
| Solv-2 | 0.3 |
| **Thirteenth Layer: Middle-sensitive Blue-sensitive** | |
| Emulsion Layer Silver Iodobromide Emulsion (AgI 10.2 mol %, AgI-rich core type, c/s ratio 1/2, sphere-corresponding diameter 1.0μ, fluctuation coefficient of sphere-corresponding diameter 30%, tabular grains, aspect ratio of diameter/thickness 3.5) | 0.4 as Ag |
| Gelatin | 0.7 |
| ExY-2 | 0.1 |
| ExS-8 | $2.2 \times 10^{-4}$ |
| H-1 | 0.01 |
| H-2 | 0.005 |
| Solv-2 | 0.05 |
| **Fourteenth Layer: High-sensitive Blue-sensitive** | |
| Emulsion Layer Silver Iodobromide Emulsion (AgI 9.8 mol %, AgI-rich core type, c/s ratio 1/2, sphere-corresponding diameter 1.8μ, fluctuation coefficient of sphere-corresponding diameter 55%, tabular grains, aspect ratio of diameter/thickness 4.5) | 0.8 as Ag |
| Gelatin | 0.7 |
| ExY-2 | 0.2 |
| ExS-8 | $2.3 \times 10^{-4}$ |
| Solv-2 | 0.07 |
| **Fifteenth Layer: First Protective Layer** | |
| Gelatin | 0.9 |
| UV-4 | 0.1 |
| UV-5 | 0.2 |
| H-1 | 0.02 |
| H-2 | 0.005 |
| Solv-3 | 0.03 |
| Cpd-2 | 0.7 |
| **Sixteenth Layer: Second Protective Layer** | |
| Fine Silver Bromide Grain Emulsion (mean grain size 0.07μ) | 0.1 |
| Gelatin | 0.7 |
| H-1 | 0.2 |
| H-2 | 0.05 |

The compounds used in the above layers were as follows:

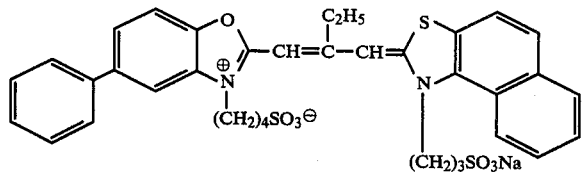

ExS-1

-continued
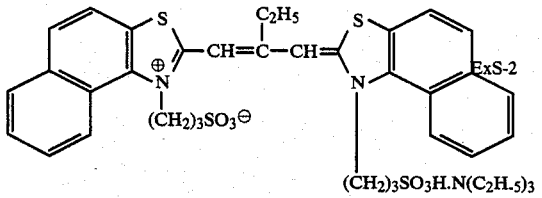
ExS-2
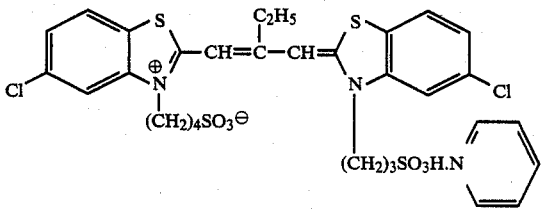
ExS-3
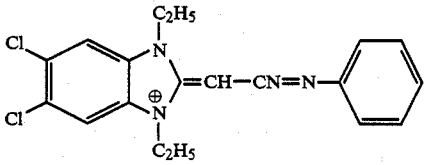
ExS-4
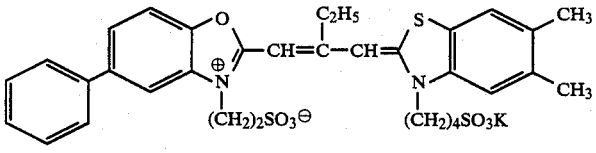
ExS-5
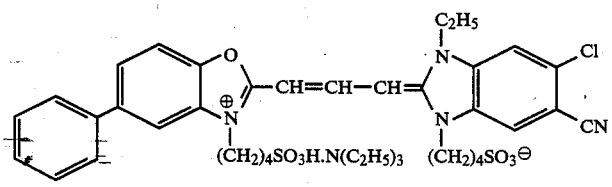
ExS-6
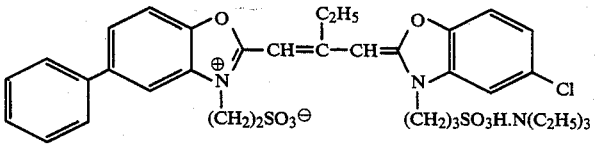
ExS-7
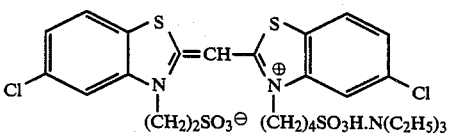
ExS-8
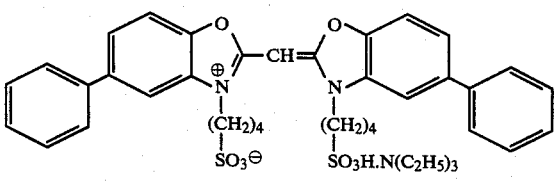
ExS-9
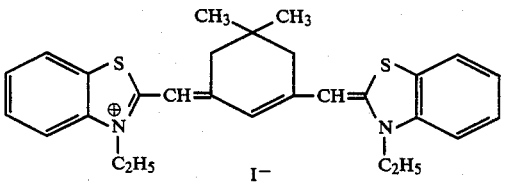
ExS-10

-continued
ExC-1
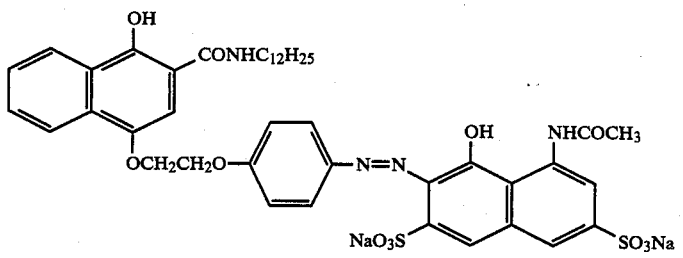
ExC-2
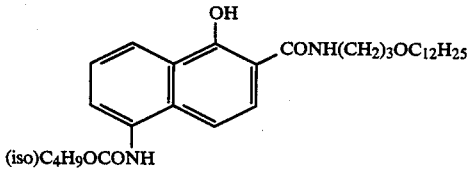
(mixture of (1) and (2))
ExX-3
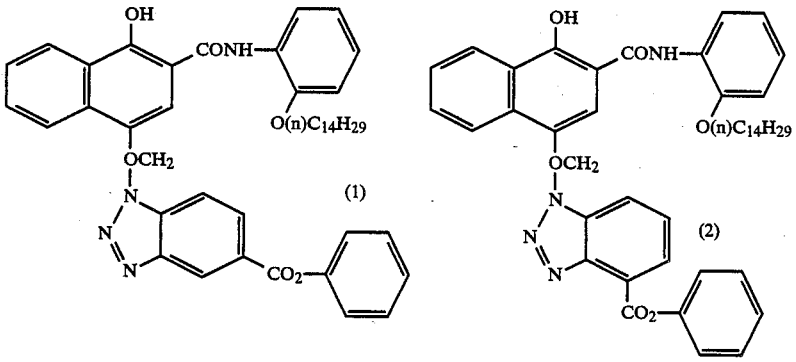
ExC-4
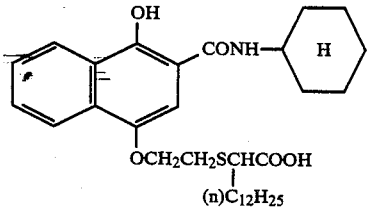
ExC-5
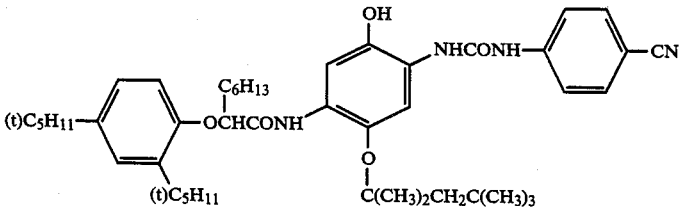
ExM-1
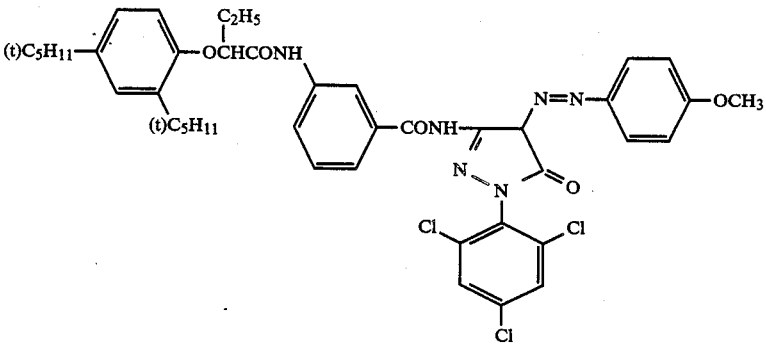

-continued
ExM-2
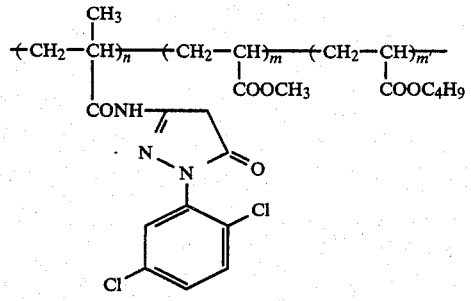
n/m + m' = 1
m/m' = 1
Molecular Weight: about 40,000
ExM-3
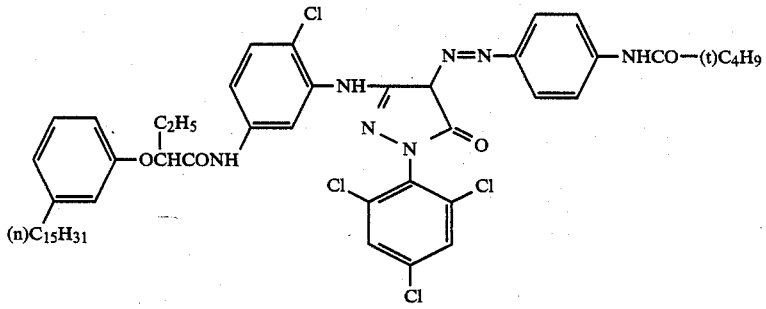
ExM-4
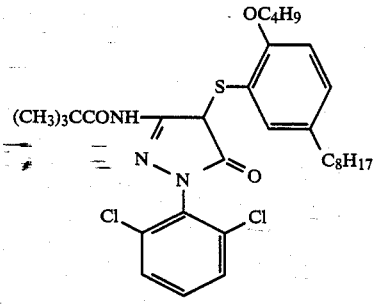
ExM-5
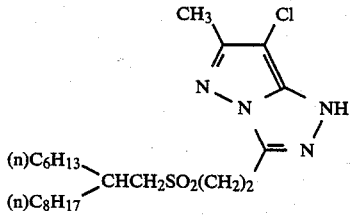
(Mixture of (1) and (2))
ExY-1
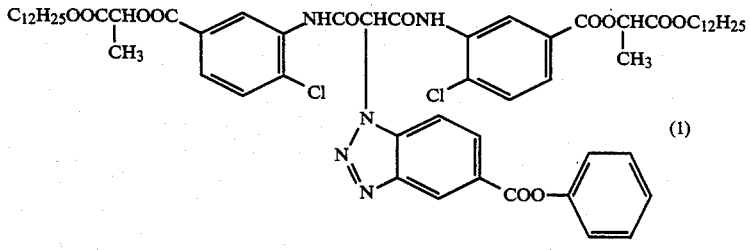
(1)

-continued
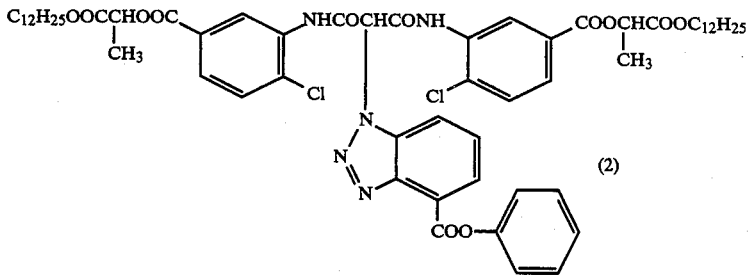
(2)
ExY-2
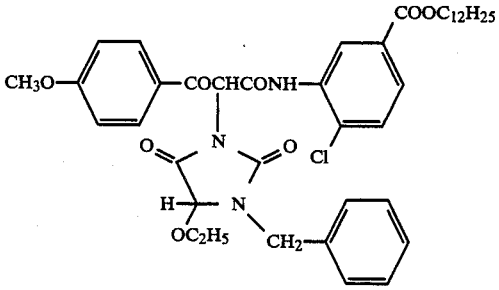
UV-1
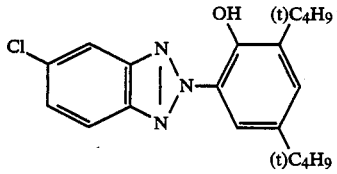
UV-2
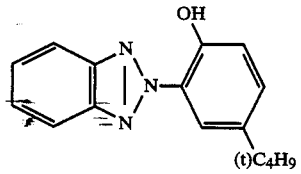
UV-3
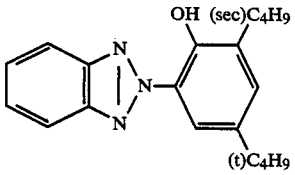
UV-4
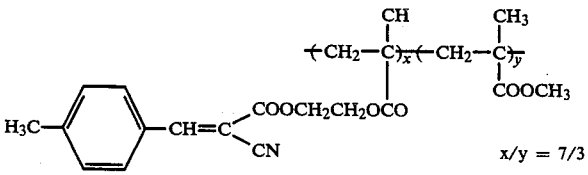
x/y = 7/3 (wt.)
UV-5
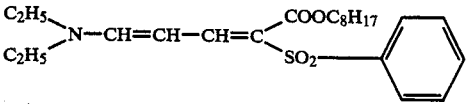
H-2
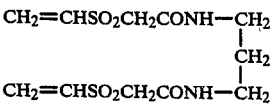

-continued

ExF-1

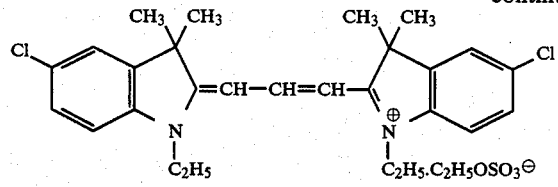

ExF-2

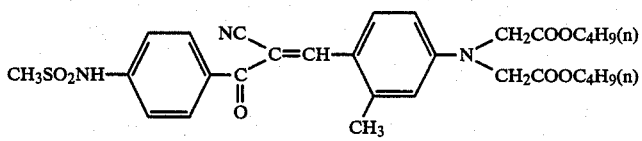

(Yellow dye described in JP-A-61-205934)

Solv-1

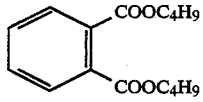

Solv-2

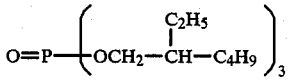

Solv-3

$O{=}P{\leftarrow}O{-}C_9H_{19}(iso))_3$

Cpd-1

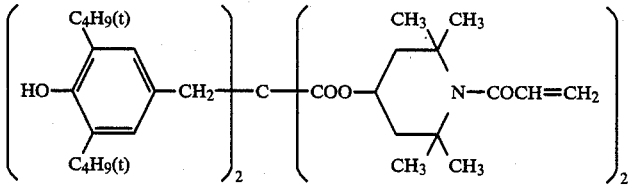

Cpd-2

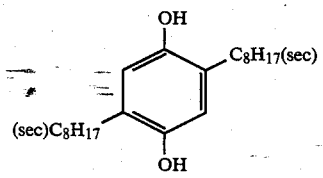

Next, Samples Nos. 102 to 109 were prepared in the same manner as above, using a comparative color mixing preventing agent or the compound of the invention in the sixth layer (interlayer) or the tenth layer (interlayer) as indicated in Table 2-1 below.

TABLE 2-1

| Sample No. | 6th Layer (Interlayer) | | 10th Layer (Interlayer) | |
|---|---|---|---|---|
| 101 (comparison) | — | | — | |
| 102 (") | Cpd-2 | 0.20 | Cpd-2 | 0.15 |
| | Solv-2 | 0.10 | Solv-2 | 0.08 |
| 103 (the invention) | | | | |
| | I-(3) | 0.20* | I-(3) | 0.15 |
| | Solv-2 | 0.10 | Solv-2 | 0.08 |
| 104 (") | I-(7) | 0.20 | II-(7) | 0.15 |
| | Solv-2 | 0.10 | Solv-2 | 0.08 |
| 105 (") | I-(12) | 0.20 | I-(12) | 0.15 |
| | Solv-2 | 0.10 | Solv-2 | 0.10 |
| 106 (") | I-(14) | 0.20 | I-(14) | 0.15 |
| | Solv-2 | 0.10 | Solv-2 | 0.10 |
| 107 (") | I-(16) | 0.20 | I-(16) | 0.15 |
| | Solv-2 | 0.10 | Solv-2 | 0.10 |
| 108 (") | I-(3) | 0.20 | — | — |
| | Solv-2 | 0.10 | — | — |
| 109 (") | — | — | I-(3) | 0.15 |

TABLE 2-1-continued

| Sample No. | 6th Layer (Interlayer) | | 10th Layer (Interlayer) | |
|---|---|---|---|---|
| | — | — | Solv-2 | 0.10 |

*Although Compound I-(3) has about 1.8 times molecular weight of the molecular weight of Cpd-2, the same amount was used to definitely show the effect of the invention.

In order to compare the degree of the interlayer color mixing generated during the step of development procedure, ΔG and ΔR were determined as mentioned below.

The samples were wedgewise exposed to a blue light through a blue filter (BPN-42, manufactured by Fuji Film) and then developed in accordance with the color development procedure mentioned below to obtain sample strips. The density of each of the thus processed samples was measured, and the density difference between the magenta color density at the point having an yellow density of 1.5 and the base density was obtained. This was ΔG.

The samples also were wedgewise exposed through a green filter (BPN-53, manufactured by Fuji Film) and then developed in the same manner as above to obtain sample strips. The density difference between the cyan color density at the point having a magenta color density of 1.5 and the base density was obtained. This was ΔR. The yellow color density and the cyan color density referred to herein each means the density obtained by subtracting the base density from the respective color density values. The results obtained are shown in Table 2-2 below.

TABLE 2-2

| Sample No. | Compound used in 6th or 10th Layer | Degree of Interlayer Color Mixing ΔG | ΔR |
|---|---|---|---|
| 101 (comparison) | — | 0.15 | 0.13 |
| 102 (") | Cpd-2 | 0.10 | 0.07 |
| 103 (the invention) | I-(3) | 0.06 | 0.03 |
| 104 (") | I-(7) | 0.07 | 0.03 |
| 105 (") | I-(12) | 0.06 | 0.03 |
| 106 (") | I-(14) | 0.05 | 0.04 |
| 107 (") | I-(16) | 0.06 | 0.04 |
| 108 (") | I-(3) | 0.09 | 0.04 |
| 109 (") | I-(3) | 0.06 | 0.06 |

From the results in Table 2-2 above, it is seen that the addition of the compound of the present invention to the photographic material samples was effective for reducing the degree of the interlayer color mixing in the materials.

Color Development (A) for Taking Color Photographic Materials

The photographic process included the following steps.

| Step | Processing time | Processing Temperature |
|---|---|---|
| Color Develpment | 3 min 15 sec | 38° C. |
| Bleaching | 1 min 00 sec | 38° C. |
| Bleach-fixation | 3 min 15 sec | 38° C. |
| Rinsing (1) | 40 sec | 35° C. |
| Rinsing (2) | 1 min 00 sec | 35° C. |
| Stabilization | 40 sec | 38° C. |
| Drying | 1 min 15 sec | 55° C. |

The compositions of the processing solutions used were as follows.

| Color Developer: | |
|---|---|
| Diethylenetriamine-pentaacetic Acid | 1.0 (unit: g) |
| 1-Hydroxyethylidene-1, 1-diphosphonic Acid | 3.0 |
| Sodium Sulfite | 4.0 |
| Potassium Carbonate | 30.0 |
| | 5.0 |
| Sodium Sulfite | 12.0 |
| Ammonium Thiosulfate (70 wt. % Aqueous Solution) | 240.0 (ml) |
| Aqueous Ammonia (27 wt. %) | 6.0 (ml) |
| Water to make | 1.0 (liter) |
| pH | 7.2 |

Rinsing Solution

City water was passed through a mixed bed type column filled an H-type strong acidic cation exchange resin (Rohms & Haas, Amberlite IR-102B) and an OH-type anion exchange resin (Rohm & Haas, Amberlite IR-400) so that both the calcium ion concentration and the magnesium ion concentration were reduced to 3 mg/liter or less, and then sodium dichloroisocyanurate (20 mg/liter) and sodium sulfate (150 mg/liter) were added thereto. the solution had a pH value between 6.5 and 7.5.

| Stabilizing Solution: | (unit: g) |
|---|---|
| Formalin | 2.0 (ml) |
| Polyoxyethylene-p-monononylphenylether (mean polymerization degree 10) | 0.3 |
| Ethylenediamine-tetraacetic Acid Disodium Salt | 0.05 |
| Water to make | 1.0 liter |
| pH | 5.0 to 8.0 |

Preparation of Printing Multilayer Color Photographic Materials

Layers each having the composition described below were formed on a paper support both surfaces of which were coated with polyethylene, to prepare a printing multilayer color photographic paper sample (Sample No. 201). The respective coating compositions were prepared as described below.

Preparation of Coating Composition for First Layer 27.2 cc of ethyl acetate and 7.7 cc of solvent (Solv-1) were added to 19.1 g of yellow coupler (ExY-3) and 4.4 g of color image stabilizer (Cpd-1) and dissolved, and the resulting solution was dispersed by emulsification in 185 cc of an aqueous 10% gelatin solution containing 8 cc of 10% sodium dodecylbenzenesulfonate. The following blue-sensitive sensitizing dye was added to a silver chlorobromide emulsion (silver bromide 80.0 mol%, Ag-content 70 g/kg) in an amount of $5.0\times10^{-4}$ mol per mol of silver. The emulsion was blended with the previously prepared emulsified dispersion and dissolved. Thus a coating composition for the first layer was prepared, containing the components mentioned below. Other coating composition for second to seventh layers were also prepared in the same manner as the composition for the first layer. As a gelatin hardening agent for each layer, 2,4-dichloro-6-oxy-s-triazine sodium salt was used in an amount of 1.2% by weight based on gelatin.

The following spectral sensitizing dyes were used for the respective layers.

Blue-sensitive Emulsion Layer:

ExS-8 described above
($5.0\times10^{-4}$ mol per mol of silver halide)

Green-sensitive Emulsion Layer:

ExS-7 mentioned above,
($4.0\times10^{-4}$ mol per mol of silver halide) and

ExS-9:

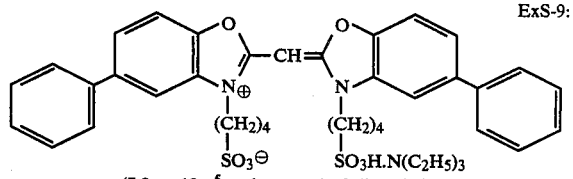

($7.0\times10^{-5}$ mol per mol of silver halide)

Red-sensitive Emulsion Layer:

ExS-10:

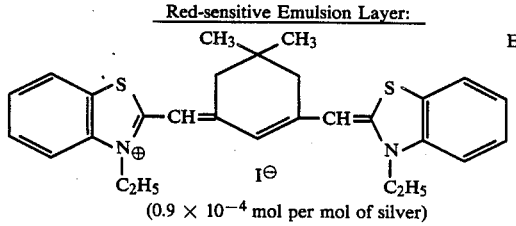

($0.9\times10^{-4}$ mol per mol of silver)

The following compound was added to the red-sensitive emulsion layer in an amount of $2.6\times10^{-3}$ mol per mol of silver halide.

ExS-11:

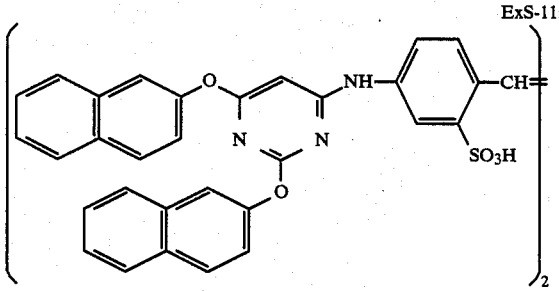

1-(5-Methylureidophenyl)-5-mercaptotetrazole was added to the blue-sensitive emulsion layer, green-sensitive emulsion layer and red-sensitive emulsion layer each in an amount of $4.0\times10^{-6}$ mol, $3.0\times10^{-5}$ mol and $1.0\times10^{-5}$ mol, respectively, per mol of silver halide.

4-Hydroxy-6-methyl-1, 3, 3a, 7-tetrazaindene was added to the blue-sensitive emulsion layer and green-sensitive emulsion layer each in an amount of $1.2\times10^{-2}$ mol and $1.1\times10^{-2}$ mol, respectively, per mol of silver halide.

The following dyes were added to the emulsion layers for the purpose of anti-irradiation.

ExF-3:

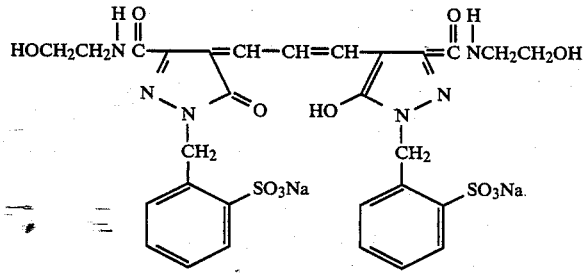

and

ExF-4:

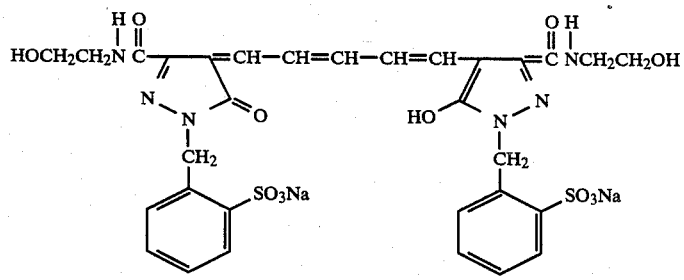

Constitution of Layers

The compositions of the respective layers are shown below. The amounts of the components coated are in units of g/m². The amount of the silver halide coated is in units of g/m² as silver.

Support

Polyethylene Laminate Paper, containing white pigment ($TiO_2$) and bluish dye (ultramarine) in polyethylene on the side of the first layer.

| | |
|---|---|
| First Layer: Blue-sensitive Layer | |
| Silver halide Emulsion (Br: 80%) | 0.26 |
| Gelatin | 1.83 |
| Yellow Coupler (ExY-3) | 0.83 |
| Color Image Stabilizer (Cpd-1) | 0.19 |
| Solvent (Solv-1) | 0.35 |
| Second Layer: Color Mixing Preventing Layer | |
| Gelatin | 0.99 |
| Color Mixing Preventing Agent (Cpd-2) | 0.08 |
| Third Layer: Green-sensitive Layer | |
| Silver halide Emulsion (Br: 80%) | 0.16 |
| Gelatin | 1.79 |
| Magenta Coupler (ExM-5) | 0.32 |
| Color Image Stabilizer (Cpd-3) | 0.20 |
| Color Image Stabilizer (Cpd-4) | 0.01 |
| Solvent (Solv-2) | 0.65 |
| Color Image Stabilizer (Cpd-8) | 0.06 |
| Color Image Stabilizer (Cpd-9) | 0.06 |
| Dye (ExF-3) | 0.10 |
| Fourth Layer: Ultraviolet Absorbing Layer | |
| Gelatin | 1.58 |
| Ultraviolet Absorbent (UV-1) | 0.62 |
| Color Mixing Preventing Agent (Cpd-5) | 0.05 |
| Solvent (Solv-3) | 0.24 |
| Fifth Layer: Red-sensitive Layer | |
| Silver halide Emulsion (Br: 70%) | 0.23 |
| Gelatin | 1.34 |
| Cyan Coupler (ExC-6) | 0.34 |
| Color Image Stabilizer (Cpd-6) | 0.17 |
| Polymer (Cpd-7) | 0.40 |
| Solvent (Solv-4) | 0.23 |
| Dye (ExF-4) | 0.12 |
| Sixth Layer: Ultraviolet Absorbing Layer | |
| Gelatin | 0.53 |
| Ultraviolet Absorbent (UV-1) | 0.21 |
| Solvent (Solv-3) | 0.08 |
| Seventh Layer: Protective Layer | |
| Gelatin | 1.33 |
| Acryl-modified Copolymer of Polyvinyl Alcohol (modification degree 17%) | 0.17 |
| Liquid Paraffine | 0.03 |

The compounds used in the layers were as follows.

Color Image Stabilizer (Cpd-3):

-continued
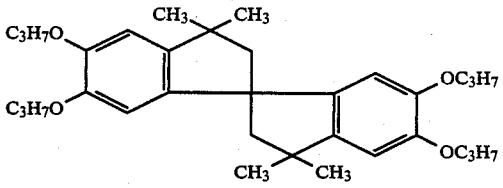
ExY-3:
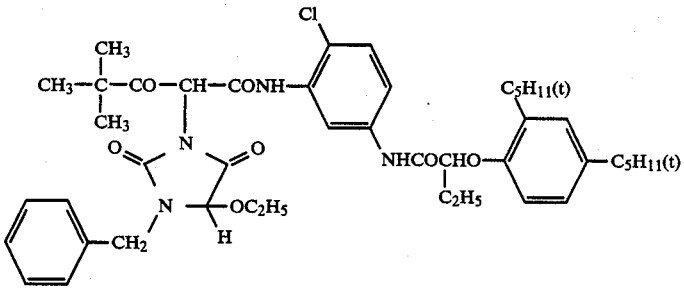
Magenta Coupler (ExM-5):
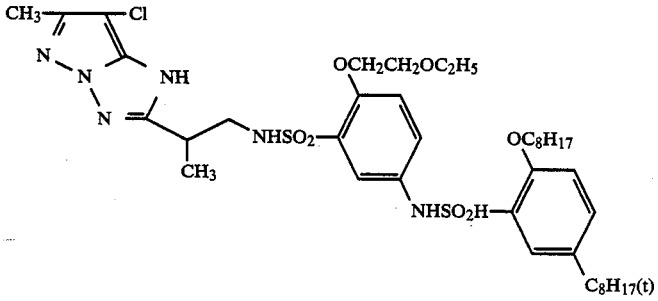
Cyan Coupler (EXC-6):
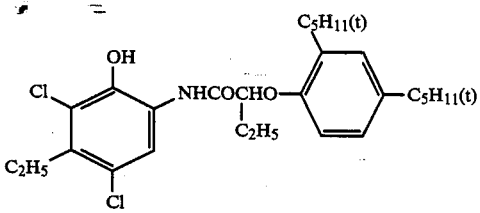
Color Image Stabilizer (Cpd-4):
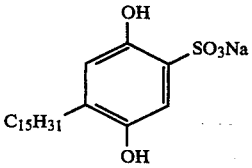
Color Mixing Preventing Agent (Cpd-5):
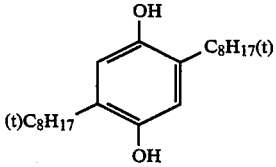
Color Image Stabilizer (Cpd-6):
Mixture (5/8/9, by weight) of the following compounds.

-continued
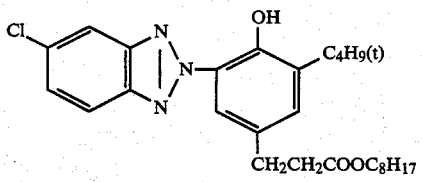
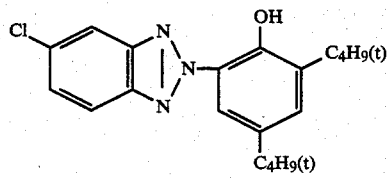
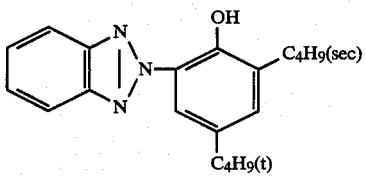
Polymer (Cpd-7)
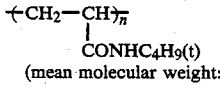
(mean molecular weight: 80,000)
Ultraviolet Absorbent (UV-1):
Mixture (2/9/8, by weight) of the following compounds.
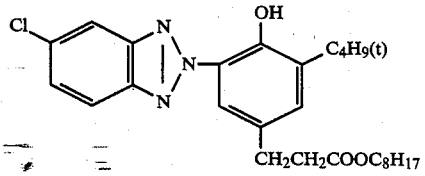
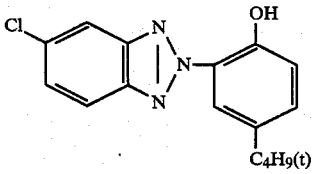
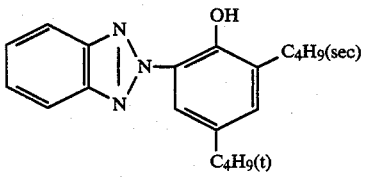
Solvent (Solv-1):
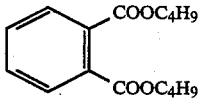
Solvent (Solv-2):
Mixture (2/1, by volume) of the following compounds.
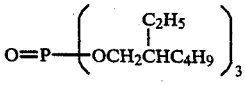

-continued

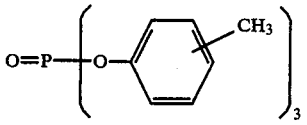

(Mixture of derivatives of o-, m-, and p-cresol)

Solvent (Solv-3):

$O{=}P{+}O{-}C_9H_{19}(iso))_3$

Solvent (Solv-4):

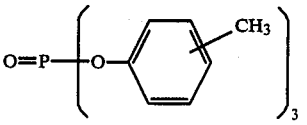

(Mixture of derivatives of o-, m- and p-cresol)

(Cpd-8):

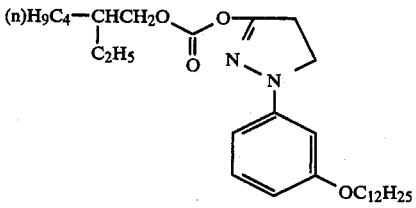

(Cpd-9):

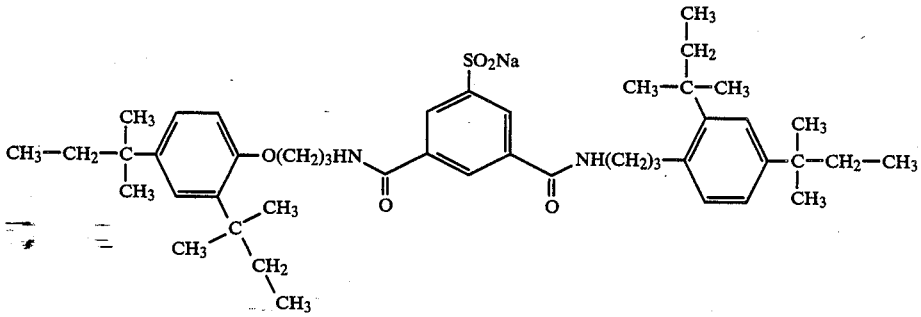

Sample No. 202 was prepared in the same manner as Sample NO. 201, except that the silver halide emulsion (Br=80 mol%) in the first layer in Sample No. 201 was replaced by the following silver halide emulsion (A) (Br=0.5 mol%) and the following silver halide emulsion (B) ((Br=1.0 mol%) was used in the third layer. The preparation of these emulsions (A) and (B) are described in Japanese Patent Application Nos. 62-86163 (corresponding to EP-A-273429) and 62-86164 (corresponding to EP-A-273430).

Preparation of Emulsion (A)

| Formation of Silver Chloride Host Grains: | |
|---|---|
| (Solution-1) | |
| $H_2O$ | 1000 cc |
| NaCl | 5.5 g |
| Gelatin | 32 g |
| (Solution-2) | |
| Sulfuric Acid (1N) | 24 cc |
| (Solution-3) | |
| The following Compound (A) (1%) | 3 cc |
| (Solution-4) | |
| NaCl | 1.7 g |
| $H_2O$ to make | 200 cc |
| (Solution-5) | |

-continued

| Formation of Silver Chloride Host Grains: | |
|---|---|
| $AgNO_3$ | 5 g |
| 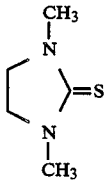 | |
| $H_2O$ to make | 200 cc |
| (Solution-6) | |
| NaCl | 41.3 g |
| $K_2IrCl_6$ (0.001%) | 0.5 cc |
| $H_2O$ to make | 600 cc |
| (Solution-7) | |
| $AgNO_3$ | 120 g |
| $H_2O$ to make | 600 cc |

(Solution-1) was heated to 76° C. and (Solution-2) and (Solution-3) were added thereto. Next, (Solution-4) and (Solution-5) were simultaneously added thereto over a period of 10 minutes.

After 10 minutes, (Solution-6) and (Solution-7) were simultaneously added thereto over a period of 35 minutes. 5 minutes after the addition, the temperature of the reaction system was lowered for desalting. Water and dispersing gelatin were added to the reaction mixture, which was then adjusted to have pH of 6.3. Thus a monodispersed cubic silver chloride emulsion having a mean grain size of 1.1 μm and a fluctuation coefficient (value of standard deviation divided by mean grain size (diameter): s/d) of 0.10 was obtained.

One half (½) of the thus prepared emulsion was separated, and 12.6 cc of a 0.6% solution of a spectral sensitizing dye for blue light (the following CR-1) was added thereto as a halogen-conversion inhibiting compound, and a 0.05 μm ultrafine AgBr gain emulsion was further added thereto a in a proportion of 0.5 mol% to the host AgCl emulsion. Then the resulting emulsion was blended and ripened for 10 minutes at 58° C. Next, sodium thiosulfate was added to the thus ripened emulsion for optinum chemical sensitization, and then $10^{-4}$ mol/mol-Ag of the following Stabilizer (B) was added thereto. This was called Emulsion (A).

Compound CR-1:

Stabilizer (B):

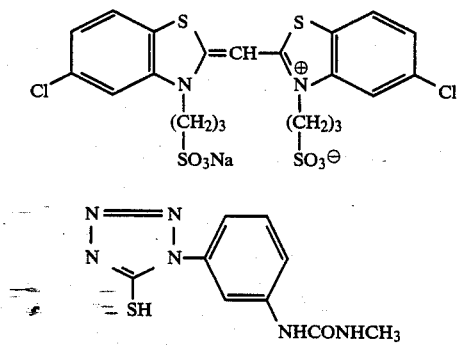

Preparation of Silver Halide Emulsion (B):

| | |
|---|---|
| (Solution-8) | |
| $H_2O$ | 1000 cc |
| NaCl | 3.3 g |
| Gelatin | 32 g |
| (Solution-9) | |
| Sulfuric Acid (1N) | 24 cc |
| (Solution-10) | |
| Compound (A) mentioned above (1%) | 3 cc |
| (Solution-11) | |
| NaCl | 11.00 g |
| $H_2O$ to make | 200 cc |
| (Solution-12) | |
| $AgNO_3$ | 32.00 g |
| $H_2O$ to make | 200 cc |
| (Solution-13) | |
| NaCl | 44.00 g |
| $K_2IrCl_6$ (0.001%) | 2.3 cc |
| $H_2O$ to make | 560 cc |
| $AgNO_3$ | 128 g |
| (Solution-14) | |
| $H_2O$ to make | 560 cc |

(Solution-8) was heated to 52° C. and (Solution-9) and )Solution-10) were added thereto. Next, (Solution-11) and (Solution-12) were simultaneously added thereto over a pperiod of 14 minutes. After 10 minutes, (Solution-13) and (Solution-14) were simultaneously added thereto over a period of 15 minutes. 5 minutes after the addition, the temperature of the reaction system was lowered for desalting.

Water and dispersing gelatin were added to the reaction mixture, which was then adjusted to have pH of 6.2. Thus a monodisperse cubic silver chloride emulsion having a mean grain size (diameter): s/d) of 10 was obtained. The following Compound CR-2 ($4.0\times10^{-4}$ mol per mol of silver halide) was added to the emulsion, and an ultrafine silver bromide grain emulsion (grainsize 0.05 μm) further added thereto in a proportion of 1 mol% (silver bromide) to silver chloride emulsion. Then the resulting emulsion was ripened for 10 minutes at 58° C.

Compound CR-2:

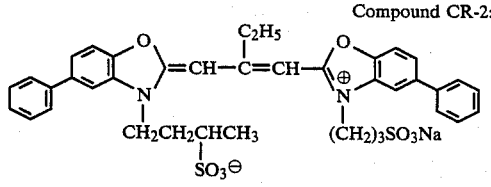

Next, sodium thiosulfate was added to the resulting emulsion at 58° C. for optimum chemical sensitization, and the above-mentioned CR-2 was further added thereto in an amount of $4\times10^{-4}$ mol per mol of silver halide for spectral sensitization. The compound (B) which was same as that used in preparation of Emulsion (A) was added to the thus sensitized emulsion as a stabilizer, in an amount of $5\times10^{-4}$ mol per mol of silver halide.

Color Development Process (B):

| Step | Temperature | Time |
|---|---|---|
| Color Development | 38° C. | (1 min 40 sec) |
| Bleaching-fixation | 33° C. | 40 sec |
| Rinsing (1) | 30 to 34° C. | 15 sec |
| Rinsing (2) | 30 to 34° C. | 15 sec |
| Rinsing (3) | 30 to 34° C. | 15 sec |
| Drying | 70 to 80° C. | 50 sec |

(The parenthesized time means a standard time. Rinsing was effected by three-tank countercurrent system from the rinsing tank (3) to the rinsing tank (1).)

The processing solutions used in the respective steps had the following compositions.

| | |
|---|---|
| Color Developer: | |
| Water | 800 ml |
| Diethylenetramine-pentaacetic Acid | 1.0 g |
| Nitrilotriacetic Acid | 2.0 g |
| 1-Hydroxyethylidene-1,1-diphosphonic Acid | 2.0 g |
| Potassium Bromide | 0.5 g |
| Potassium Carbonate | 30 g |
| N—ethyl-N—(β-methanesulfonamidoethyl)-3-methyl-4-aminoaniline Sulfate | 5.5 g |
| N,N—diethylhydroxylamine | 3.6 g |
| Brightening Agent (WHITEX 4B, manufactured by Sumitomo Chemical Co.) | 1.5 g |
| Triethylenediamine(1,4-diazabicyclo-[2,2,2] octane | 5.0 g |
| Water to make | 1000 ml |
| pH (25° C.) | 10.20 |
| Bleach-fixing Solution: | |
| Water | 400 ml |
| Ammonium Thiosulfate (70 wt %) | 200 ml |
| Sodium Sulfite | 20 g |
| Ethylenediamine-tetraacetic Acid Iron (III) Ammonium Complex | 60 g |
| Ethylenediamine-tetraacetic Acid Disodium Salt | 5 g |
| Water to make | 1000 ml |

-continued

| | |
|---|---|
| pH (25° C.) | 5.5 |

Rinsing Solution

Ion-exchanged Water (calcium, magnasium: each 3 ppm or less).

The effect of improving the color reproducibility of the photographic material by the present invention may be confirmed by the decrease of the color mixing degree measured by the use of a Macbeth Color Chart disclosed in Japanese patent Application No. 62-150320.

The printing color photographic material of the present invention includes color printing photographic papers, e.g., direct positive color photographic papers and reversal color photographic papers. The main function of the printing oclor photographic materail is to receive the image information composed of the three primary colors on a color print original by the spectral sensitivity of the respective blue-sensitive layer, green-sensitive layer and red-sensitive layer of the said material in accordance with the spectral transmittance of the yellow, magenta and cyan dyes, thereby to independently and faithfully reproduce the colors from the original onto the photographic material.

In general, a Macbeth Chart composed of 18 chromatic colors and 6 non-chromatic colors can be used for evaluation of color-reproducibility of photographic materials, as described, for instance, by C. S. B. MaCamy et al, *J. Appln. Phot. Eng.*, Vol. 2, pages 95 to 99 (1976), as follows.

In general, among the blue-sensitive layer, green-sensitive layer and red-sensitive layer constituting printing color photographic materials, the green-sensitive layer has the highest probability of worsening the color reproducibility of the material. Accordingly, the green-sensitive layer of printing color photographic materails is specifically considered in detail. In a color negative obtained by photographing Color Chart (i), the exposure to be applied to the green-sensitive layer may be represented by the following formula with respect to the Color Chart (i);

$$Ei = \int_{485}^{570} S(\lambda) \cdot Ti(\lambda) \cdot P(\lambda) d\lambda \quad (1)$$

$(i = 1 \text{ to } 24)$ in which Ti(λ) means a spectral transmission distribution of the dye; S(λ) means a spectral sensitivity deistribition of the green-sensitive layer of the photographic materail; and P(λ) means an energy distribution of the printing light source.

In general, a printing color photographic materail is so printed such that the middle density non-chromatic color may have a determined density on the finished print. Under such standard conditionos, the exposure (Ei) is obtained on the basis of the exposure ($E_{22}$) of the non-chromatic color may have a determined density on the finished print. Under such standard conditions, the exposure (Ei) is obtained on the basis of the exposure ($E_{22}$) of the non-chromatic chart (wherein i is 22 and the optical density if about 0.7) of being 1.0. Accordingly, it may be determined whether or not the exposure (Ei) of the chart (i) is large or small as compared with the standard non-chromatic color from the value Hi which is defined by the following formula (2):

$$Hi = Ei/E_{22} \quad (2)$$

The peak maximum sensitivity wavelength of the green-sensitive layer is considered to be the ideal spectral sensitivity and a delta function type spectral sensitivity distribution having a sensitivity of only 5 nm in the center is detremined, and the Hi value is designated as $Hi^0$. The value $\alpha_i$ as defined by the following formuila (3) represents the deviation from the ideal exposure of the chart (i) color.

$$\alpha_i = Hi/Hi^0 \quad (3)$$

Accordingly, the color mixing degree βi of the chart (i) color is defined by the following formula (4)

$$\beta_i = \alpha_i - 1.0 \quad (4)$$

As shown by the following formula (5), the average of the 18 chromatic colors in the Macbeth Chart is obtained with respect to the color mixing degree $\beta_i$ of the chart (i), and this is defined as the mean color mixing degree (γ).

$$\gamma = \frac{1}{18} \times \sum_{i=1}^{18} |\beta_i| \quad (5)$$

The mean color mixing degree for the blue-sensitive layer of red-sensitive layer may also be defined in the same manner as above, except that the effective wavelength range was replaced by the range of from 390 nm to 485 nm or the range of from 570 nm to 740 nm, respectively.

Using Samples Nos. 101, 102, 103 and 109, a Macbeth Chart was photographed under a standard taking light source (about 5,500° K.). Next, these were developed by the above-mintioned color development process (A). Thus color negative films were obtained. Through each of these color negative films, the printing color photographic paper Sample No. 201 and No. 202 were printed with a printer. The thus printed Sample No. 201 was color-developed by the process (B), while the printed Sample 202 was color-developed in accordance with the process (B) with property adjustment of the development time. Accordingly, prints were obtained from the respective samples.

For these prints, the aforesaid Macbeth Chart color mixing degree ($\beta_i$) was obtained.

The results obtained are shown in Table 2-3 below.

TABLE 2-3

| Color Negative Film | Color Printing Paper | Color Y(i = 16) | Color Mixing Degree βi = 16 | Color Mixing Degree (Filter of the Invention was used.) $\beta_i^F = 16$ |
|---|---|---|---|---|
| Sample 101 | Sample 201 | Y | 0.48 | 0.26 |
| Sample 102 | Sample 201 | Y | 0.44 | 0.24 |
| Sample 103 | Sample 201 | Y | 0.40 | 0.22 |
| Sample 109 | Sample 201 | Y | 0.41 | 0.22 |

TABLE 2-3-continued

| Color Negative Film | Color Printing Paper | Color Y(i = 16) | Color Mixing Degree $\beta i = 16$ | Color Mixing Degree (Filter of the Invention was used.) $\beta_i^F = 16$ |
|---|---|---|---|---|
| Sample 102 | Sample 202 | y | 0.41 | 0.22 |
| Sample 103 | Sample 202 | Y | 0.36 | 0.18 |
| Sample 109 | Sample 202 | y | 0.35 | 0.18 |

From the value of the color mixing degree ($\beta_{i=16}$) shown in Table 2-3 above, it is seen that the sample Nos. 103 and 109 of the present invention formed color prints with lower yellow color mixing degree Y (i=16), as compared with the comparative samples Nos. 101 and 102, when the same color printing paper was used for all the samples. In addition, it is also clear from the results shown in Table 2-4 below that the samples Nos. 104, 105, 106 and 107 were similarly superior, like sample No. 103.

TABLE 2-4

| Color Negative Film | Color Printing Paper | Color Y(i = 16) | Color Mixing Degree $\beta i = 16$ | Color Mixing Degree (Filter of the Invention was used.) $\beta_i^F = 16$ |
|---|---|---|---|---|
| Sample 101 | Sample 202 | Y | 0.46 | 0.25 |
| Sample 104 | Sample 202 | Y | 0.38 | 0.20 |
| Sample 105 | Sample 202 | Y | 0.37 | 0.18 |
| Sample 106 | Sample 202 | Y | 0.36 | 0.18 |
| Sample 107 | Sample 202 | Y | 0.38 | 0.19 |

Figure 4:
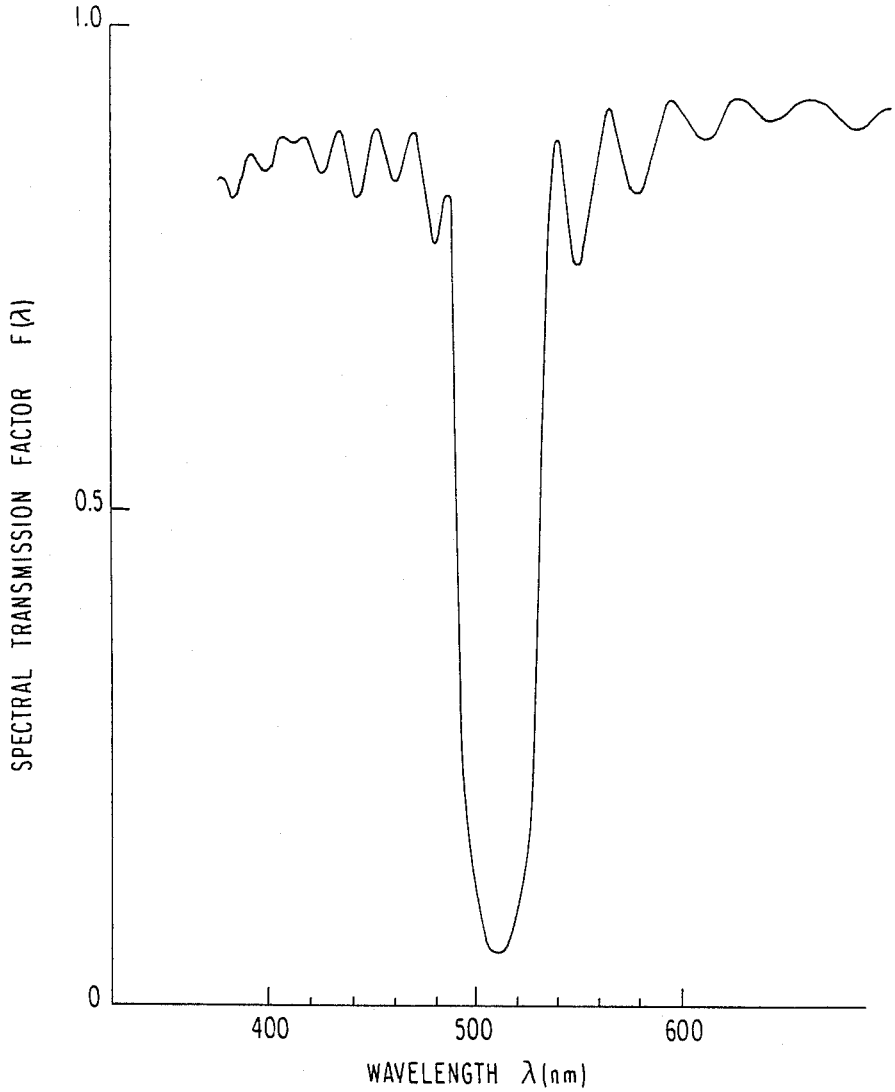
FIG. 4 and FIG. 5 each show a spectral transmittance curve of each of the band stop filters A and B.

Next, a band stop filter having spectral transmittance distribution shown in FIG. 4 was set on a printer (between light source and color negative film) and printing paper samples were printed through the negative film in the same manner as above. Then the color mixing degree $\beta F_{i=16}$ was evaluated. The band stop filter used had the following characteristics:

Wavelength range for $W_{178}$ : 488 to 530 nm $W_{\frac{1}{2}}/W_{\frac{1}{4}}=0.76$ The results obtained are shown in Tables 2-3 and 2-4.

From the results in these tables, it is seen that when the taking color photographic materials of the present invention (samples Nos. 103 to 107 and 109) were used, the magenta color mixing in the yellow color was small, and when the band stop filter of the invention was used, the megenta color mixing became still small.

Regarding the green color $G_{i=14}$, the color mixing preventing capacity was separately evaluated. As a result, it was found that the saturation was elevated and a fresh green image was reproduced when the photographic material samples of the present invention were printed through the band stop filter of the invention.

EXAMPLE 2

Sample No. 203 was prepared in the same manner as the.preparation of Sample No. 201 of Example 1, except that the Compound I-(1) of the invention was added to the second layer (color mixing preventing layer) and the fourth layer (ultraviolet absorbing layer) together with solvent (Solv-2 or Solv-3).

| | |
|---|---|
| Second Layer: color mixing Preventing Layer | |
| Gelatin | 1.20 (g) |
| Color Mixing Preventing Agent (Cpd-2) | 0.05 |
| Compound I-(1) | 0.10 |
| Solvent (Solv-2) | 0.06 |
| Fourth layer: Ultraviolet Absorbing Layer | |
| Gelatin | 1.60 (g) |

-continued

| | |
|---|---|
| Ultraviolet Absorbent (UV-1) | 0.62 |
| Color Mixing Preventing Agent (Cpd-5) | 0.03 |
| Compound I-(1) | 0.05 |
| Solvent (Solv-3) | 0.24 |

Using the taking color photographic material samples Nos. 101 and 103 in Example 1, a Macbeth Color Chart was photographed in the same manner as in Example 1, and the photographed samples were color-developed to obtain color negative films. The band stop filter (A) and band stop filter (B) having the spectral transmittance curves shown in FIGS. 4 and 5, respectively, were set in Auto Printer FAP-3500 Type (manufactured by Fuji Photo Film Co., Ltd.), and the printing color photographic material samples Nos. 201 and 203 obtained in Example 3 were printed through the color negative films obtained as above. The thus-printed samples were color-developed by Fuji Film Standard Color Development Process CP-20 to obtaine color prints. The thus obtainedf color prints were evaluated with respect to the color reproducibility of yellow $Y_{i=16}$ and the green $G_{i=14}$. As a result, it was noted by visual observation with the naked eye that the magneta color mixing in the yellow image and in the green image was smaller in the prints obtained from the color negative sample Nos. 101 and 103 than from the sample No. 203.

While the invention has been described in detail and with reference to specific embodiments thereof, it will be apparent to one skilled in the art that various changes and modifications can be made therein without departing from the spirit and scope thereof.

What is claimed is:

1. A method of forming a color image wherein a color print original is printed on a printing color photographic material and the thus printed material is then subjected to color development to give a color print, which is characterized in that a band stop filter having a half width of the spectral transmittance curve of said filter in a wavelength range outside the region of the maximum spectral sensitivity wavelength ($\lambda$max)$\pm$20 nm of at least one light-sensitive layer of the printing color photographic material is provided between the light source to be used in said printing step and the light-sensitive layer of said printing color photographic material, and in that a compound of a general formula (I):

$(C_p).X$ (I)

wherein $C_p$ represents a coupler residue capable of coupling with the oxidation product of a color developing agent to form a substantially colorless compound or a coupler residue which is coupled during a color development step to form a compound capable of being dissolved or diffused out of the layer of the photographic material; and X represents a group which is in the coupling position of the coupler and which may react with the oxidation product of a developing agent or which may react therewith to be released from the coupler, is incorporated into the light-sensitive layer of the said printing color photographic material or a taking color photographic material from which the said color print original is obtained, or into the interlayer existing between the light-sensitive layers of the said material.

2. The method as claimed in claim 1, wherein said band stop filter has a half width in a wavelength range outside the maximum spectral sensitivity wavelength λmax±30 nm of at least one light-sensitive layer of said printing color photographic material.

3. The method as claimed in claim 1, wherein the half width $W_{\frac{1}{2}}$ of said band stop filter is from 5 to 60 nm.

4. The method as claimed in claim 1, wherein the ratio of the $\frac{1}{4}$ width of the spectral transmittance curve of said band stop filter to the $\frac{3}{4}$ width of the spectral transmittance curve of said band stop filter is at least 0.35.

5. The method as claimed in claim 1, wherein a light for imagewise exposing said printing color photographic material is passed through said band stop filter and at least one filter selected from an infrared absorption filter, a color correcting filter and a neutral density filter.

6. The method as claimed in claim 1, wherein said band stop filter comprises a substrate having thereon alternating plural thin layers of at least two dielectric substances having different reflective indices.

7. The method as claimed in claim 1, wherein said band stop filter has a minimum transmittance of at most 30%.

8. The method as claimed in claim 1, wherein the half width of the spectral transmittance curve of said band stop filter is in a range of at least one of 480 to; 540 nm and/or 570 to 630 nm.

9. The method as claimed in claim 5, wherein said light is passed through at least one of an ultraviolet absorption filter having an absorption in a wavelength range shorter than 420 nm or an infrared absorption filter having an absorption in a wavelength range longer than 750 nm.

10. The method as claimed in claim 1, wherein said filter comprises a substrate having thereon plural alternating silicon oxide layers and aluminum oxide layers.

11. The method as claimed in claim 10, wherein said substrate has a thickness of from 0.2 nm to 2 nm, and each of said silicon oxide layers and aluminum oxide layer has a film thickness of from 300 Å to 5,000 521 .

12. The method as claimed in claim 10, wherein said band stop filter comprises at least 7 silicon oxide layers and at least 7 aluminum oxide layers.

13. The method as claimed in claim 12, wherein said filter comprises from 21 to 101 silicon oxide layers and from 21 to 101 aluminum oxide layers.

14. The method as claimed in claim 1, wherein said compound represented by formula (I) is represented by formula (II):

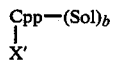

(II)

in which Sol represents an alkali-soluble group; b is an integer of from 1 to 3; Cpp represents a group of capable releasing X' by a coupling reaction with the oxidation product of a developing agent; and X' represents a coupling-off group containing a non-diffusible group.

15. The method as claimed in claim 14, wherein said compound represented by formula (II) is represented by at least one of the following formulae (Cp-1), (Cp-2), (Cp-3), (Cp-4), (Cp-5), (Cp-6), (Cp-7), or (Cp-8):

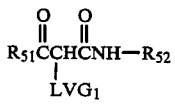

(Cp-1)

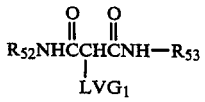

(Cp-2)

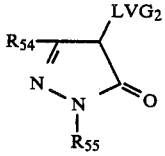

(Cp-3)

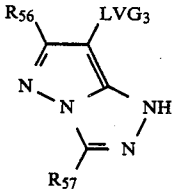

(Cp-4)

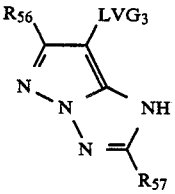

(Cp-5)

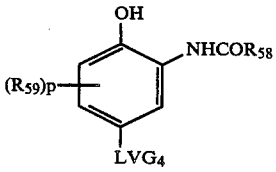

(Cp-6)

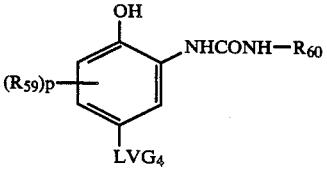

(Cp-7)

-continued

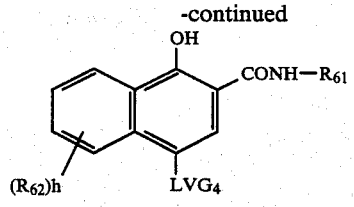

(Cp-8)

wherein $R_{51}$ represents a group $R_{41}$;

$R_{52}$ and $R_{53}$, which may be the same or different, each represents an aromatic group or a heterocyclic group;

$R_{54}$ represents a group $R_{41}$, $R_{41}CON(R_{43})-$, $R_{41}N(R_{43})-$, $R_{41}SO_2N(R_{43})-$, $R_{41}S-$, $R_{43}O-$, $R_{45}NCON(R_{43})(R_{44})-$, $R_{43}OOC-$, $R_{44}NCO(R_{43})-$, or $N\equiv C-$;

$R_{55}$ represents a group $R_{41}$;

$R_{56}$ and $R_{57}$, which may be the same or different, each represents a group $R_{43}$, $R_{41}S-$, $R_{43}O-$, a carboxyl group, $R_{41}CON(R_{43})-$, $R_{41}N(R_{43})-$, $R_{41}OCON(R_{43})-$, $R_{43}NCON(R_{44})(R_{45})-$, or $R_{41}SO_2N(R_{43})-$;

$R_{58}$ represents a group $R_{41}$;

$R_{59}$ represents a group $R_{41}$, $R_{41}CON(R_{43})-$, $R_{41}OCON(R_{43})-$, $R_{41}SO_2N(R_{43})-$, $R_{43}OOC-$, $R_{43}NCON(R_{44})(R_{45})-$, $R_{44}NSO_2N(R_{44})(R_{45})-$, a sulfonic acid group or a salt thereof, $R_{41}O-$, $R_{41}S-$, a halogen atom or $R_{41}N(R_{43})-$;

p is 0 or an integer of 1 to 3; and the plural $R_{59}$ groups may be the same or different;

$R_{60}$ is a group $R_{41}$;

$R_{61}$ is a group $R_{41}$;

$R_{62}$ is a group $R_{41}$, $R_{41}CONH-$, $R_{41}OCONH-$, $R_{41}SO_2NH-$, a carboxyl group, a sulfonic acid group, a sulfonic acid salt $R_{43}NCON(R_{44})(R_{45})-$, $R_{43}NSO_2N(R_{44})(R_{45})-$, $R_{43}O-$, $R_{41}S-$, a halogen atom or $R_{41}N(R_{43})-$;

h is 0 or an integer of from 1 to 4, and plural $R_{62}$ groups may be the same or different;

wherein $R_{41}$ represents an aliphatic group, an aromatic group or a heterocyclic group; $R_{43}$, $R_{44}$, and $R_{45}$, which may be the same or different, each represents hydrogen, an aliphatic group, an aromatic group or a heterocyclic group; and $LVG_1$ represents $R_{65}O-$, an imido group bonded to the coupling position via nitrogen atom, a 5-membered or 6-membered unsaturated nitrogen-containing heterocyclic group bonded to the coupling position via a nitrogen atom or $R_{66}S-$; $LVG_2$ represents $R_{66}S-$, $R_{65}O-$, $R_{65}-N=N-$ or a 5-membered or 6-membered unsaturated nitrogen-containing heterocyclic group bonded to the coupling position via a nitrogen atom, $LVG_3$ represents $R_{66}S-$ or a 5-membered or 6-membered unsaturated nitrogen-containing heterocyclic group bonded to the coupling position via a nitrogen atom; $LVG_4$ represents $R_{66}O-$, $R_{65}-N=N-$ or $R_{66}S-$, wherein $R_{65}$ represents an aromatic group or a heterocyclic group, and $R_{66}$ represents an aromatic group or a heterocyclic group, and the number of total carbon atoms contained in $R_{65}$ or $R_{66}$ is from 10 to 40.

16. The method as claimed in claim 1, wherein said compound represented by formula (I) is present in an amount of from $10^{-6}$ to $10^{-1}$ mol per mol of silver halide in said photographic material.

17. The method as in claim 1, wherein the compound of the formula (I) is incorporated into the interlayer between the yellow coupler-containing blue-sensitive layer and the magenta coupler-containing green-sensitive layer of the taking color photographic material and the band stop filter to be used in the step of printing the color negative film original obtained from the said taking color photographic material on a printing color photographic material has a half width ($W_{\frac{1}{2}}$) of the spectral transmittance curve of the filter in the wavelength range from 480 to 540 nm and has a ratio of $W_{\frac{1}{4}}$ ($\frac{1}{4}$ value width of the spectral transmittance curve of the filter) to $W_{\frac{3}{4}}$ ($\frac{3}{4}$ value width of the spectral transmittance curve of the filter) of being 0.35 or more.

18. The method as in claim 1, wherein the compound of the formula (I) is incorporated into the interlayer between the magenta coupler-containing green-sensitive layer and the cyan coupler-containing red-sensitive layer of the taking color photographic material.

19. The method as in claim 1, wherein the compound of the formula (I) is incorporated into the interlayer between the blue-sensitive layer and the green-sensitive layer, the interlayer between the green-sensitive layer and red-sensitive layer of the green-sensitive layer of taking color photographic material, and the color negative film original obtained from the said material is printed via a combination of a band stop filter having the $W_{\frac{1}{2}}$ value in the wavelength range from 480 to 530 nm and the ratio of $W_{\frac{1}{2}}/W_{\frac{3}{4}}$ of being 0.5 or more and band stop filter having the $W_{\frac{1}{2}}$ value in the wavelength range from 570 to 630 nm and the ratio of $W_{\frac{1}{4}}/W_{182}$ of being 0.35 or more.

* * * * *